US005154995A

United States Patent [19]

Kawai

[11] Patent Number: 5,154,995

[45] Date of Patent: Oct. 13, 1992

[54] SILVER HALIDE COLOR PHOTOGRAPHIC MATERIAL AND PROCESS FOR THE FORMATION OF COLOR IMAGES THEREON

[75] Inventor: Kiyoshi Kawai, Kanagawa, Japan

[73] Assignee: Fuji Photo Film Co., Ltd., Kanagawa, Japan

[21] Appl. No.: 538,358

[22] Filed: Jun. 13, 1990

[30] Foreign Application Priority Data

Jun. 13, 1989 [JP] Japan ..... 1-150308

[51] Int. Cl.[5] ..... G03C 7/20; G03C 7/30

[52] U.S. Cl. ..... 430/22; 430/356; 430/363; 430/503; 430/506; 430/508; 430/571; 430/572; 430/576; 430/944

[58] Field of Search ..... 430/502, 503, 509, 394, 430/576, 581, 582, 583, 584, 585, 944, 359, 363, 504, 506, 508, 571, 22, 572, 383, 356

[56] References Cited

U.S. PATENT DOCUMENTS

| | | | |
|---|---|---|---|
| 2,357,388 | 9/1947 | Duerr et al. | 430/394 |
| 2,360,214 | 10/1944 | Evans et al. | 430/504 |
| 2,578,333 | 12/1951 | Yule | 430/394 |
| 2,927,024 | 3/1960 | Woodward et al. | 430/508 |
| 3,558,308 | 7/1967 | Fletcher | 430/394 |
| 4,269,932 | 5/1981 | Moran et al. | 430/394 |
| 4,707,436 | 11/1987 | Sasaki | 430/504 |
| 4,745,040 | 5/1988 | Levine | 430/21 |
| 4,770,961 | 9/1988 | Tanaka et al. | 430/944 |
| 4,770,980 | 9/1988 | Matejec et al. | 430/504 |
| 4,777,102 | 10/1988 | Levine | 430/21 |
| 4,801,525 | 1/1989 | Mihara et al. | 430/944 |
| 4,806,460 | 2/1989 | Ogawa et al. | 430/504 |
| 4,816,378 | 3/1989 | Powers et al. | 430/944 |
| 4,837,133 | 6/1989 | Kuhn | 430/363 |
| 4,873,170 | 10/1989 | Nishinori et al. | 430/944 |
| 4,902,609 | 2/1990 | Hahn | 430/504 |
| 4,943,517 | 7/1990 | Powers et al. | 430/944 |

FOREIGN PATENT DOCUMENTS

| | | | |
|---|---|---|---|
| 209590 | 5/1956 | Australia | 430/394 |

OTHER PUBLICATIONS

James, T. H., *The Theory of the Photographic Process*, chpt. 8, pp. 194–205, 1977.

James, T. H., *The Theory of the Photographic Process*, Chpt. 18, pp. 517–519, 1977.

*Primary Examiner*—Richard L. Schilling

*Attorney, Agent, or Firm*—Sughrue, Mion, Zinn, Macpeak & Seas

[57] ABSTRACT

A novel silver halide color photographic material is provided which comprises a support having coated thereon at least three silver halide emulsion layers having maximum spectral sensitivities in at least three sensitive wavelength ranges of 400 nm to 500 nm, 500 nm to 570 nm and 650 nm to 730 nm and is sensitive to said three sensitive wavelength ranges to form yellow, magenta and cyan dye images, respectively, characterized in that said silver halide color photographic material has additionally at least one function to provide a maximum spectral sensitvity in wavelength range other than said three sensitive wavelength ranges and to form any of yellow, magenta or cyan dye image by an exposure to the light of said other range. A color image formation method is also disclosed which comprises exposing said silver halide color photographic material to light in a print exposure process in combination with a scanning exposure process, and then developing said silver halide color photographic material.

12 Claims, No Drawings

SILVER HALIDE COLOR PHOTOGRAPHIC MATERIAL AND PROCESS FOR THE FORMATION OF COLOR IMAGES THEREON

FIELD OF THE INVENTION

The present invention relates to a silver halide color photographic material which can form print images thereon directly thereon from a color negative or color reversal film and further can undergo scanning exposure to high density light from laser or light-emitting diode to form color images thereon. The present invention also relates to a method for the formation of color images using such a silver halide color photographic material.

BACKGROUND OF THE INVENTION

In recent years, data processing technology has experienced rapid advances in systems wherein image data are transferred, stored or reproduced on a CRT in the form of electrical signals. These advances have increased the need for providing hard copy from these image data. Thus, various hard copying techniques have been proposed in this field of endeavor.

Most of these hard copying techniques serve to provide hard copies by converting image or letter data from electrical signals to intensity of heat or light or amount of dyes. The hard copying materials used in these hard copying techniques include those with use of silver halide and also those without use of silver halide. In respect to picture quality, those using silver halide are superior. Examples of hard copying materials or systems which provide hard copies with high picture quality include Pictrography (available from Fuji Photo Film Co., Ltd.), which employs a silver halide heat developable dye diffusion process and an LED scanning exposure process, and Fuji Photo ID Card System (available from Fuji Photo Film Co., Ltd.), which employs a color paper in combination with a CRT scanning exposure process.

Thus, as a process for obtaining hard copies from electrical signals, a conventional scanning exposure process comprises sequentially retrieving image date to be used for exposure. This exposure process is very advantageous in that when letter data are printed, then their colors, sizes and locations can be independently predetermined in connection with output from computers. However, the exposure to image data requires elaborate apparatus for reading, storing and outputting image data. Furthermore, images thus obtained exhibit a poor picture quality as compared to image formed on currently available light-sensitive materials such as color negative films comprising silver halide and color papers comprising silver halide. Therefore, this conventional exposure technique is not ordinarily used to provide hard copy from image data.

Accordingly, in the case of data consisting of images and letters, e.g., a post card, the images are conventionally printed on a color paper from a color negative film while letters are contact-printed on the color paper through a lithographic plate simultaneously with the images, thereby obtaining both image and letter data at the same time.

Therefore, it has been highly desireable to provide a system which can make the best combined use of the silver halide photographic material printing process and the electrical signal scanning exposure process such that image data are printed through high quality pictures on a silver halide photographic material, such as color negative films and color reversal films, while letter data or illustration data can be easily edited by computers, and electrically outputted and printed.

SUMMARY OF THE INVENTION

It is therefore an object of the present invention to provide a silver halide photographic material which can provide both high quality pictures in a printing process and hard copy of letters, illustrations or electronic images easily in a scanning exposure process using electrical signals.

The above and other objects of the present invention will become more apparent from the following detailed description and examples.

These objects of the present invention are accomplished with a silver halide color photographic material which comprises a support having coated thereon at least three silver halide emulsion layers having maximum spectral sensitivities falling in at least the three wavelength ranges of 400 nm to 500 nm, 500 nm to 570 nm and 650 nm to 730 nm and is sensitive to said three wavelength ranges to form yellow, magenta and cyan dye images, respectively. The silver halide color photographic material has further at least one function to provide a maximum spectral sensitivity in wavelength range other than the above-mentioned three sensitive wavelength ranges and is sensitive to such additional wavelength range to form any of yellow, magenta and cyan dye image by an exposure to the light of the additional other wavelength range.

DETAILED DESCRIPTION OF THE INVENTION

The conventional color papers have spectral sensitivity characteristics which are adapted for printing from color negative films, color reversal films or the like but are not optimal for typical light sources, e.g., laser, light-emitting diode, CRT, employed in scanning exposure methods using electrical signal. The light-sensitive material of the present invention has a spectral sensitivity adapted for printing from color negative films, color reversal films or the like and at least one spectral sensitivity adapted for a light source, e.g., for coloring magenta, to be used in the scanning exposure process, preferably each for yellow, magenta and cyan coloring.

The spectral sensitivity for each of a yellow, magenta and cyan coloring as adapted for the light source in the scanning exposure process is determined as based upon the wavelength of the light source to be used in the scanning exposure process. If these, spectral sensitivities overlap the sensitive wavelength range of the a light-sensitive material suitable for printing from color negative films, then the sensitive wavelength range can be used also as the spectral sensitivity range for the scanning exposure process. However, it is difficult to cover all the three maximum spectral sensitivities because of limitations on the wavelength of laser as the light source for use in the scanning exposure process.

In particular, if the conventional color printing light sensitive material (maximum spectral sensitivities: 480 nm, 550 nm and 710 nm) is used to effect a scanning exposure, it is difficult to select a scanning exposure light source suitable for these spectral sensitivities from available conventional lasers. If conventional lasers must be used as the scanning exposure light source, only the following two approaches are possible:

(1) The combined use of three kinds of gas lasers: He-Cd (441.6 nm), Ar (514.5 nm) and He-Ne (632.8 nm); and (2) An infrared semiconductor laser (900 nm, 1,200 nm) and a non-linear optical material are combined so that the second harmonics (450 nm, 600 nm) of the laser oscillation wavelength and its sum frequency (514 nm) can be used.

However, if such an infrared semiconductor light source is used, the exposure must be effected in a wavelength drastically shifted from the maximum spectral sensitivity, particularly, for the scanning exposure light source for cyan coloring. In particular, if the above-described exposure approach (2) is used, the amount of light supplied therefrom is too limited, making it impossible to effect exposure at a satisfactory rate. This approach is also disadvantageous in that non-linear optical materials are inadequate in stability and longevity. Furthermore, the above-described exposure approach (1) is disadvantageous in that it requires bulky and expensive equipment and, is thus is not well adapted for attaining the objects of the present invention.

Therefore, in order to accomplish the present object of easily obtaining high quality pictures at a low cost, it is necessary that the scanning exposure apparatus be a cheap, compact and stable light source. In this respect, semiconductor lasers are preferably used. In this case, conventional semiconductor lasers available include only those which can affect exposure at a spectral sensitivity of longer than 650 nm. Therefore, semiconductor lasers must be provided having the capability to affect exposure at new spectral sensitivity wavelengths.

Thus, to this end, the present light-sensitive invention can have maximum spectral sensitivities in wavelength ranges other than the conventional sensitive wavelength range adapted for printing and can be sensitive to these other wavelength ranges to form any of yellow, magenta and cyan dye images.

The above mentioned spectral sensitivity will be further described hereinafter. The light-sensitive material of the present invention needs to have maximum spectral sensitivities in wavelength ranges of 400 to 500 nm, 500 to 570 nm and 650 to 730 nm, respectively, and comprises at least one respective emulsion layer containing a coupler which reacts with an oxidation product of a developing agent to develop yellow, magenta and cyan colors.

The maximum spectral sensitivities in the ranges of 400 to 500 nm, 500 to 570 nm and 650 to 730 nm are suitable for printing from color negative films, color. reversal films or the like.

The light-sensitive material of the present invention needs to further have at least one function to provide a maximum spectral sensitivity in a wavelength range other than these three sensitive wavelength ranges and be sensitive to these other ranges to form any of yellow dye images, magenta dye images and cyan dye images. In particular, for yellow coloring, a maximum spectral sensitivity is preferably provided in a wavelength range of longer than 570 nm (more preferably 730 nm or more, particularly 740 nm or more). For magenta coloring, a maximum spectral sensitivity is preferably provided in a wavelength range of longer than 570 nm. For cyan coloring, a maximum spectral sensitivity may be provided in a wavelength range from 570 nm to 650 nm or in a wavelength range of longer than 730 nm. The maximum spectral sensitivities for yellow, magenta and cyan coloring can be in various combinations. In a preferred combination, both the maximum spectral sensitivities for yellow and magenta coloring layers exist in a wavelength range of 730 nm or more (more preferably 740 nm or more for yellow coloring layer), and the maximum spectral sensitivity for cyan coloring layer does not exist in any wavelength range other than the range of 650 to 730 nm.

The light-sensitive material of the present invention can undergo scanning exposure by means of a scanning exposure apparatus at the same time with printing exposure to light through color negative films, color reversal films or the like. Examples of light sources which can be used for scanning exposure include glow lamp, xenon lamp, mecury vapor lamp, tunsten lamp, CRT, light-emitting diode, gas lasers such as He-Ne laser, argon laser, and He-Cd laser, coherent lasers such as a semiconductor laser, and light sources combined with wavelength conversion elements consisting of semiconductor lasers and non-linear optical materials. Among these light sources, light-emitting diodes (LED) and lasers are preferably used in view of light intensity, stability, longevity, ease of modulation, and economy. Particularly preferred among these light sources are semiconductor lasers and semiconductor lasers combined with wavelength conversion elements comprising non-linear optical materials. Therefore, the spectral sensitivities to be provided, aside from and in addition to the spectral sensitivity suitable for printing, are determined according to the wavelength of the light source used in the scanning exposure process.

Specific examples of spectral sensitivities and scanning exposure apparatus to be used therefor will be set forth in Table 1 below, but the present invention should not be construed as being limited thereto.

The process for providing spectral sensitivities for scanning exposure besides the spectral sensitivity suitable for printing will be further described hereinafter.

For example, such processes involve the provision of a photographic material comprising silver halide emulsion layer having a maximum spectral sensitivity in a wavelength range of 400 nm to 500 nm and containing yellow coupler, and also it is desired to provide sensitivity to a wavelength (hereinafter "λ nm") of 570 nm or more for yellow coloring. This photographic material is arranged to include (1) a silver halide emulsion having a maximum spectral sensitivity to λ nm and a yellow coupler is incorporated into a layer other than the silver halide emulsion layer sensitive to a wavelength range of 400 nm to 500 nm; or (2) a mixture of a silver halide emulsion having a spectral sensitivity to a wavelength range of 400 to 500 nm and a silver halide emulsion sensitive to λ nm, wherein the silver halide emulsions have been separately prepared, and a yellow coupler may be combined and coated as a single layer; or (3) an emulsion obtained by adding both spectral sensitizing dye having a maximum spectral sensitivity to 400 to 500 nm and a spectral sensitizing dye having a maximum spectral sensitivity to λ nm to a common silver halide emulsion so that silver halide grains therein are provided having maximum spectral sensitivities to both the ranges of 400 to 500 nm and λ nm, and this silver halide emulsion may be coated together with a yellow coupler. In this case, the respective light-sensitive layer in the embodiments (1), (2) and (3) may be present in a plurality of layers for the purpose of gradation or other useful purposes.

In the same way, the process (1), (2) or (3) as described above may involve the provision of a silver halide emulsion layer having a maximum spectral sensitivity in a wavelength range of longer than 570 nm but shorter than 650 nm and being sensitive to the wavelength range to provide magenta coloring, and a silver halide emulsion layer having a maximum spectral sensitivity in a wavelength range of longer than 730 nm and being sensitive to the wavelength range to provide cyan coloring.

TABLE 1

| | Maximum spectral sensitivity (nm) | | | Scanning exposure light source | | |
|---|---|---|---|---|---|---|
| | Yellow coloring layer | Magenta coloring layer | Cyan coloring layer | Light source | Wavelength (nm) | |
| 1 | 480 | 550/510 | 710[4)] | He—Cd laser | 441.6 | Y |
| | | | 630[5)] | Ar laser | 514.5 | M |
| | | | | He—Ne laser | 632.8 | |
| 2 | 480 | 550/510 | 710[4)] | GaAs (900) + SHG[1)] | 450 | Y |
| | | 600[5)] | | InGaAs (1200) + SHG | 600 | M |
| | | | | InGaAs (1300) + SH | 650 | C |
| 3 | 480 | 550/510 | 710[4)] | GaAs (900) + SHG | 450 | Y |
| | | | 600[5)] | InGaAs (1200) + SHG | 600 | C |
| | | | | Above Described sum frequency[2)] | 514 | M |
| 4[3)] | 480 | 550/510 | 710[4)] | AlGaInAs (670) | 670 | C |
| | 750[5)] | 810[5)] | | GaAlAs (750) | 750 | |
| | | | | GaAlAs (810) | 810 | M |
| 5[3)] | 480 | 550/510 | 710[4)] | AlGaInAs (670) | 670 | C |
| | 750[5)] | 830[5)] | | GaAlAs (750) | 750 | Y |
| | | | | GaAlAs (830) | 830 | M |
| 6[3)] | 480 | 550/510 | 710[4)] | AlGaInAs (670) | 670 | C |
| | 780[5)] | 830[5)] | | GaAlAs (780) | 780 | Y |
| | | | | GaAlAs (830) | 830 | M |
| 7[3)] | 480 | 550/510 | 710[4)] | AlGaInAs (670) | 670 | C |
| | 780[5)] | 880[5)] | | GaAlAs (780) | 780 | Y |
| | | | | GaAlAs (880) | 880 | M |
| 8[3)] | 480 | 550/510 | 710[4)] | LED (580) | 580 | M |
| | 810[5)] | 580[5)] | | LED (665) | 665 | C |
| | | | | LED (810) | 810 | Y |

1) SHG: using second higher harmonics produced by non-linear optical elements

2) Obtained by two lasers (900 nm, 1,200 nm) and a non-linear optical element

3) Added maximum spectral sensitivities 5) for the yellow coloring layer and magenta coloring layer can be exchanged 4) Broad spectral sensitivity in a wavelength range of 650 to 730 nm (max. spectral sensitivity at 710 nm)

5) These maximum spectral sensitivities are added to the conventional maximum spectral sensitivities.

The spectral sensitizing dyes to be used in the present invention will be further described hereinafter.

As the spectral sensitizing dye sensitive to light of 400 to 500 nm there is preferably used at least one of compounds represented by the general formula (I):

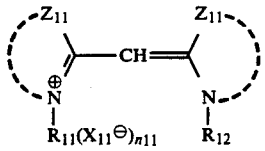

(I)

wherein $Z_{11}$ and $Z_{12}$ each represents an atomic group selected from the group consisting of benzoxazole nucleus, naphthoxazole nucleus, benzothiazole nucleus and naphthothiazole nucleus which may be substituted by halogen atom, alkyl group, alkoxy group, aryl group or hydroxyl group; $R_{11}$ and $R_{12}$ each represents a substituted or unsubstituted alkyl group: $X_{11}^{\theta}$ represents an anion; and $n_{11}$ represents an integer 0 or 1, with the proviso that at least one of $Z_{11}$ and $Z_{12}$ represents a benzothiazole nucleus or naphthothiazole nucleus and that if one of $R_{11}$ and $R_{12}$ forms an inner salt with quarternarized nitrogen atoms, $n_{11}$ is 0.

Preferred examples of functional groups which substitute for the heterocyclic groups formed of $Z_{11}$ and $Z_{12}$ include halogen atoms such as fluorine, chlorine and bromine, alkyl groups such as methyl, ethyl and propyl, alkoxy groups such as methoxy, ethoxy and propoxy, and aryl groups such as phenyl and p-tolyl. Preferred examples of the substituted or unsubstituted alkyl group represented by $R_{11}$ and $R_{12}$ include methyl group, ethyl group, n-propyl group, i-propyl group, 2-hydroxyethyl group, 4-hydroxyethyl group, 2-acetoxyethyl group, 3-acetoxypropyl group, 2-methoxyethyl group, 4-methoxybutyl group, 2-carboxyethyl group, 3-carboxypropyl group, 2-(2-carboxyethoxy)ethyl group, 2-sulfoethyl group, 3-sulfopropyl group, 3-sulfobutyl group, 4-sulfobutyl group, 2-hydroxy-3-sulfopropyl group, 2-(3-sulfopropoxy)ethyl group, 2-acetoxy-3-sulfopropyl group, 3-methoxy-2-(3-sulfopropoxy)propyl group, 2-[2-(3sulfopropoxy)ethoxy]ethyl group, and 2-hydroxy-3-(3-sulfopropoxy)propyl group.

As the spectral sensitizing dye sensitive to light of 500 to 570 nm, these can be preferably selected from dyes represented by the general formula (II) below. These dyes can be used singly or in combination.

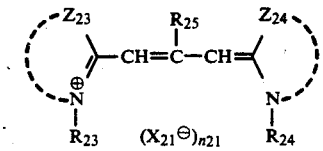

(II)

wherein $Z_{23}$ and $Z_{24}$ each represents an atomic group selected from the group consisting of benzoxazole nucleus, naphthoxazole nucleus, benzothiazole nucleus and naphthothiazole which may be substituted by halogen atom, alkyl group, alkoxy group, aryl group and hydroxyl group; $R_{25}$ represents a hydrogen atom or alkyl group; $R_{23}$ and $R_{24}$ each represents a substituted or unsubstituted alkyl group; $X_{21}^{\theta}$ represents an anion; and $n_{21}$ represents an integer 0 or 1, with the proviso that if one of $R_{23}$ and $R_{24}$ forms an inner salt with quarternarized nitrogen atoms, $n_{21}$ is 0.

Preferred examples of functional groups which substitute for the heterocyclic groups formed of $Z_{23}$ and $Z_{24}$ include halogen atom such as fluorine, chlorine and bromine, alkyl group such as methyl, ethyl and propyl, alkoxy group such as methoxy, ethoxy and propoxy, and aryl group such as phenyl and p-tolyl.

Preferred examples of the group represented by $R_{25}$ include hydrogen atom, and alkyl group such as methyl group, ethyl group, propyl group and butyl group. Preferred among these alkyl groups are ethyl group and propyl group. Preferred examples of the substituted or unsubstituted alkyl group represented by $R_{23}$ or $R_{24}$ include methyl group, ethyl group, n-propyl group, i-propyl group, 2-hydroxyethyl group, 4-hydroxybutyl group, 2-acetoxyethyl group, 3-acetoxypropyl group, 2-methoxyethyl group, 4-methoxybutyl group, 2-carboxyethyl group, 3-carboxypropyl group, 2-(2-carboxyethoxy)ethyl group, 2 sulfoethyl group, 3-sulfopropyl group, 3-sulfobutyl group, 4-sulfobutyl group, 2-hydroxy-3-sulfopropyl group, 2-(3-sulfopropoxy)ethyl group, 2-acetoxy-3-sulfopropyl group, 3-methoxy-2-(3-sulfopropoxy)propyl group, 2-[2-(3-sulfopropoxy)ethoxy]ethyl group, 2-hydroxy-3-(3-sulfopropoxy)propyl group, benzyl group, and phenetyl group.

As the spectral sensitizing dye sensitive to light of 650 to 750 nm there can be preferably selected from dyes represented by the general formula (II), wherein at least one of $Z_3$ and $Z_{24}$ of the above mentioned general formula (II) represents benzothiazole nucleus or naphthothiazole nucleus, which are designated as dye (II'), and also the following general formula (III). The dyes of general formula (II) and general formula (III) can be used singly or in combination.

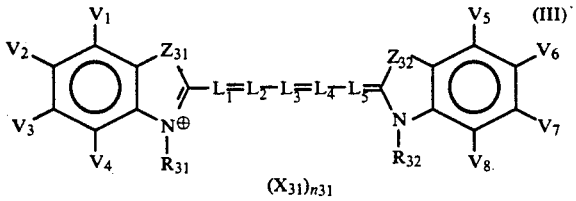

In the general formula (III), $Z_{31}$ represents a nitrogen atom, oxygen atom, sulfur atom or selenium atom. $Z_{32}$ represents an oxygen atom, sulfur atom or selenium atom.

$L_1$, $L_2$, $L_3$, $L_4$ and $L_5$ each represents a methine group which may be substituted with a substituted or unsubstituted alkyl group, e.g., methyl, ethyl, substituted or unsubstituted aryl group, e.g., phenyl, or halogen atom, e.g., chlorine, bromine, or may form a ring with other methine groups.

$R_{31}$ and $R_{32}$ may be the same or different and each represents an alkyl group. Preferred examples of such an alkyl group include unsubstituted alkyl group containing 18 or less carbon atoms, e.g., methyl, ethyl, propyl, butyl, pentyl, octyl, decyl, dodecyl, octadecyl, and a substituted alkyl group, e.g., an alkyl group containing 18 or less carbon atoms substituted by substituents such as a carboxy group, sulfo group, cyano group, halogen atom, e.g., fluorine, chlorine, bromine; a hydroxyl group; an alkoxycarbonyl group containing 8 or less carbon atoms, e.g., methoxycarbonyl, ethoxycarbonyl, phenoxycarbonyl, benzyloxycarbonyl; an alkoxy group containing 8 or less carbon atoms, e.g., methoxy, ethoxy, benzyloxy, phenethyloxy; a monocyclic aryloxy group containing 10 or less carbon atoms, e.g., phenoxy, p-tolyloxy; an acyloxy group containing 3 or less carbon atoms, e.g., acetyloxy, propionyloxy; an acyl group containing 8 or less carbon atoms, e.g., acetyl, propionyl, benzoyl, mesyl; a carbamoyl group, e.g., carbamoyl, N,N,-dimethylcarbamoyl, morpholinocarbonyl, piperidinocarbonyl; a sulfamoyl group, e.g., sulfamoyl, N,N-dimethylsulfamoyl, morpholinosulfonyl, piperidinosulfonyl; and an aryl group containing 10 or less carbon atoms, e.g., phenyl, 4-chlorophenyl, 4-methylphenyl, α-naphthyl.

Particularly preferred among these alkyl groups are an unsubstituted alkyl group, e.g., methyl, ethyl, and sulfoalkyl group, e.g., 2-sulfoethyl, 3-sulfopropyl, 4-sulfobutyl. .

$R_{31}$ and $L_1$, and/or $R_{32}$ and $L_5$ may be connected to each other to form a 5- or 6-membered carbon ring.

$V_1$, $V_2$, $V_3$, $V_4$, $V_5$, $V_6$, $V_7$ and $V_8$ each can represent a hydrogen atom; a halogen atom, e.g., chlorine, fluorine, bromine, an unsubstituted alkyl group, preferably an unsubstituted alkyl group containing 10 or less carbon atoms, e.g., methyl, ethyl, a substituted alkyl group, preferably 18 or less carbon atoms, e.g., benzoyl, a-naphthylmethyl, 2-phenylethyl, trifluoromethyl, an acyl group, preferably an acryl group containing 10 or less carbon atoms, e.g., acetyl, benzoyl, mesyl, acyloxy group, and preferably an acyloxy group containing 10 or less carbon atoms, e.g., acetyloxy, alkoxycarbonyl group, preferably an alkoxycarbonyl group containing 10 or less carbon atoms, e.g., methoxycarbonyl, ethoxycarbonyl, benzyloxycarbonyl; a substituted or unsubstituted carbamoyl group, e.g., carbamoyl, N,N-dimethylcarbamoyl, morpholinocarbonyl, piperidinocarbonyl; a substituted or unsubstituted sulfamoyl group, e.g., sulfamoyl, N,N-dimethylsulfamoyl, morpholinosulfonyl, piperidinosulfonyl; a carboxy group; a cyano group; a hydroxyl group; an amino group; an acylamino group, preferably an acylamino group containing 8 or less carbon atoms, e.g., acetylamino; an alkoxy group; preferably alkoxy group containing 10 or less carbon atoms, e.g., methoxy, ethoxy, benzyloxy; an alkylthio group, e.g., ethylthio, alkylsulfonyl group, e.g., methylsulfonyl; a sulfonic acid group, an aryloxy, e.g., phenoxy; or an aryl group, e.g., phenyl, tolyl. Among $V_1$ to $V_8$, those two groups which are connected to adjacent carbon atoms may be connected to each other to form a condensed ring. Examples of such a condensed ring include benzene ring, and heterocyclic group, e.g., pyrrole, thiophene, furan, pyridine, imidazole, triazole, thiazole.

When it is necessary to neutralize ionic charge of the dye, $(X_{31})n_{31}$ is contained in the formula to indicate the presence or absence of cations or anions. Therefore, $n_{31}$ can take a proper value of 0 or more as necessary. Whether such a dye is a cation or anion or has no net ionic charge depends on its auxochrome and substituents. Paired ions $(X_{31})_{n31}$ can be easily replaced after the preparation of the dye. Typical cations are inorganic or organic ammonium ions and alkaline metal ions. On the other hand, the anions may be either inorganic or organic anions. Examples of such anions include halogen anions, e.g., fluorine ion, chlorine ion, bromine ion, iodine ion; substituted arylsulfonic acid ions, e.g., p-toluenesulfonic acid ion, p-chlorobenzenesulfonic acid ion); aryldisulfonic acid ions, e.g., 1,3-benzenedisulfonic acid ion, 1,5-naphthalenedisulfonic acid ion, 2,6-naphthalenedisulfonic acid ion; alkylsulfuric acid ions, e.g., methylsulfuric acid ion; sulfuric acid ion; thiocyanic acid ion, perchloric acid ion; tetrafluoroboric acid ion; picric acid ion; acetic acid ion; and trifluoromethanesulfonic acid ion. Preferred among these ions is an iodine ion.

Among red-sensitive sensitizing dyes represented by the general formula (III), preferred are those represented by the general formulae (IV) or (V) below:

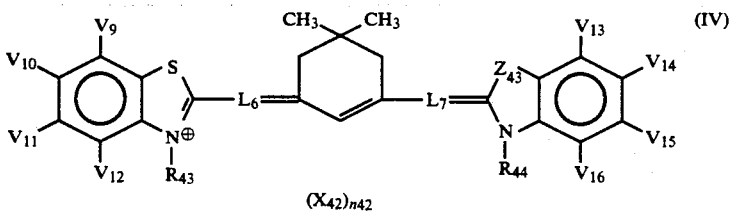

(IV)

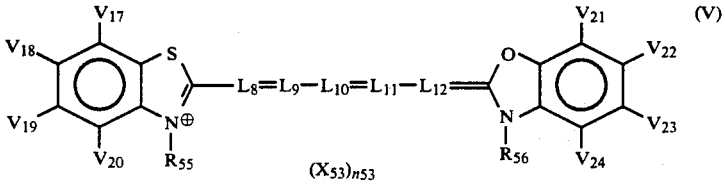

(V)

In the general formula (IV), $Z_{43}$ represents an oxygen atom or sulfur atom.

$L_6$ and $L_7$ each represents a methine group.

$R_{43}$ and $R_{44}$ have the same meanings as $R_{31}$ and $R_{32}$ in the general formula (III), respectively. $R_{43}$ can be connected to $L_6$ to form a 5- or 6-membered carbon ring, and $R_{44}$ can be connected to $L_7$ to form a 5- or 6-membered carbon ring.

$V_9$, $V_{10}$, $V_{11}$, $V_{12}$, $V_{13}$, $V_{14}$, $V_{15}$ and $V_{16}$ each represents a hydrogen atom or a substituent as defined by $V_1$, $V_2$, $V_3$, $V_4$, $V_5$, $V_6$, $V_7$ and $V_8$ in the general formula (III) respectively. Among $V_9$ to $V_{16}$, those two groups connected to adjacent carbon atoms cannot together form a condensed ring. Assuming that $V_9$ to $V_{16}$ each has a Hammett $\sigma_p$ value ($\sigma_{pi}$; i=9 to 16) satisfying the equation $Y=\sigma_{p9}+\sigma_{p10}+\sigma_{p11}+\sigma_{p12}+\sigma_{p13}+\sigma_{p14}+\sigma p15+_{p16}$;

if $Z_{43}$ is an oxygen atom, Y is −0.08 or less; and if $Z_{43}$ is a sulfur atom, Y is −0.05 or less. Y is preferably −0.15 or less, particularly from −0.90 to −0.17 if $Z_{43}$ is an oxygen atom, and is preferably −0.30 or less, particularly from −1.05 to −0.34 if $Z_{43}$ is a sulfur atom.

The value of $\sigma_p$ indicates a value set forth in Kozokassei Sokan Konwakai, "Kagaku no Ryoiki", No. 122, "Yakubutu no Kozokassei Sokan- Drug Design to Sayo Kisaku Kenkyu eno Shishin", pp. 96 to 103, Nankodo, and Corwin Hansch and Albert Leo, "Substituent Constants for Correlation Analysis in Chemistry and Biology", pp. 69 to 161, John Wiley and Sons. A method for the measurement of $\sigma_p$ is described in "Chemical Reviews", vol. 17, pp. 125 to 136, 1935. Preferred examples of $V_9$, $V_{10}$, $V_{11}$, $V_{12}$, $V_{13}$, $V_{14}$, $V_{15}$ and $V_{16}$ include a hydrogen atom; an unsubstituted alkyl group containing 6 or less carbon atoms, e.g., methyl, ethyl, n-propyl, isopropyl, n-butyl, t-butyl, pentyl, cyclopropyl, cyclobutyl, cyclopentyl, cyclohexyl; a substituted alkyl group containing 8 or less carbon atoms, e.g., carboxymethyl, 2-carboxyethyl, benzyl, phenethyl, dimethylaminopropyl; a hydroxyl group; an amino group, e.g., amino, hydroxylamino, methylamino, dimethylamino, diphenylamino; an alkoxy group, e.g., methoxy, ethoxy, isopropoxy, propoxy, butoxy, pentoxy; an aryloxy group, e.g., phenoxy), and an aryl group, e.g., phenyl.

$(X_{42})_{n42}$ has the same meaning as $(X_{31})_{n31}$ in the general formula (III).

In the general formula (V), $L_8$, $L_9$, $L_{10}$, $L_{11}$ and $L_{12}$ have the same meanings as $L_1$, $L_2$, $L_3$, $L_4$ and $L_5$ in the general formula (III), respectively. $L_8$, $L_9$, $L_{10}$, $L_{11}$ and $L_{12}$ each preferably is a methine group substituted by a substituent having a negative Hammett $\sigma_p$ value. Examples of such a substituent include a substituted or unsubstituted alkyl group, e.g., methyl, ethyl. More preferably, $L_9$ and $L_{11}$ may be connected to each other to form a 5- or 6-membered carbon ring.

$R_{55}$ and $R_{56}$ have the same meanings as $R_{31}$ and $R_{32}$ in the general formula (III), respectively.

Among $V_{17}$, $V_{18}$, $V_{19}$, $V_{20}$, $V_{21}$, $V_{23}$ and $V_{24}$, one or more pairs connected to adjacent carbon atoms are connected to each other to form a benzene ring or heterocyclic group, e.g., pyrrole, thiophene, furan, pyridine, imidazole, triazole, thiazole. These rings may be further substituted. The other groups $V_{17}$ to $V_{24}$ which do not participate in this construction have the same meanings as $V_1$ to $V_8$ in the general formula (III), respectively.

$(X_{53})_{n53}$ has the same meaning as $(X_{31})_{n31}$ in thegeneral formula (III).

In particular, when a high silver chloride content emulsion is used as an emulsion, a compound having a reduction potential ($E_R$) of −1.23 (VvsSCE) or lower, particularly −1.27 (VvsSCE) or lower is preferably used. In respect to chemical structure, a benzothiadicarbocyanine dye in which two methine groups in a pentamethine connecting group are connected to each other to form a ring is preferably used. Electron donative groups such as an alkyl group and an alkoxy group are preferably connected to the benzene ring in the benzothiazole nucleus of such a dye.

The measurement of reduction potential can be accomplished by phase-discriminative secondary higher harmonics alternating voltammetry. A dropping mercury electrode is used as working electrode. A saturated calomel electrode is used as reference electrode. Platinum is used as opposite electrode.

The measurement of reduction potential by phase-discriminative secondary harmonics alternating voltammetry using platinum as working electrode is described in "Journal of Imaging Science", vol. 30, pp. 27 to 35. 1986.

Specific examples of the sensitizing dyes represented by the general formula (I), (II) and (III) will be set forth below, but the present invention should not be construed as being limited thereto.
I-1
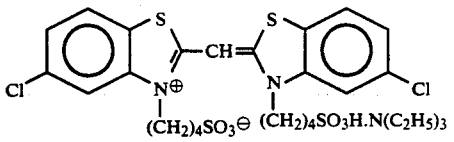
I-2
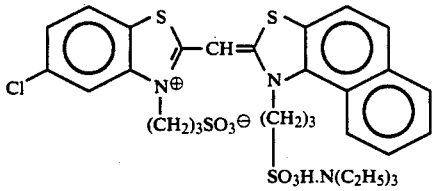
I-3
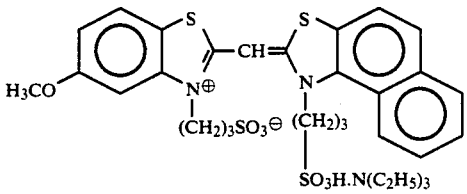
I-4
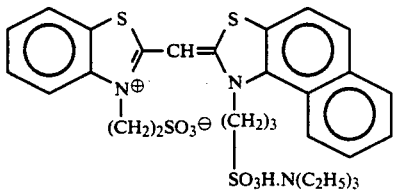
I-5
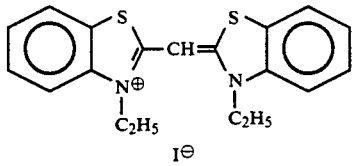
II-1
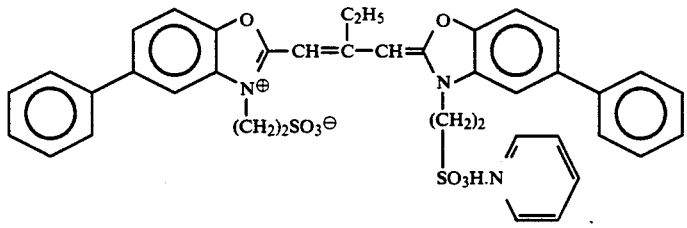
II-2
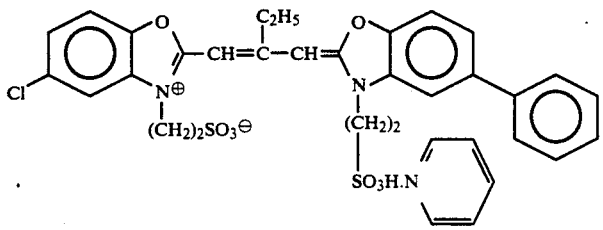

-continued

II-3

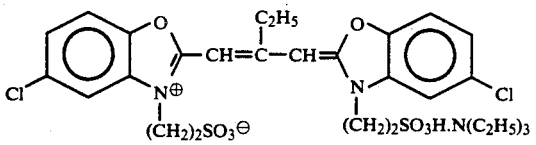

(For red-sensitive layer)

II'-4

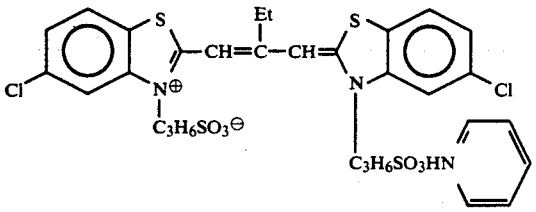

(For red sensitive layer)

II'-5

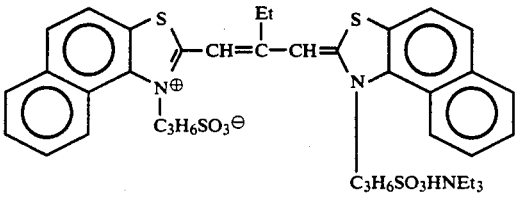

(III)

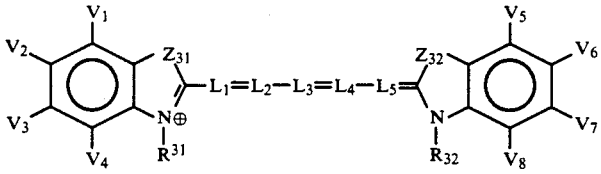

| | $Z_2$ | $R_1$ | $R_2$ | $V_2$ | $V_3$ | $V_6$ | $V_7$ | X | n | $E_R$ |
|---|---|---|---|---|---|---|---|---|---|---|
| III-1 | S | $CH_3CH_2$ | $CH_3CH_2$ | $CH_3$ | H | H | H | $I^-$ | 1 | −1.27 |
| III-2 | " | " | " | " | $CH_3$ | " | " | " | " | −1.29 |
| III-3 | " | " | " | " | H | $CH_3$ | " | " | " | −1.29 |
| III-4 | " | " | " | " | " | H | $CH_3$ | " | " | −1.28 |
| III-5 | " | " | " | H | $CH_3$ | " | " | " | " | −1.27 |
| III-6 | " | " | " | $CH_3O$ | H | " | H | " | " | −1.27 |
| III-7 | " | " | " | " | $CH_3O$ | " | " | " | " | −1.29 |
| III-8 | " | " | " | " | H | $CH_3O$ | " | " | " | −1.30 |
| III-9 | " | " | " | " | " | H | $CH_3O$ | " | " | −1.29 |
| III-10 | S | $CH_3CH_2$ | $CH_3CH_2$ | H | $CH_3O$ | H | $CH_3O$ | $I^-$ | 1 | −1.28 |
| III-11 | " | " | " | $CH_3$ | $CH_3$ | $CH_3$ | $CH_3$ | " | " | −1.33 |
| III-12 | " | " | " | $CH_3O$ | $CH_3O$ | $CH_3O$ | $CH_3O$ | " | " | −1.34 |
| III-13 | " | " | " | $CH_3O$ | $CH_3$ | H | H | " | " | −1.29 |
| III-14 | " | " | " | $CH_3CH_2O$ | H | $CH_3CH_2O$ | " | " | " | −1.30 |
| III-15 | " | " | " | $CH_3CH_2$ | " | $CH_3CH_2$ | " | " | " | −1.28 |
| III-16 | " | " | " | $CH_3(CH_2)_2$ | " | $CH_3(CH_2)_2$ | " | " | " | −1.20 |
| III-17 | " | " | " | $N(CH_3)_2$ | " | H | " | " | " | −1.28 |
| III-18 | " | $(CH_2)_3SO_3^-$ | " | $CH_3$ | " | $CH_3$ | " | — | — | −1.29 |
| III-19 | " | $(CH_2)_4O_3^-$ | " | $CH_3$ | " | " | " | — | — | −1.29 |
| III-20 | " | $(CH_2)_3SO_3^-$ | $(CH_2)_3SO_3^-$ | " | " | " | " | $\overset{+}{H}NEt_2$ | 1 | −1.29 |
| III-21 | " | $(CH_2)_4SO_3^-$ | $(CH_2)_4SO_3^-$ | " | " | " | " | 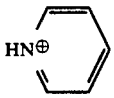 | " | −1.29 |
| III-22 | " | $CH_3(CH_2)_4$ | $CH_3CH_2$ | " | " | " | " | $I^-$ | " | −1.29 |
| III-23 | S | $CH_3(CH_2)_4$ | $(CH_2)_3SO_4^-$ | $CH_3$ | H | $CH_3$ | H | — | — | −1.29 |
| III-24 | " | $CH_3$ | $CH_3$ | " | " | " | " | $I^-$ | 1 | −1.29 |
| III-25 | " | $(CH_2)_3SO_4^-$ | $(CH_2)_4SO_4^-$ | " | " | " | " | $\overset{+}{H}NEt_2$ | " | −1.29 |
| III-26 | " | $CH_3$ | $CH_3(CH_2)_2$ | " | " | " | " | $I^-$ | " | −1.29 |
| III-27 | " | $(CH_2)_3SO_3^-$ | $CH_3CH_2$ | $CH_3O$ | $CH_3O$ | H | " | — | — | −1.29 |
| III-28 | " | $CH_3CH_2$ | $(CH_2)_3SO_3^-$ | " | " | " | " | — | — | −1.29 |
| III-29 | O | " | $CH_3CH_2$ | $CH_3$ | H | " | " | $I^-$ | 1 | −1.29 |

-continued
(III)
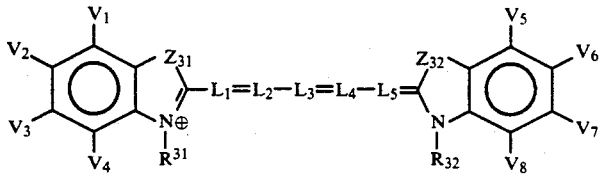
$(X_{31})_{n31}$
| | $Z_2$ | $R_1$ | $R_2$ | $V_2$ | $V_3$ | $V_6$ | $V_7$ | X | n | $E_R$ |
|---|---|---|---|---|---|---|---|---|---|---|
| III-30 | " | " | " | H | $CH_3$ | " | " | " | " | −1.28 |
| III-31 | " | " | " | $CH_3$ | " | " | " | " | " | −1.31 |
| III-32 | " | " | " | " | H | $CH_3$ | " | " | " | −1.31 |
| III-33 | " | " | " | " | " | H | $CH_3$ | " | " | −1.30 |
| III-34 | " | " | " | H | $CH_3$ | " | " | " | " | −1.29 |
(III-35)
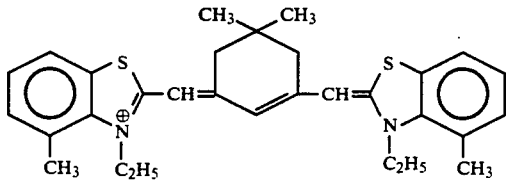
$E_R = -1.29$
(III-36)
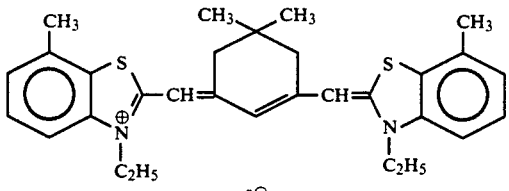
$E_R = -1.28$
(III-37)
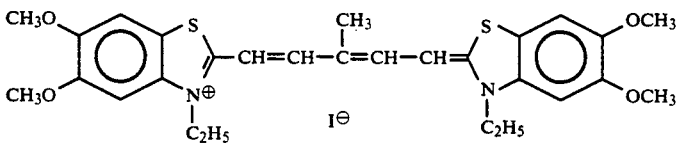
$E_R = -1.30$
(III-38)
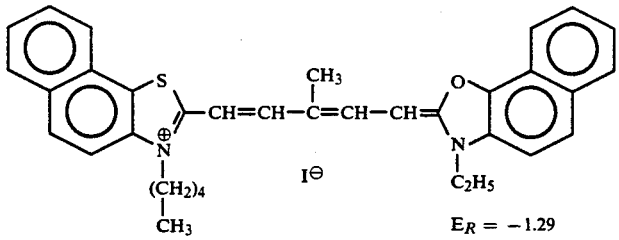
$E_R = -1.29$
(III-39)
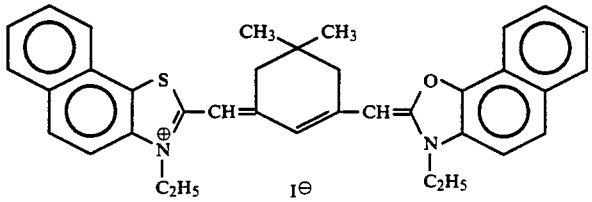
$E_R = -1.35$ -continued (III-40)

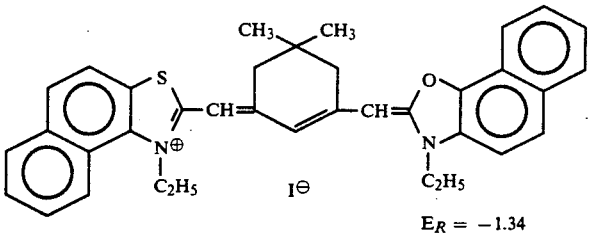

$E_R = -1.34$ (III-41)

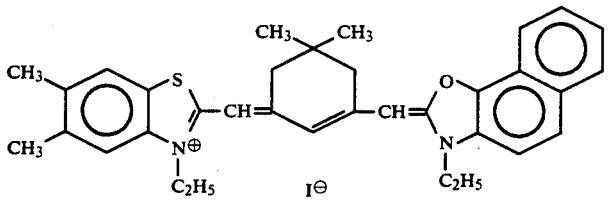

$E_R = -1.34$ (III-42)

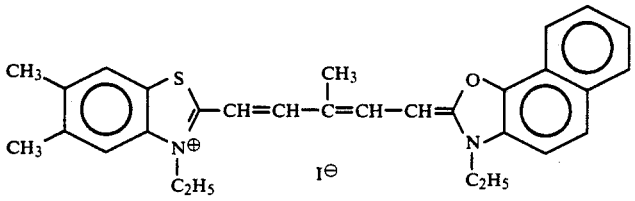

$E_R = -1.29$ (III-43)

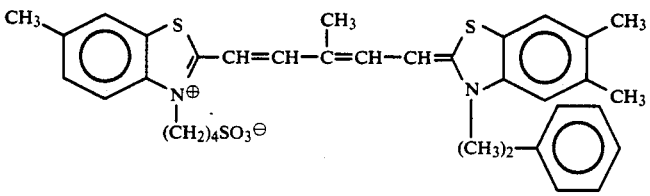

(III-44)

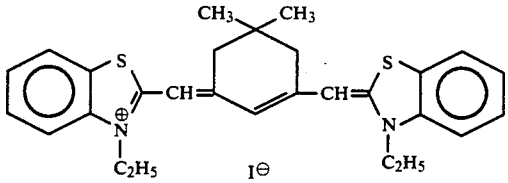

Examples of spectral sensitizing dyes to be used for the purpose of providing spectral sensitivity to ranges other than the above mentioned spectral sensitivity range include those described in Harmer, "Heterocyclic Compounds-Cyanine Dyes and Related Compounds", John Wiley Sons, New York, London, 1964.

In particular, for spectral sensitization in a range of 720 nm or more, any suitable sensitizing dye can be selected from the group consisting of sensitizing dyes represented by the general formulae (VI), (VII) and (VIII) described below. These sensitizing dyes are advantageous in that they are chemically stable, can be relatively firmly adsorbed by the surface of silver halide grains and cannot be easily desorbed therefrom by a dispersed substance present therewith such as coupler.

The sensitizing dyes represented by the general formulae (VI), (VII) and (VIII) will be further described hereinafter.

(VI)

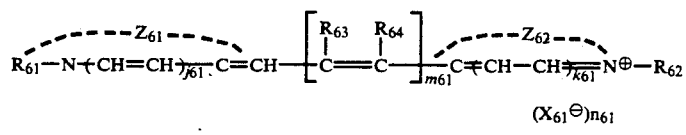

wherein $Z_{61}$ and $Z_{62}$ each represents an atomic group required for the formation of a heterocyclic nucleus.

Such a heterocyclic nucleus is preferably a 5- or 6-membered nucleus containing as hetero atoms nitrogen atoms and optionally sulfur, oxygen, selenium or tellurium atoms. Condensed rings or substituents may be further connected to these rings.

Specific examples of the above mentioned heterocyclic nucleus include thiazole nucleus, benzothiazole nucleus, naphthothiazole nucleus, selenazole nucleus, benzoselenazole nucleus, naphthoselenazole nucleus, oxazole nucleus, benzoxazole nucleus, naphthoxazole nucleus, imidazole nucleus, benzimidazole nucleus, naphthoimidazole nucleus, 4-quinoline nucleus, pyrroline nucleus, pyridine nucleus, tetrazole nucleus, indolenine nucleus, benzindolenine nucleus, indole nucleus, tellurazole nucleus, benzotellurazole nucleus, and naphthotellurazole nucleus.

$R_{61}$ and $R_{62}$ each represents an alkyl group, alkenyl group, alkynyl group or aralkyl group. These groups and groups described hereinafter are construed as optionally containing substituents. For example, the alkyl group may be a substituted or unsubstituted alkyl group. These groups may be straight-chain, branched or cyclic. The alkyl group preferably contains 1 to 8 carbon atoms.

Specific examples of substituents to be contained in such a substituted alkyl group include a halogen atom, e.g., chlorine, bromine, fluorine; a cyano group; an alkoxy group; a substituted or unsubstituted amino group; a carboxy group; a sulfonic acid group; and a hydroxyl group. The alkyl group may contain these substituents singly or in combination thereof.

Specific examples of the alkenyl group represented by $R_{61}$ or $R_{62}$ include a vinylmethyl group.

Specific examples of the aralkyl group represented by $R_{61}$ or $R_{62}$ include a benzyl group and a phenethyl group.

The suffix m61 represents an integer 1, 2 or 3.

$R_{63}$ represents a hydrogen atom. $R_{64}$ represents a hydrogen atom, a lower alkyl group or an aralkyl group and may be connected to $R_{62}$ to form a 5- or 6-membered ring. If $R_{64}$ represents a hydrogen atom, $R_{63}$ may be connected to other $R_{63}$'s to form a hydrocarbon ring or heterocyclic group. Such a ring is preferably a 5- or 6-membered ring. The suffixes j61 and k61 each represents an integer 0 or 1. $X_{61}^{\theta}$ represents an acid anion. The suffix $n_{61}$ represents an integer 0 or 1.

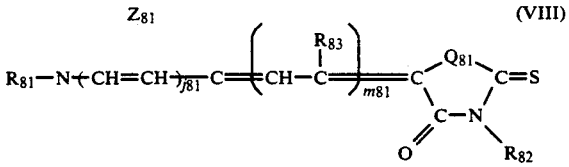

(VIII)

wherein $Z_{81}$ represents an atomic group required for the formation of a heterocyclic ring. Specific examples of such a heterocyclic ring include those described with reference to $Z_{61}$ and $Z_{62}$, and also thiazolidine, thiazoline, benzothiazoline, naphthothiazoline, selenazolidine, selenazoline, benzoselenazoline, naphthoselenazoline, benzoxazoline, naphthoxazoline, dihydropyridine, dihydroquinoline, benzimidazoline, and naphthoimidazoline.

$Q_{81}$ has the same meaning as $Q_{71}$. $R_{81}$ has the same meaning as $R_{61}$ or $R_{62}$, and $R_{82}$ has the same meaning as $R_{73}$. The suffix $m_{81}$ represents an integer 2 or 3. $R_{83}$ has the same meaning as $R_{74}$ and may be connected to other $R_{83}$'s to form a hydrocarbon ring or heterocyclic ring. The suffix $j_{81}$ has the same meaning as $j_{61}$.

In the general formula (VI), the heterocyclic nucleus formed of $Z_{61}$ and/or $Z_{62}$ preferably contains naphthothiazole nucleus, naphthoselenazole nucleus, naphthoxazole nucleus, naphthoimidazole nucleus or 4-quinoline nucleus. This can also apply to $Z_{71}$ and/or $Z_{72}$ in the general formula (VII) and $Z_{81}$ in the general formula (VIII). In these sensitizing dyes, methine chains preferably form a hydrocarbon ring or heterocyclic ring.

The infrared sensitization is effected at M-band of sensitizing dyes. Therefore, the spectral sensitivity distribution is normally broader than sensitization at J-band. Thus, a colored layer containing a dye is preferably provided in a colloid layer on the light-sensitive surface side rather than a predetermined light-sensitive layer to correct the spectral sensitivity distribution. The colored layer is effective to inhibit color stain by a filtering effect.

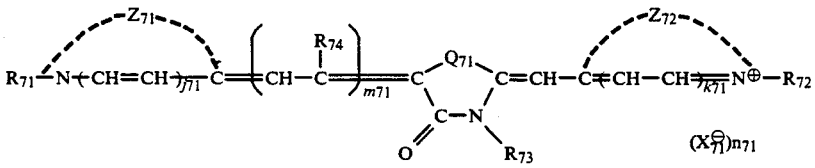

(VII)

wherein $Z_{71}$ and $Z_{72}$ have the same meanings as $Z_{61}$ and $Z_{62}$, respectively, and $R_{71}$ and $R_{72}$ have the same meanings as $R_{61}$ and $R_{62}$. $R_{73}$ represents an alkyl group; an alkenyl group; an alkynyl group; or an aryl group, e.g., substituted or unsubstituted phenyl group, further, $m_{71}$ represents an integer 2 or 3. $R_{74}$ represents a hydrogen atom; a lower alkyl group or an aryl group and may be connected to other $R_{74}$'s to form a hydrocarbon ring or heterocyclic ring. Such a ring is preferably a 5- or 6-membered ring.

$Q_{71}$ represents a sulfur atom, oxygen atom, selenium atom or $>N-R_{75}$ in which $R_{75}$ has the same meaning as $R_{73}$. The suffixes $j_{71}$, $k_{71}$, $X_{71}^{\theta}$ and $n_{71}$ have the same meanings as $j_{61}$, $k_{61}$, $X_{61}^{\theta}$ and $n_{61}$, respectively.

As a sensitizing dye for infrared sensitization, a preferable compound has a reduction potential of −1.05 (VvsSCE) or lower, particularly −1.10 (VvsSCE) or lower. Such a sensitizing dye is favorable for high sensitization, particularly for stabilization of sensitivity or latent images.

The measurement of reduction potential can be accomplished by phase-discriminative secondary higher harmonics alternating polarography. A dropping mercury electrode is used as working electrode. A saturated calomel electrode is used as reference electrode. Platinum is used as the opposite electrode.

The measurement of reduction potential by phase-discriminative secondary higher harmonics alternating voltammetry using platinum as working electrode is described in ΘJournal of Imaging Science", vol. 30, pp. 27 to 35, 1986.

Specific examples of the sensitizing dyes represented by the general formulae (VI), (VII) and (VIII) will be set forth below.
(Q-1)
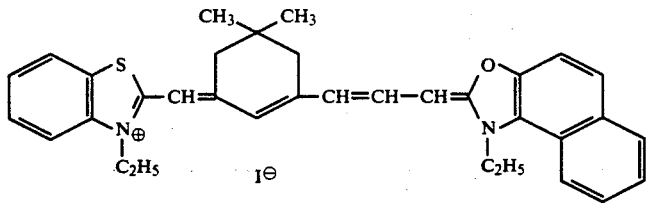
(Q-2)
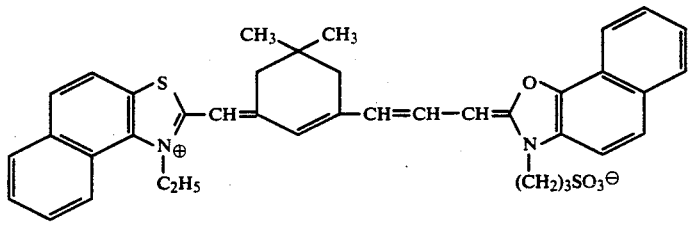
(Q-3)
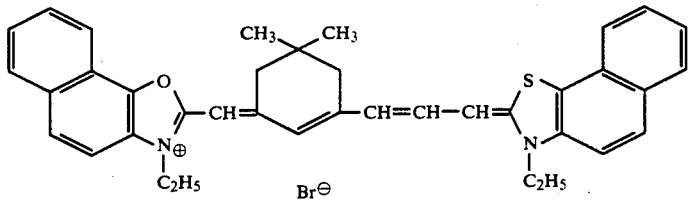
(Q-4)
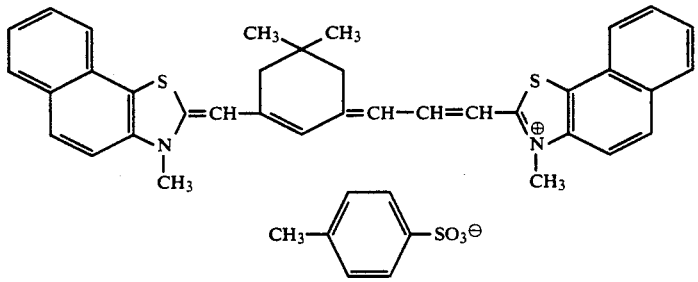
(Q-5)
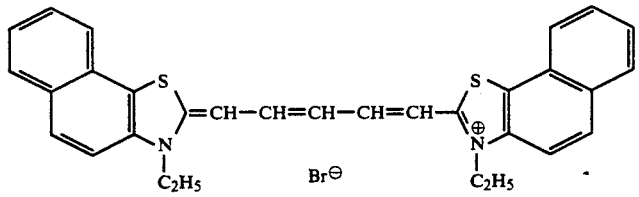
(Q-6)
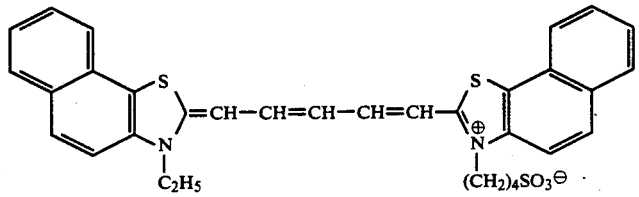
(Q-7)
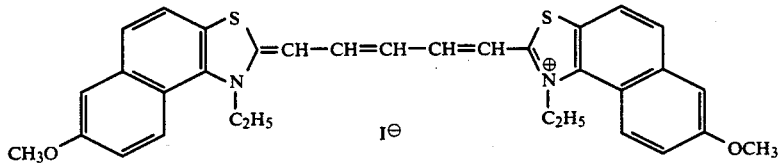

-continued
(Q-8)
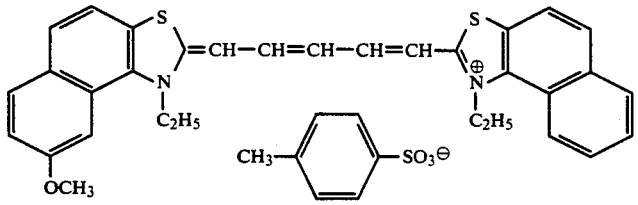
(Q-9)
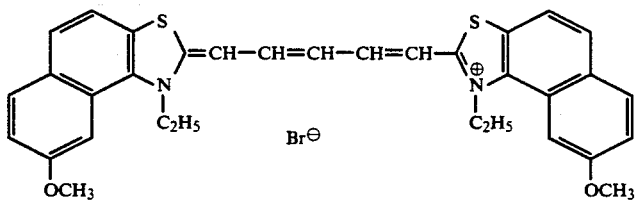
(Q-10)
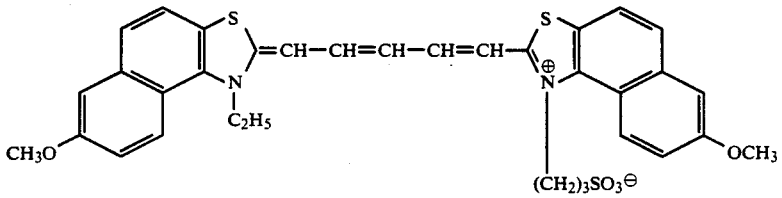
(Q-11)
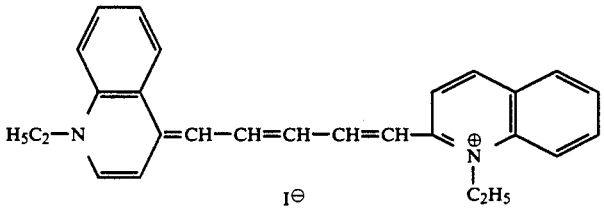
(Q-12)
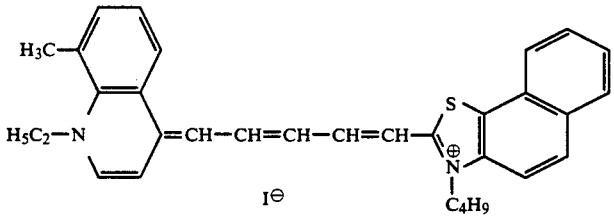
(Q-13)
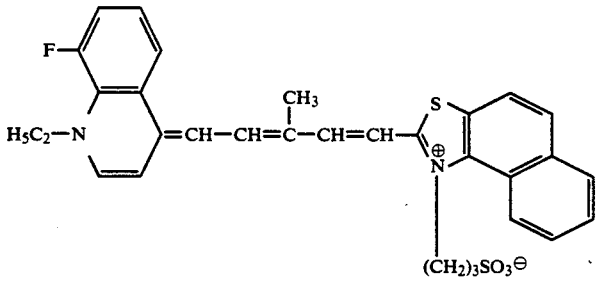
(Q-14)
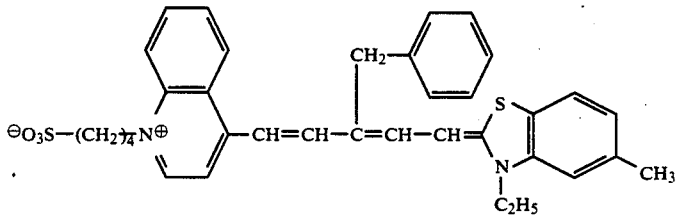

-continued
(Q-15)
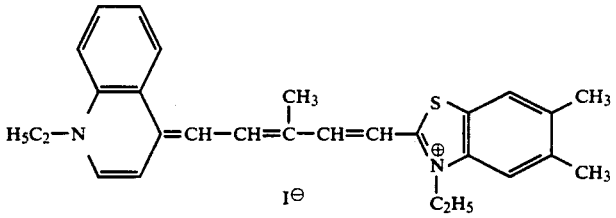
(Q-16)
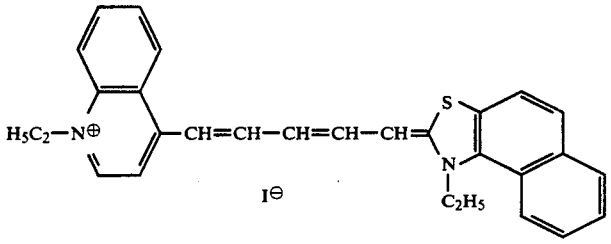
(Q-17)
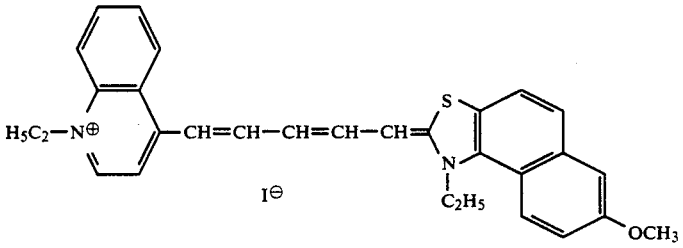
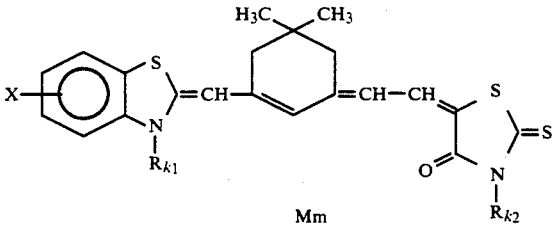
Mm
| Compound No. | $R_{k1}$ | $R_{k2}$ | X | M | m |
|---|---|---|---|---|---|
| (Q-18) | $C_2H_5$ | $C_2H_5$ | H | — | — |
| (Q-19) | " | " | 6,7-benzo | — | — |
| (Q-20) | " | " | 4,5-benzo | — | — |
| (Q-21) | " | " | 5,6-$(OCH_3)_2$ | — | — |
| (Q-22) | $(CH_2)_4SO_3^{\ominus}$ | " | 6,7-benzo | $HN^{\oplus}(C_2H_5)_3$ | 1 |
| (Q-23) | $C_2H_5$ | $(CH_2)_2SO_3^{\ominus}$ | " | " | " |
| (Q-24) | $(CH_2)_4CH_3$ | $C_2H_5$ | 5,6-$(CH_3)_2$ | — | — |
| (Q-25) | $(CH_2)_3CO_2H$ | " | 6-$CH_3$ | — | — |
| (Q-26) | $(CH_2)_3CH_3$ | $CH_2CO_2H$ | 6,7-benzo | — | — |
| (Q-27) | $(CH_2)_2OCH_3$ | $C_2H_5$ | 4,5-benzo | — | — |
(Q-28)
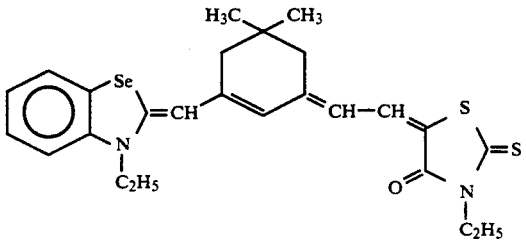

-continued
(Q-29)
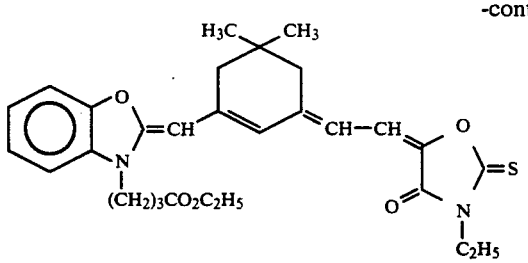
(Q-30)
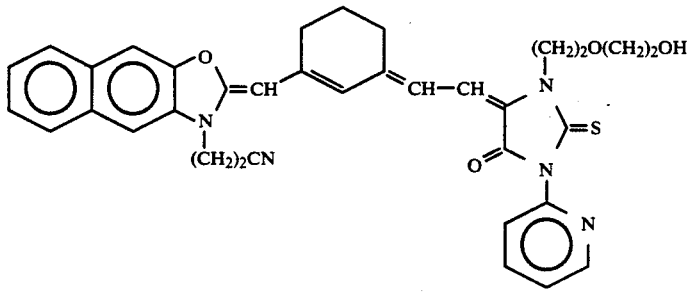
(Q-31)
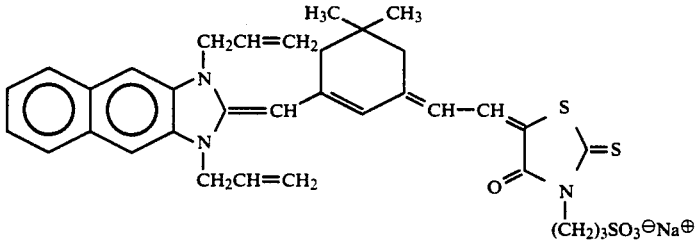
(Q-32)
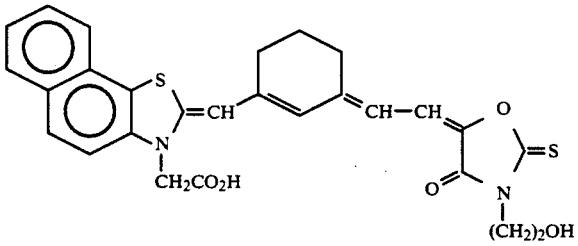
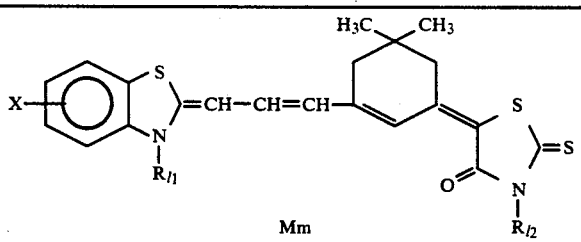
Mm
| Compound No. | $R_{11}$ | $R_{12}$ | X | M | m |
|---|---|---|---|---|---|
| (Q-33) | $C_2H_5$ | $C_2H_5$ | 6,7-benzo | — | — |
| (Q-34) | " | " | 4,5-benzo | — | — |
| (Q-35) | " | " | 5,6-$(OCH_3)_2$ | — | — |
| (Q-36) | $CH_2CO_2H$ | $(CH_2)_3CH_3$ | 5,6-$(CH_3)_2$ | — | — |
| (Q-37) | $(CH_2)_3SO_3^{\ominus}$ | $CH_3$ | H | 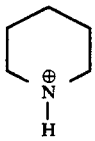 | 1 |
| (Q-38) | $(CH_2)_5CH_3$ | $(CH_2)_2SO_3^{\ominus}$ | 6,7-benzo | $NH^{\oplus}(C_2H_5)_3$ | 1 |

-continued
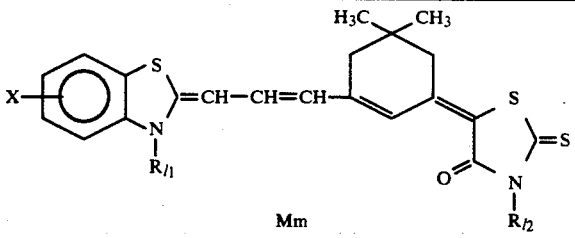
Mm
| Compound No. | $R_{11}$ | $R_{12}$ | X | M | m |
|---|---|---|---|---|---|
| (Q-39) | $(CH_2)_3CN$ | $CH_2OCH_3$ | 4,5-benzo | — | — |
| (Q-40) | $(CH_2)_2OC_2H_5$ | $C_2H_5$ | 6-Cl | — | — |
| (Q-41) | $SO_3^{\ominus}$ \| $(CH_2)_2CHCH_3$ | $(CH_2)_2CH_3$ | 6-$CH_3$ | $K^{\oplus}$ | 1 |
| (Q-42) | $(CH_2)_2SCH_3$ | $(CH_2)_3CO_2H$ | 6-$OCH_3$ | — | — |
(Q-43)
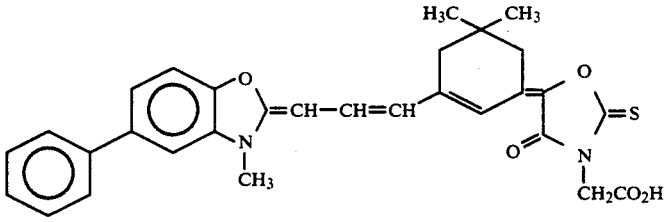
(Q-44)
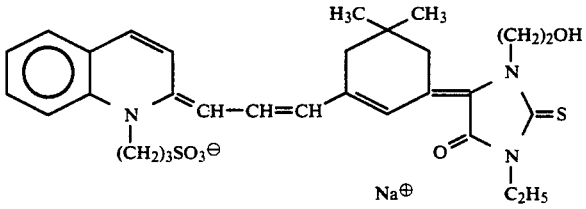
(Q-45)
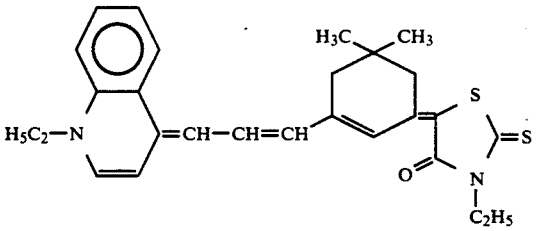
(Q-46)
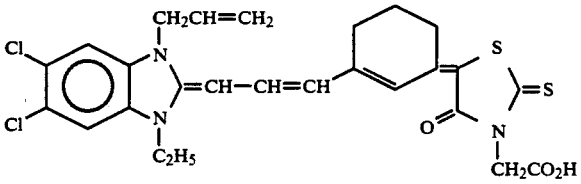
(Q-47)
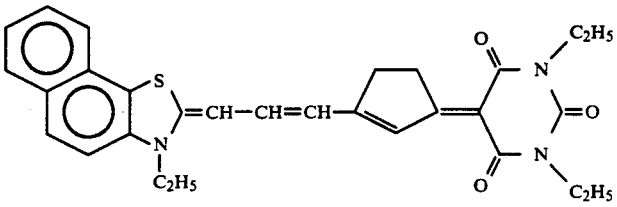

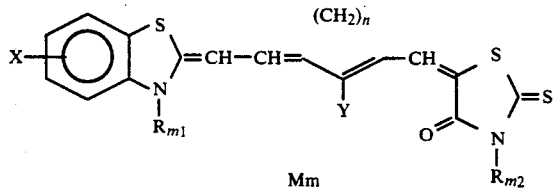
Mm
| Compound No. | $R_{m1}$ | $R_{m2}$ | Y | X | n | M | m |
|---|---|---|---|---|---|---|---|
| (Q-48) | $C_2H_5$ | $C_2H_5$ | H | 6,7-benzo | 2 | — | — |
| (Q-49) | " | " | " | " | 3 | — | — |
| (Q-50) | $CH_2CO_2H$ | " | Cl | " | 3 | — | — |
| (Q-51) | $(CH_2)_3SO_3^{\ominus}$ | $CH_3$ | $NPh_2$ | 4,5-benzo | 2 | $HN^{\oplus}(C_2H_5)_3$ | 1 |
| (Q-52) | $(CH_2)_2OCH_3$ | $CH_3CO_2H$ | H | 5,6-$(CH_3)_2$ | 4 | — | — |
| (Q-53) | $(CH_2)_7CH_3$ | $(CH_2)_2SO_3^{\ominus}$ | 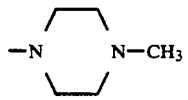 | 5,6-$(OCH_3)_2$ | 3 | $Na^{\oplus}$ | 1 |
| (Q-54) | $(CH_2)_2OH$ | $CH_3$ | " | 6-$CH_3$ | 2 | — | — |
(Q-55)
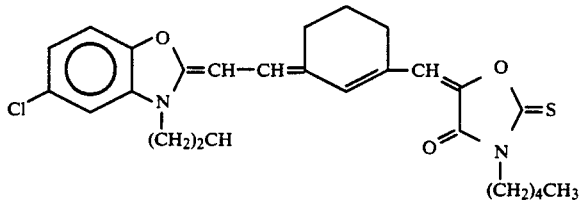
(Q-56)
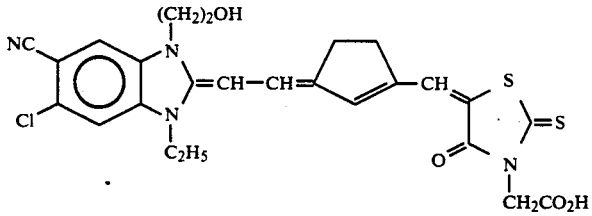
(Q-57)
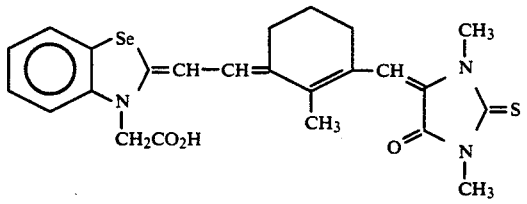
(Q-58)
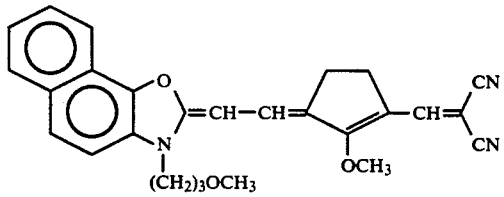
(Q-59)
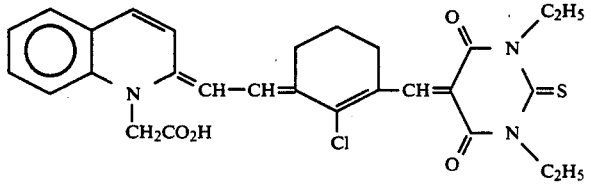

-continued
(Q-60)
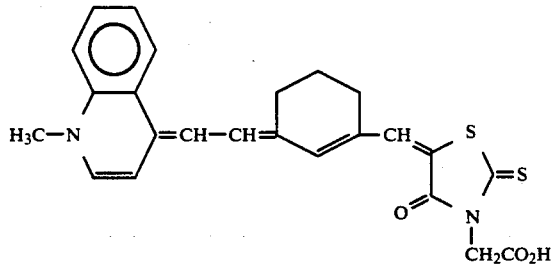
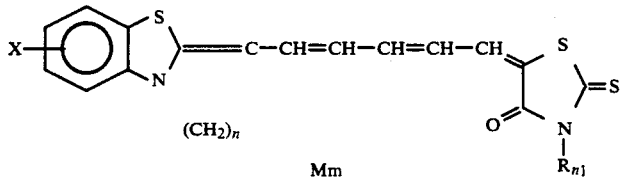
| Compound No. | $R_{n1}$ | X | n | M | m |
|---|---|---|---|---|---|
| (Q-61) | $C_2H_5$ | 6,7-benzo | 2 | — | — |
| (Q-62) | " | " | 3 | — | — |
| (Q-63) | " | " | 4 | — | — |
| (Q-64) | $CH_2CO_2H$ | 4,5-benzo | 3 | — | — |
| (Q-65) | $(CH_2)_4CH_3$ | $(CH_2)_2SO_3^{\ominus}$ | 3 | $HN^{\oplus}(C_2H_5)_3$ | 1 |
| (Q-66) | $(CH_2)_2OH$ | H | 2 | — | — |
| (Q-67) | $(CH_2)_3SO_3^{\ominus}$ | $CH_2CO_2H$ | 4 | $K^{\oplus}$ | 1 |
(Q-68)
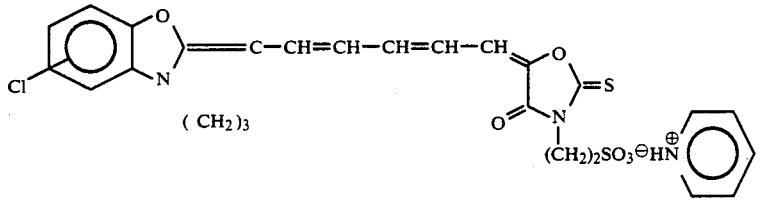
(Q-69)
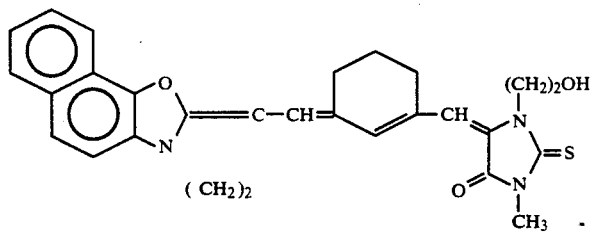
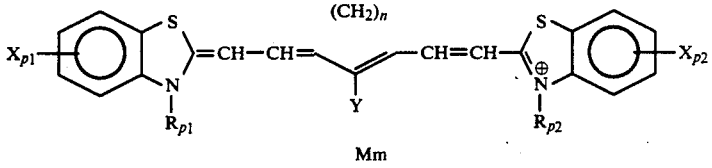
| Compound No. | $R_{p1}$ | $R_{p2}$ | $X_{p1}$ | $X_{p2}$ | Y | n | M | m |
|---|---|---|---|---|---|---|---|---|
| (Q-70) | $C_2H_5$ | $C_2H_5$ | H | H | H | 2 | $I^{\ominus}$ | 1 |
| (Q-71) | " | " | " | " | $CH_3$ N Ph | 2 | " | " |

-continued
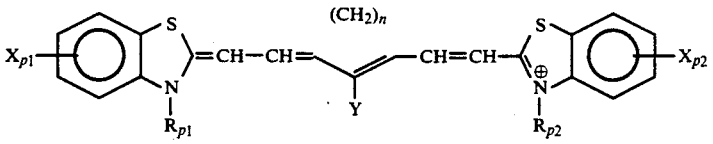
Mm
| Compound No. | $R_{p1}$ | $R_{p2}$ | $X_{p1}$ | $X_{p2}$ | Y | n | M | m |
|---|---|---|---|---|---|---|---|---|
| (Q-72) | " | " | " | " | Cl | 3 | " | " |
| (Q-73) | $CH_2CO_2H$ | " | " | " | N-$Ph_2$ | 2 | $Br^{\ominus}$ | 1 |
| (Q-74) | $(CH_2)_3SO_3Na$ | " | " | " | H | 2 | $Cl^{\ominus}$ | 1 |
| (Q-75) | $(CH_2)_4CH_3$ | " | 6-$CH_3$ | " | " | 3 | 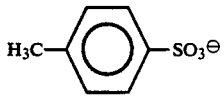 | 1 |
| (Q-76) | $(CH_2)_3SO_3^{\ominus}$ | $(CH_2)_4SO_3^{\ominus}$ | H | " | $OCH_3$ | 3 | $HN(C_2H_5)_3^{\oplus}$ | 1 |
| (Q-77) | $CH_3$ | $C_2H_5$ | 6,7-benzo | 5-$CH_3$ | $CH_3$ | 4 | $I^{\ominus}$ | 1 |
(Q-78)
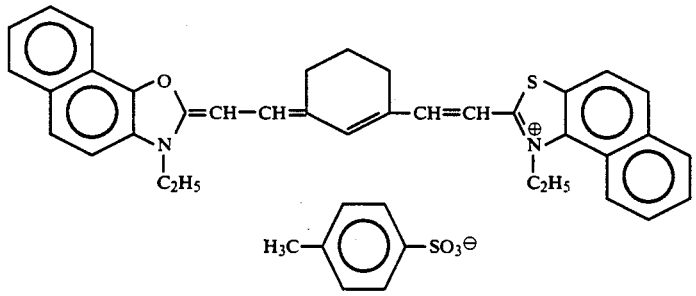
(Q-79)
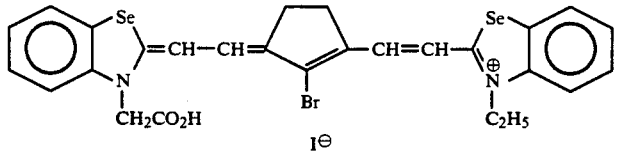
(Q-80)
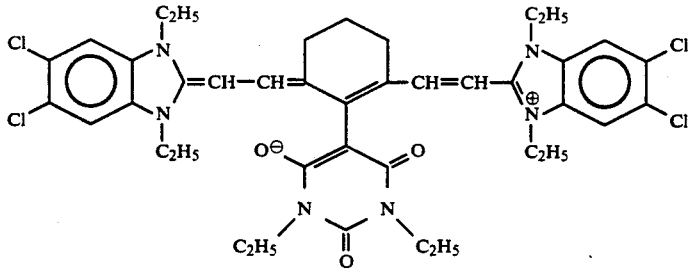
(Q-81)
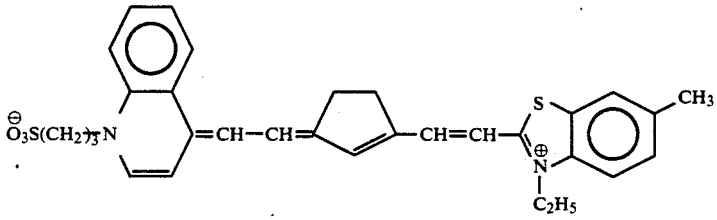

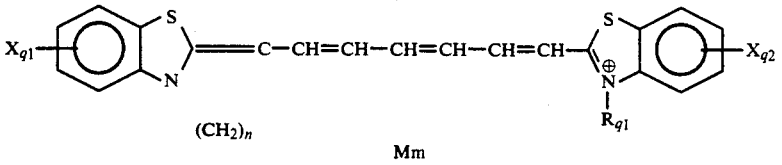

Mm

| Compound No. | $R_{q2}$ | $X_{q1}$ | $X_{q2}$ | n | M | m |
|---|---|---|---|---|---|---|
| (Q-82) | $C_2H_5$ | 6,7-benzo | H | 2 | $I^{\ominus}$ | 1 |
| (Q-83) | $(CH_2)_3SO_3^{\ominus}$ | 4,5-benzo | 4,5-benzo | 3 | — | — |
| (Q-84) | $(CH_2)_2CO_2H$ | 6,7-benzo | 5,6-$(OCH_3)_2$ | 4 | $I^{\ominus}$ | 1 |
| (Q-85) | $(CH_2)_4CH_3$ | 5,6-$(CH_3)_2$ | 5-Cl | 3 | $Br^{\oplus}$ | 1 |
| (Q-86) | $(CH_2)_2CN$ | H | H | 2 | 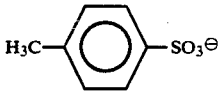 | 1 |

(Q-87)

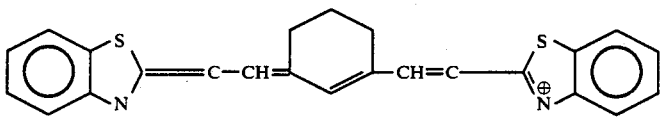

$I^{\ominus}$ (Q-88)

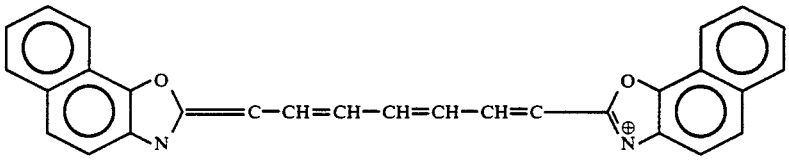

$Cl^{\ominus}$

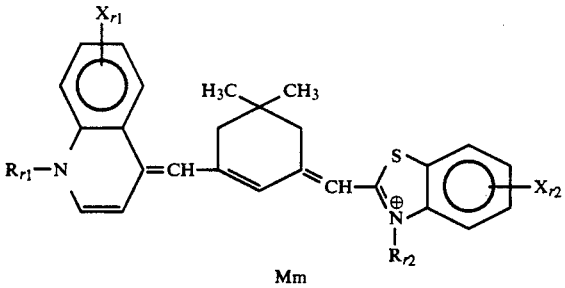

Mm

| Compound No. | $R_{r1}$ | $R_{r2}$ | $X_{r1}$ | $X_{r2}$ | M | m |
|---|---|---|---|---|---|---|
| (Q-89) | $C_2H_5$ | $C_2H_5$ | H | H | $I^{\ominus}$ | 1 |
| (Q-90) | $(CH_2)_4CH_3$ | " | 6-$CH_3$ | 4,5-benzo | $Br^{\ominus}$ | 1 |
| (Q-91) | $(CH_2)_3SO_3^{\ominus}$ | $CH_3$ | 8-$OCH_3$ | 5,6-$(OCH_3)_2$ | — | — |
| (Q-92) | " | $(CH_2)_3SO_3^{\ominus}$ | H | 6,7-benzo | 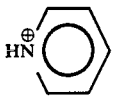 | 1 |
| (Q-93) | $CH_2CO_2H$ | $CH_2CO_2H$ | 6-Cl | 5,6-$(CH_3)_2$ | $I^{\ominus}$ | 1 |
| (Q-94) | $(CH_2)_2OCH_3$ | $(CH_2)_3CH_3$ | 6-Br | 5-Cl | $Cl^{\ominus}$ | 1 |

(Q-95)
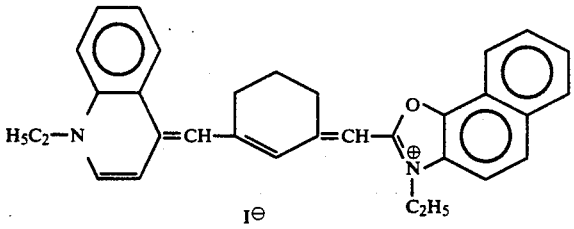
(Q-96)
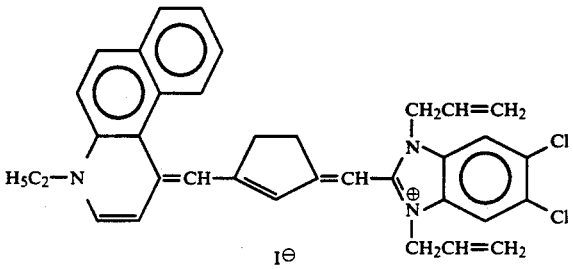
(Q-97)
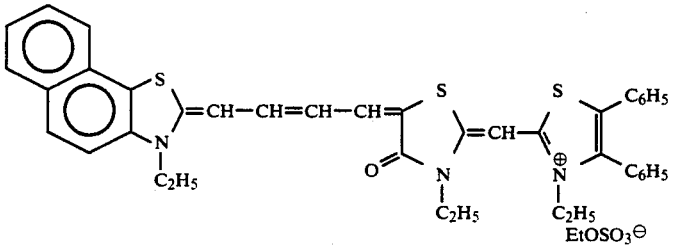
(Q-98)
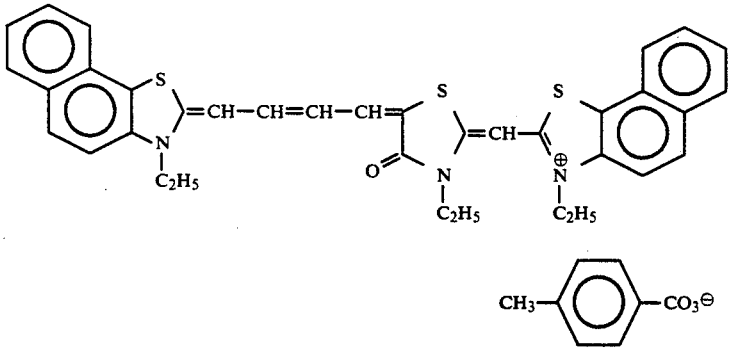
(Q-99)
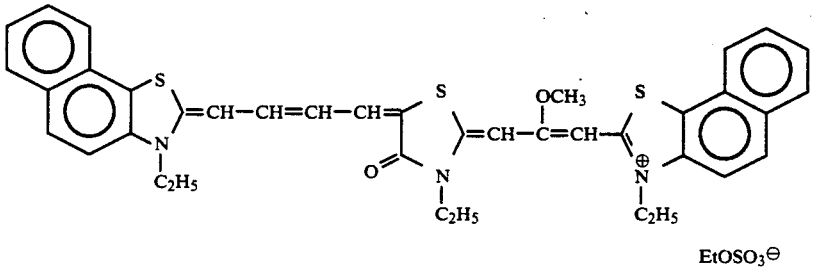

-continued
(Q-100)
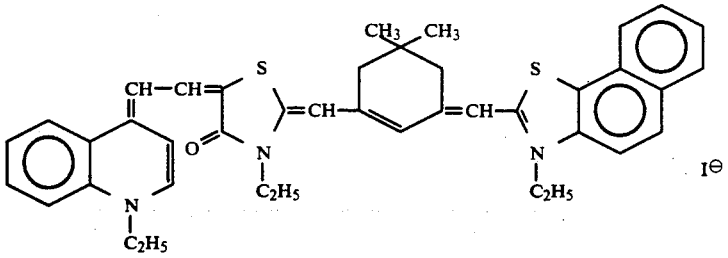
(Q-101)
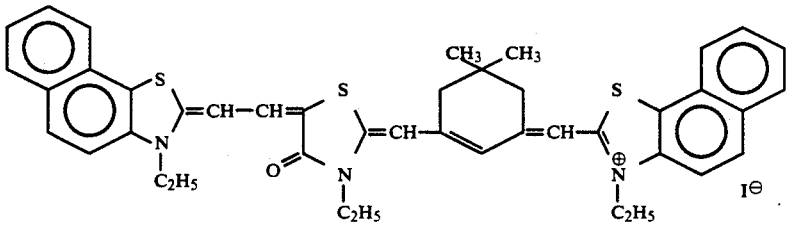
(Q-102)
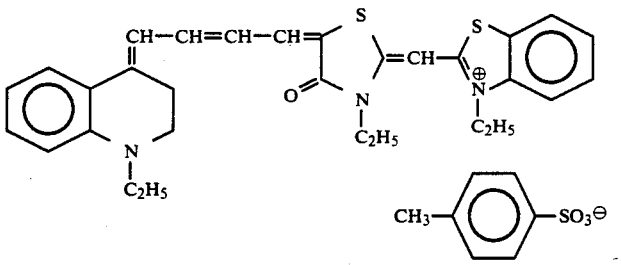
(Q-103)
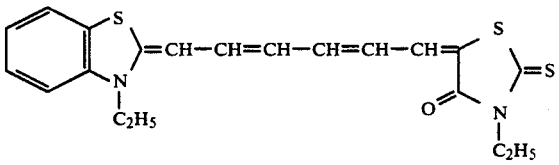
(Q-103)
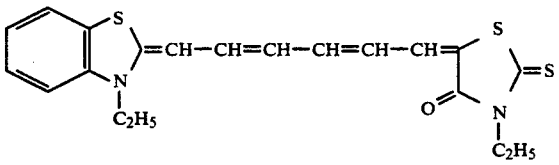
(Q-103)
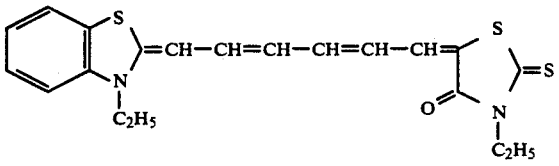
(Q-103)
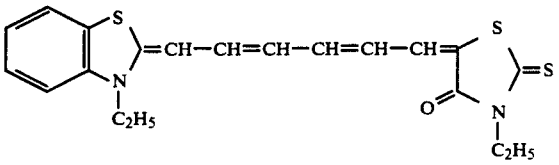

-continued
(Q-104)
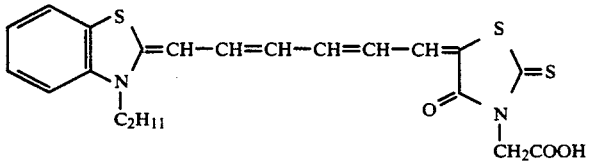
(Q-105)
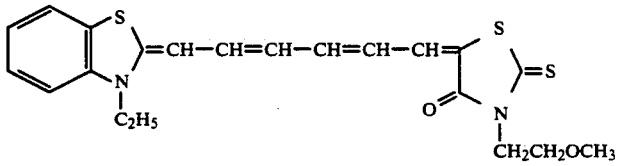
(Q-106)
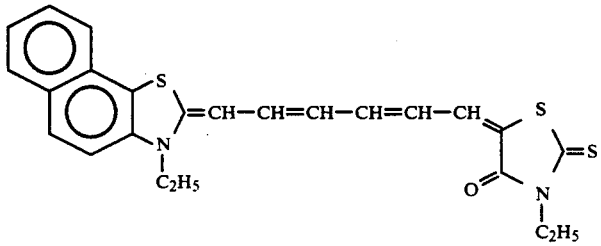
(Q-107)
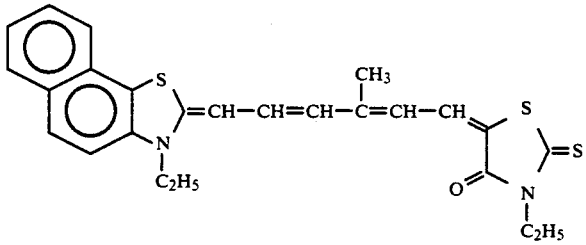
(Q-108)
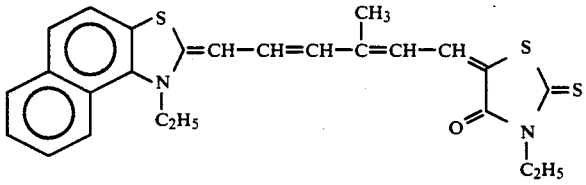
(Q-109)
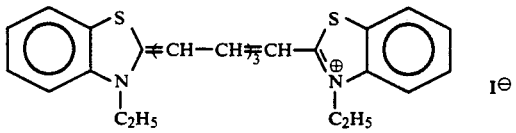
(Q-110)
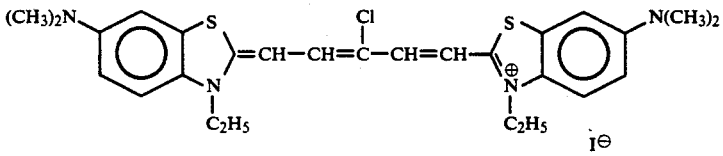
(Q-111)
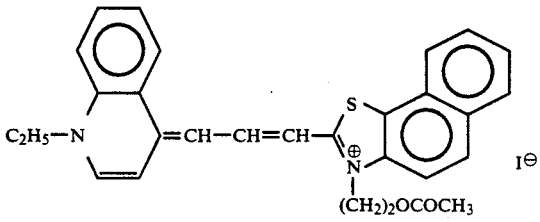

-continued (Q-112)

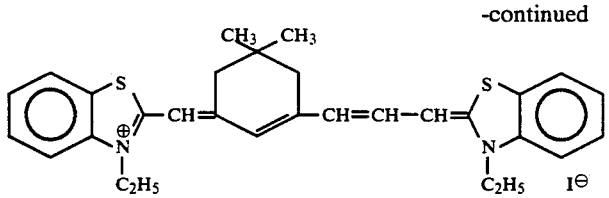

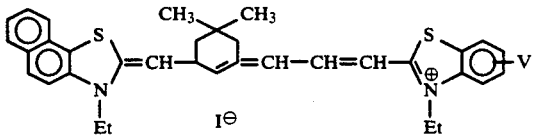

| | V |
|---|---|
| (Q-113) | H |
| (Q-114) | 6-$CH_3$ |
| (Q-115) | 5-$CH_3$ |
| (Q-116) | 6-$OCH_3$ |
| (Q-117) | 5-$OCH_3$ |
| (Q-118) | 5,6-$(CH_3)_2$ |
| (Q-119) | 5,6-$(OCH_3)_2$ |

In order to incorporate these spectral sensitizing dyes into the silver halide emulsion, these spectral sensitizing dyes may be directly dispersed in the emulsion or incorporated in the emulsion in the form of a solution in a solvent such as water, methanol, ethanol, propanol, methyl Cellosolve and 2,2,3,3-tetrafluoropropanol or a mixture thereof. As described in JP-B-44-23389, JP-B-44-27555 and JP-B-57-22089 (the term "JP-B" as used herein means an "examined Japanese patent publication"), these dyes may be incorporated in the emulsion in the form of an aqueous solution or colloidal dispersion prepared in the presence of an acid or base. As described in U.S. Pat. Nos. 3,822,135 and 4,006,025, these dyes may be incorporated in the emulsion in the form of an aqueous solution or colloidal dispersion prepared in the presence of a surface active agent. These dyes may be incorporated in the emulsion in the form of an aqueous dispersion or hydrophilic colloidal dispersion of solution in a solvent substantially immiscible with water such as phenoxyethanol. As described in JP-A-53-102733 and JP-A-58-105141 (the term "JP-A" as used herein means an "unexamined published Japanese patent application"), these dyes may be incorporated in the emulsion in the form of a dispersion in a hydrophilic colloid. These dyes may be incorporated in the emulsion at any step during the preparation of the emulsion which has heretofore been known to be useful. In particular, the time of incorporation of these dyes in the emulsion can be selected from the group consisting of before the formation of the silver halide grains, during the formation of the silver halide grains, between shortly before the formation of the silver halide grains and before the rinse step, before the chemical sensitization, during the chemical sensitization, and between shortly after the chemical sensitization and before the cooling and solidification of the emulsion. Ordinarily, the incorporation of these dyes is effected between the completion of chemical sensitization and before coating. As described in U.S. Pat. Nos. 3,628,969 and 4,225,666, these dyes can be incorporated in the emulsion at the same time with a chemical sensitizer so that spectral sensitization is effected at the same time as chemical sensitization. As described in JP-A-58-113928, spectral sensitization can be effected prior to chemical sensitization. Alternatively, these dyes can be incorporated in the emulsion before the completion of the precipitation of silver halide grains to initiate spectral sensitization. As taught in U.S. Pat. No. 4,225,666, a spectral sensitizing dye can be batch-wise incorporated in the emulsion. In particular, a spectral sensitizing dye can be partially incorporated in the emulsion prior to chemical sensitization, and the rest part of the dye can be incorporated in the emulsion after chemical sensitization. As taught in U.S. Pat. No. 4,183,756, these spectral sensitizing dyes can be incorporated in the emulsion at any time during the formation of silver halide grains. In particular, these spectral sensitizing dyes are preferably incorporated in the emulsion before the step of rinsing the emulsion or the step of chemical sensitization of the emulsion.

The amount of the spectral sensitizing dye to be incorporated can vary widely as necessary and is preferably in the range of $0.5\times10^{-6}$ to $1.0\times10^{-2}$ mol, more preferably $1.0\times10^{-6}$ to $5.0\times10^{-3}$ mol per mol of silver halide.

For red or infrared sensitization in the present invention, M-band type sensitization can be effectively accomplished by supersensitization with a compound represented by the general formula (A), (B), (Ea), (Eb) or (Ec) which described infra.

The supersensitizer represented by the general formula (A) can be used in combination with the supersensitizers represented by the general formulae (B), (Ea), (Eb) and (Ec) to exhibit a specifically improved effect of supersensitization.

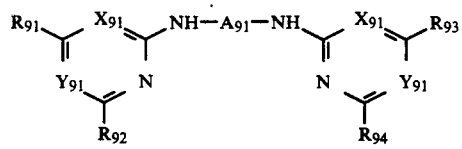

(A)

In the general formula (A), $A_{91}$ represents a divalent aromatic residue. $R_{91}$, $R_{92}$, $R_{93}$ and $R_{94}$ each represents a hydrogen atom, hydroxyl group, alkyl group, alkoxy group, aryloxy group, halogen atom, heterocyclic nucleus, heterocyclylthio group, arylthio group, amino group, alkylamino group, arylamino group, aralkylamino group, aryl group or mercapto group which may be substituted.

At least one of $A_{91}$, $R_{91}$, $R_{92}$ and $R_{94}$ contains sulfo groups. $X_{91}$ and Y91 each represents —CH= r —N=, with the proviso that at least one of $X_{91}$ and $Y_{91}$ represents —N=.

In the general formula (A), —$A_{91}$— represents a divalent aromatic residue which may contain —$SO_3M$ group (in which M represents a hydrogen atom or a cation which provides water-solubility, e.g., sodium and potassium).

—$A_{91}$— can be advantageously selected from the group consisting of —$A_{92}$— and —$A_{93}$— described infra, with the proviso that if none of $R_{91}$, $R_{92}$, $R_{93}$ and $R_{94}$ contains —$SO_3M_{91}$ group, —$A_{91}$— is selected from the group consisting of —$A_{92}$—.
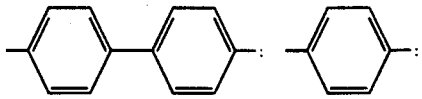
-$A_{92}$-:
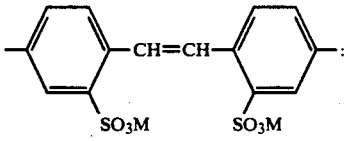
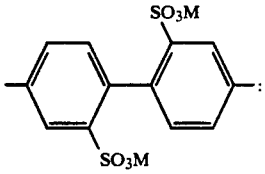
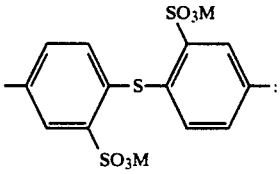
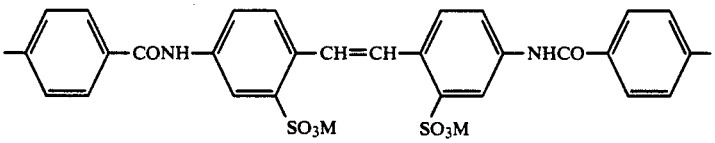
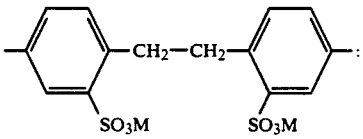
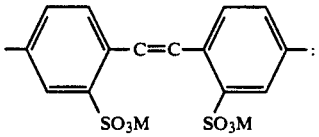
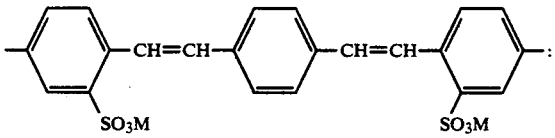
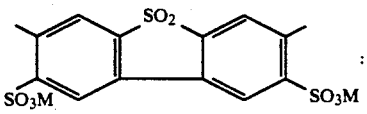
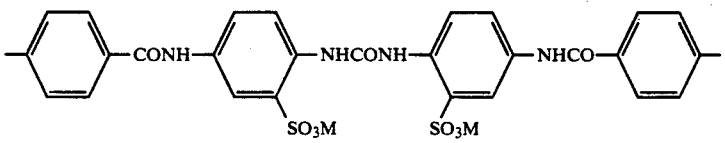
wherein M represents a hydrogen atom or a cation which provides water-solubility.

-continued

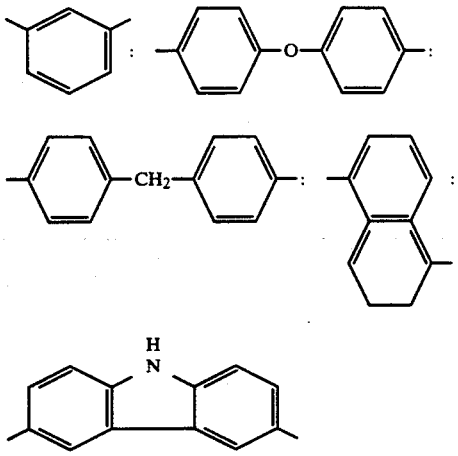

$R_{91}$, $R_{92}$, $R_{93}$ and $R_{94}$ each represents a hydrogen atom; a hydroxyl group; a alkyl group, preferably containing 1 to 8 carbon atoms, e.g., methyl, ethyl, n-propyl, n-butyl; an alkoxy group, preferably containing 1 to 8 carbon atoms, e.g., methoxy, ethoxy, propoxy, butoxy; an aryloxy group, e.g., phenoxy, naphthoxy, o-tolyloxy, p-sulfophenoxy; a halogen atom, e.g., chlorine, bromine; a heterocyclic nucleus, e.g., morpholinyl, piperidyl; an alkylthio group, e.g., methylthio, ethylthio; a heterocyclylthio group, e.g., benzothiazolyl, benzoimidazolylthio phenyltetrazolylthio; an arylthio group, e.g., phenylthio, tolylthio; an amino group; an alkylamino group or substituted alkylamino group, e.g., methylamino, ethylamino, propylamino, dimethylamino, diethylamino, dodecylamino, cyclohexylamino, β-hydroxyethylamino, di-(β-hydroxyethyl)amino, β-sulfoethylamino), arylamino or substituted arylamino group (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino; a heterocyclylamino group, e.g., 2-benzothiazolylamino, 2-pyridylamino; a substituted or unsubstituted aralkylamino group, e.g., benzylamino, o-anisylamino, m-anisylamino, p-anisylamino; an aryl group, e.g., phenyl; a or mercapto group.

$R_{91}$, $R_{92}$, $R_{93}$, and $R_{94}$ may be the same or different. If $—A_{91}—$ is selected from the group consisting of $—A_{93}—$, then at least one of $R_{91}$, $R_{92}$, $R_{93}$ and $R_{94}$ needs to contain the above mentioned sulfo group in the form of a free acid group or salt. $X_{91}$ and $Y_{91}$ each represents —CH= or —N=. Preferably, $X_{91}$ represents —CH=, and $Y_{91}$ represents —N=.

Specific examples of the compound represented by the general formula (A) to be used in the present invention will be set forth below, but the present invention should not be construed as being limited thereto.

| | |
|---|---|
| (A-1): | Disodium 4,4'-bis[2,6,di(2-naphthoxy)pyrimidine-4-ylamino]stilbene-2,2'-disulfonate |
| (A-2): | Disodium 4,4'-bis[2,6,di(2-naphthyl)-pyrimidine-4-ylamino]stilbene-2,2'-disulfonate |
| (A-3): | Disodium 4,4'-bis[2,6-dianilinopyrimidine-4-ylamino]stilbene-2,2'-disulfonate |
| (A-4): | Disodium 4,4'-bis[2-(2-naphthylamino)-6-anilinopyrimidine-4-ylamino]stilbene-2,2'-disulfonate |
| (A-5): | Triethylammonium 4,4'-bis[2,6-diphenoxy-pyrimidine-4-ylamino]stilbene-2,2'-disulfonate |
| (A-6): | Disodium 4,4'-bis[2,6-di(benzoimidazolyl-2-thio)pyrimidine-4-ylamino]stilbene-2,2'-disulfonate |
| (A-7): | Disodium 4,4'-bis[4,6-di(benzothiazolyl-2-thio)pyrimidine-2-ylamino]stilbene-2,2'-disulfonate |
| (A-8): | Disodium 4,4'-bis[4,6-di(benzothiazolyl-2-amino)pyrimidine-2-ylamino]stilbene-2,2'-disulfonate |
| (A-9): | Disodium 4,4'-bis[4,6-di(naphthyl-2-oxy) pyrimidine-2-ylamino]stilbene-2,2'-disulfonate |
| (A-10): | Disodium 4,4'-bis(4,6-diphenoxypyrimidine-2-ylamino)stilbene-2,2'-disulfonate |
| (A-11): | Disodium 4,4'-bis(4,6-diphenylthiopyrimidine-2-ylamino)stilbene-2,2'-disulfonate |
| (A-12): | Disodium 4,4'-bis(4,6-dimercaptopyrimidine-2-ylamino)biphenyl-2,2'-disulfonate |
| (A-13): | Disodium 4,4'-bis(4,6-dianilino-triazine-2-ylamino)stilbene-2,2'-disulfonate |
| (A-14): | Disodium 4,4'-bis(4-anilino-6-hydroxy-triazine-2-ylamino)stilbene-2,2'-disulfonate |
| (A-15): | Disodium 4,4'-bis[4,6-di(naphthyl-2-oxy) pyrimidine-2-ylamino]bibenzyl-2,2'-disulfonate |
| (A-16): | Disodium 4,4'-bis(4,6-dianilinopyrimidine-2-ylamino)stilbene-2,2'-disulfonate |
| (A-17): | Disodium 4,4'-bis[4-chloro-6-(2-naphthyloxy) pyrimidine-2-ylamino)biphenyl-2,2'-disulfonate |
| (A-18): | Disodium 4,4'-bis[4,6-di(1-phenyltetrazolyl-5-thio)pyrimidine-2-ylamino]stilbene-2,2'40 -disulfonate |
| (A-19): | Disodium 4,4'-bis[4,6-di(benzoimidazolyl-2-thio) pyrimidine-2-ylamino]stilbene-2,2'-disulfonate |
| (A-20): | Disodium 4,4'-bis(4-naphthylamino-6-anilino-triazine-2-ylamino]stilbene-2,2'-disulfonate |

Preferred among these specific examples are (A-1) to (A-6), (A-9), (A-15) and (A-20). Particularly preferred among these examples are (A-1), (A-2), (A-4), (A-5), (A-g), (A-15), and (A-20).

The supersensitizer compound represented by the general formula (A) is used in an amount of 0.01 to 5 g per mol of silver halide or in an amount of 5 to 2000, preferably 20 to 1500 by weight per weight of sensitizing dye. The compound represented by general formula (A) is preferably used in combination with a compound represented by the general formula (B).

The compound represented by the general formula (B) will be further described hereinafter.

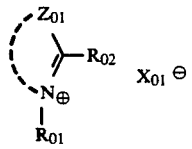

(B)

In the general formula (B), $Z_{01}$ represents a nonmetallic atom group required for the formation of a 5- or 6-membered nitrogen-containing heterocyclic ring. This heteroyclic ring may be condensed with benzene or naphthalene rings. Examples of such a heterocyclic group include thiazolium, e.g., thiazolium, 4-methylthiazolium, benzothiazolium, 5-methylbenzothiazolium, 5-chlorobenzothiazolium, 5-methoxybenzothiazolium, 6-methylbenzothiazolium, 6-methoxybenzothiazolium, naphtho[1,2-d]thiazolium, naphtho[2,1-d]thiazolium; oxazolium, e.g., oxazolium, 4-methyloxazolium, benzoxazolium, 5-chlorobenzoxazolium, 5-phenylbenzoxazolium, 5-methylbenzoxazolium, naphtho[1,2-d]oxazolium; imidazolium, e.g., 1-methylbenzimidazolium, 1-propyl-5-chlorobenzimidazolium, 1-ethyl-5,6-dichlorobenzimidazolium, 1-allyl-5-trifluoromethyl-6-chloro-benzimidazolium; and selenazolium, e.g., benzoselenazolium, 5-chlorobenzoselenazolium, 5-methylbenzoselenazolium, 5-methoxybenzoselenazolium, naphtho[1,2-d]selenazolium. $R_{01}$ represents a hydrogen atom, alkyl group, preferably containing 8 or less carbon atoms, e.g., methyl, ethyl, propyl, butyl, pentyl; or an alkenyl group, e.g., allyl. $R_{02}$ represents a hydrogen atom or lower alkyl group, e.g., methyl, ethyl. $R_{01}$ and $R_{02}$ each may be a substituted alkyl group. $X_{01}$ represents an acid anion, e.g., $Cl^-$, $Br^-$, $I^-$, $ClO_4^-$. Preferred among the groups represented by $Z_{01}$ are thiazoliums. Particularly preferred among the groups represented by $Z_{01}$ are substituted or unsubstituted benzothiazolium or naphthothiazolium. These groups are construed as including substituted groups.

Specific examples of the compound represented by the general formula (B) will be set forth below, but the present invention should not be construed as being limited thereto.

(B-1)

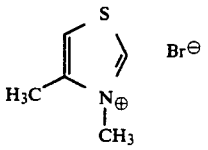

(B-2)

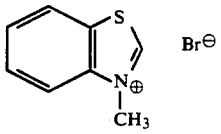

(B-3)

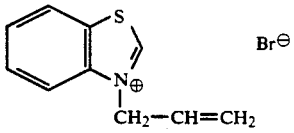

(B-4)

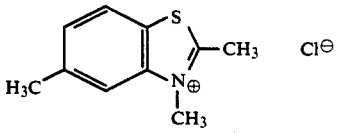

(B-5)

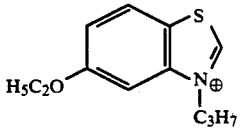

(B-6)

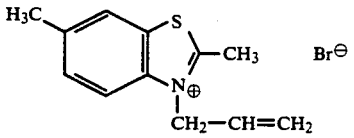

(B-7)

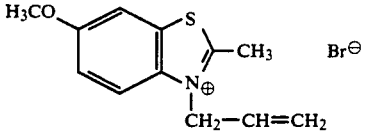

-continued (B-8)

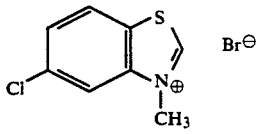

(B-9)

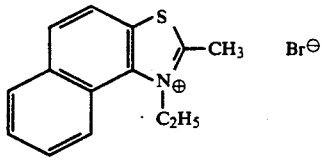

(B-10)

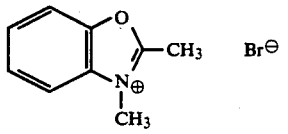

(B-11)

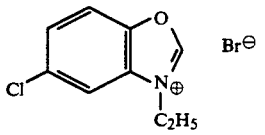

(B-12)

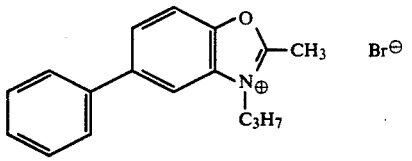

(B-13)

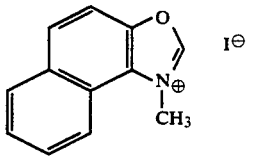

(B-14)

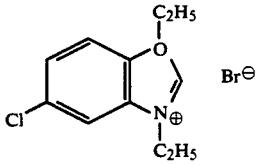

(B-15)

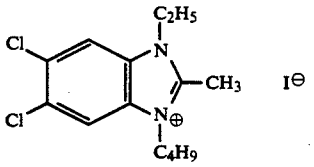

(B-16)

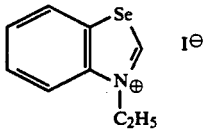

(B-17)

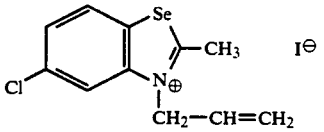

-continued (B-18)

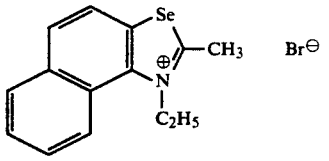

The present compound represented by the general formula (B) is preferably used in an amount of about 0.01 to 5 g per mol of silver halide in the emulsion.

The weight proportion of the infrared sensitizing dye to the compound represented by the general formula (B) is preferably in the range of 1/1 to 1/300, particularly 1/2 to 1/200.

The compound represented by the general formula (B) to be used in the present invention can be directly dispersed in the emulsion or incorporated in the emulsion in the form of solution in a proper solvent such as water, methyl alcohol, ethyl alcohol, propanol, methyl Cellosolve and acetone or a mixture thereof. Alternatively, the compound can be incorporated in the emulsion in the form of dispersion in a solution or colloid in accordance with the process for the incorporation of sensitizing dyes.

The incorporation of the compound represented by the general formula (B) in the emulsion can be effected before or after the incorporation of sensitizing dye. The compound represented by the general formula (B) and the sensitizing dye may be separately dissolved, and then incorporated in the emulsion separately at the same time or in admixture.

The combination of the infrared sensitizing dye and the compound represented by the general formula (B) can be advantageously used in combination with the compound represented by the general formula (A).

In a high silver chloride content emulsion which bas been infrared-sensitized, if the compound represented by the general formula (A) or (B) is used in combination with a heterocyclic mercapto compound, it provides a higher sensitivity and fog inhibition as well as stabilization of latent images and remarkable improvement in the dependence of the linearity of gradation on the development process.

Examples of such a heterocyclic mercapto compound include a thiazole ring, oxazole ring, oxazine ring, thiazole ring, thiazoline ring, selenazole ring, imidazole ring, indoline ring, pyrrolidine ring, tetrazole ring, thiadiazole ring, quinoline ring, oxadiazole ring, and compounds substituted by mercapto group. In particular, these heterocyclic mercapto compounds preferably contain a carboxyl group, sulfo group, carbamoyl group, sulfamoyl group, or hydroxyl group. JP-B-43-22883 describes the use of a heterocyclic mercapto compound as a supersensitizer. In the present invention, such a heterocyclic mercapto compound can be used in combination with the compound represented by the general formula (B) to exhibit remarkable effects of inhibiting fog and supersensitization.

For the red or infrared sensitization of the present invention, a supersensitizer which can be effectively used includes a condensate of 2 to 10 units of substituted or unsubstituted polyhydroxybenzene and formaldehyde represented by the general formula (Ea), (Eb) or (Ec). Such a supersensitizer has an effect of inhibiting the deterioration in latent images with time and reduction in gradation.

(Ea)

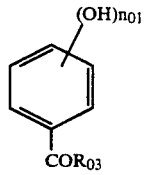

(Eb)

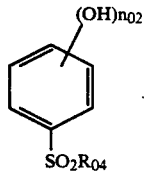

(Ec)

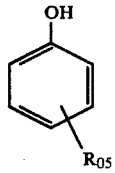

wherein $R_{03}$ and $R_{04}$ each represents OH, $OM_{01}$, $OR_{06}$, $NH_2$, $NHR_{06}$, $—N(R_{06})_2$, $—NHNH_2$ or $—NHNHR_{06}$ in which $R_{06}$ represents a $C_{1-8}$ alkyl group, allyl group or aralkyl group; $M_{01}$ represents an alkaline metal or alkaline earth metal; $R_{05}$ represents OH or halogen atom; and $n_{01}$ and $n_{02}$ each represents an integer 1, 2 or 3.

Specific examples of the substituted or unsubstituted polyhydroxybenzene as component of the aldehyde condensate to be used in the present invention will be set forth below, but the present invention should not be construed as being limited thereto.

| | |
|---|---|
| β-Resorcinolic acid | (E-1) |
| γ-Resorcinolic acid | (E-2) |
| Hydrazide 4-hydroxybenzoate | (E-3) |
| Hydrazide 3,5-hydroxybenzoate | (E-4) |
| p-Chlorophenol | (E-5) |
| Sodium hydroxybenzenesulfonate | (E-6) |
| p-Hydroxybenzoic acid | (E-7) |
| o-Hydroxybenzoic acid | (E-8) |
| m-Hydroxybenzoic acid | (E-9) |
| p-Dioxybenzene | (E-10) |
| Gallic acid | (E-11) |
| Methyl p-hydroxybenzoate | (E-12) |
| Amide o-hydroxybenzenesulfonate | (E-13) |
| Amide N-ethyl-o-hydroxybenzoate | (E-14) |

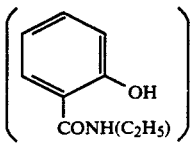

| | |
|---|---|
| Amide N-Diethyl-o-hydroxybenzoate | (E-15) |

-continued

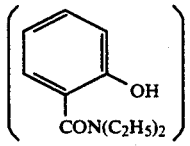

o-Hydroxybenzoic acid 2-methylhydrazide (E16)

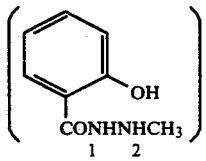

More particularly, such a condensate component can be selected from the group consisting of compounds represented by the general formulae (IIa), (IIb) and (IIc) described in JP-B-49-49504.

As a silver halide emulsion to be used in the present invention there can be preferably used an emulsion of silver bromochloride or silver chloride substantially free of silver iodide. The term "emulsion substantially free of silver iodide" as used herein means an emulsion having a silver iodide content of 1 mol % or less, preferably 0.2 mol % or less. The halogen compositions of grains can be the same or different. If an emulsion having the same halogen composition in grains is used, the properties of grains can be easily made uniform. In respect to the halogen composition distribution inside the silver halide grains, any of the examples from the following group can be properly selected consisting of a so-called uniform structure wherein the halogen composition is equal in any portion in the silver halide grains, a so-called lamination structure wherein the halogen composition differs from the core of the silver halide grains to the shell thereof (one or more layers), and a structure wherein there are contained non-layer portions having different halogen compositions inside or on the silver halide grains (if portions are contained on the surface of the silver halide grains, having different compositions connected to an edge, corner or surface thereof). In order to obtain a high sensitivity, the latter two structures are advantageously used in view of pressure resistance. If the silver halide grains have such a structure, portions having different halogen compositions may have a definite boundary each other or a indefinite boundary due to a creation of a mixed crystal formed owing to the difference in halogen composition, or a positively continuous structure change.

In respect to the halogen composition of these silver bromochloride emulsions, any conventional silver bromide/silver chloride proportion can be used. This value can vary widely depending on the purpose. The proportion of silver chloride is preferably 2% or more.

Light-sensitive materials suitable for rapid processing preferably comprise an emulsion having a high silver chloride content, i.e., so-called high silver halide content emulsion. The silver halide content of such a high silver halide content emulsion is preferably in the range of 90 mol % or more, more preferably 95 mol % or more.

Such a high silver chloride content emulsion preferably has a structure wherein silver bromide-localized phases exist in a layer or non-layer structure inside and/or on the silver halide grains. In respect to the halogen composition of the above mentioned localized layers, the silver bromide content is preferably at least 10 mol %, more preferably more than 20 mol %. These localized layers can exist inside the grains, on the edge or corner of the grains or on the surface of the grains. In a preferred embodiment, localized layes exist on the corner of the grains in an epitaxial growth process.

The formation of these silver bromide-localized phases can be accomplished by various methods. For example, a soluble silver salt and a soluble halogen salt can be allowed to react with each other in a single mixing process or simultaneous mixing process to form localized phases. Alternatively, localized phases can be formed by a so called conversion process involving the process comprising the conversion of silver halide which has been already formed into silver halide having a small solubility product. Furthermore, fine silver bromide grains can be added to the system so that they are recrystallized on the surface of silver chloride grains to form localized phases.

On the other hand, in order to minimize the drop in the sensitivity when the light-sensitive material is pressurized, even a high silver chloride content emulsion having a silver chloride content of 90 mol % or more is used, the emulsion preferably comprises grains having a uniform structure wherein the halogen composition distribution therein is small.

In order to reduce the replenishment rate of the developing solution, it is effective to further increase the silver chloride content of the silver halide emulsion. In this case, a substantially pure silver chloride emulsion having a silver chloride content of 98 to 100 mol % can be preferably used.

The mean grain size (number-average of grain sizes determined as calculated in terms of diameter of circle equivalent to projected area of grains) of silver halide grains contained in the silver halide emulsion to be used in the present invention is preferably in the range of 0.1 to 2 μm.

In respect to the distribution of grain sizes, the fluctuation coefficient (determined by dividing the standard deviation of grain size distribution by mean grain size) is 20% or less, preferably 15% or less, i.e., monodisperse. These monodisperse emulsions can be preferably coated on the same layer in admixture or separately coated on separate layers in order to get a broad latitude.

The silver halide grains in the photographic emulsions may be so-called regular grains having a regular crystal form such as cube, octahedron, and tetradecahedron, or those having an irregular crystal form such as sphere and tablet, or those having a combination of these crystal forms. In the present invention, the silver halide grains comprise grains having such regular crystal forms in a proportion of 50% or more, preferably 70% or more, more preferably 90% or more.

Alternatively, there can be preferably used an emulsion wherein tablet grains having a mean aspect ratio (diameter determined in terms of circle/thickness ratio) of 5 or more, preferably 8 or more account for more than 50% of the total grains as calculated in terms of projected area.

The photographic emulsion to be used in the present invention can be prepared according to the processes described in P. Glafkides, "Chimie et Physique", Paul Montel, 1967, G. F. Duffin, "Photographic Emulsion Chemistry", Focal Press, 1966, and V. L. Zelikman et al., "Making and Coating Photographic Emulsion", Focal Press, 1964. More specifically, the emulsion can be prepared by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used. Furthermore, a so-called controlled double jet process, in which a pAg value of a liquid phase in which silver halide grains are formed is maintained constant, may also be used. According to the controlled double jet process, a silver halide emulsion having a regular crystal form and a substantially uniform grain size can be obtained.

During the formation or physical ripening of silver halide grains to be used in the present invention, various polyvalent metallic ion impurities can be present in the system. Examples of such polyvalent metallic ion impurities include cadmium salt, zinc salt, lead salt, copper salt, thallium salt, and salt or complex salt of the groups VIII elements such as iron, ruthenium, rhodium, palladium, osmium, iridium and platinum. Particularly preferred among impurities are the group VIII elements. The amount of such a compound to be incorporated can vary depending on the purpose of application and is preferably in the range of $10^{-9}$ to $10^{-2}$ mol per mol of silver halide.

These metallic ions will be further described hereinafter. The iridium ion-containing compound is preferably used in the form of trivalent or tetravalent salt or complex salt, particularly complex salt. Preferred examples of such an iridium salt include halogen salt, amines and oxarate complex salt such as iridium (III) chloride, iridium (III) bromide, iridium (IV) chloride, sodium hexachloroiridimate (III), potassium hexachloroiridimate (IV), hexamineiridium salt (IV), trioxarateiridium salt (III), and trioxarate-iridium salt. The amount of such an iridium salt is in the range of $5\times10^{-9}$ to $1\times10^{-4}$ mol, preferably $5\times10^{-8}$ to $5\times10^{-6}$ mol per mol of silver.

The platinum ion-containing compound is preferably used in the form of divalent or tetravalent salt or complex salt, preferably complex salt. Examples of such a platinum salt or complex salt include platinum chloride (IV), potassium hexachloroplatinumate (IV), tetrachloroplatinumic acid (II), tetrabromoplatinumic acid (II), sodium tetrakis(thiocyante)platinumate (IV), and hexamineplatinum chloride (IV). The amount of such a platinum salt or complex salt is in the range of $1\times10^{-8}$ to $1\times10^{-5}$ mol per mol of silver.

The palladium ion-containing compound is normally used in the form of divalent or tetravalent salt or complex salt, particularly complex salt. Examples of such a palladium salt or complex salt include sodium tetrachloropalladiumate (II), sodium tetrachloropalladiumate (IV), potassium hexachloropalladiumate (IV), tetraminepalladium chloride (II), and potassium tetracyanopalladiumate (II).

Examples of the nickel ion-containing compound include nickel chloride, nickel bromide, potassium tetrachloronickelate (II), hexaminenickel chloride (II), and sodium tetracyanonickelate (II).

The rhodium ion-containing compound is preferably used in the form of trivalent salt or complex salt. Examples of such a rhodium salt or complex salt include potassium hexachlororhodiumate, sodium hexabromorhodiumate, and ammonium hexachlororhodiumate. The amount of such a rhodium salt is in the range of $10^{-8}$ to $10^{-4}$ mol per mol of silver.

The iron ion-containing compound is normally used in the form of divalent or trivalent iron ion-containing compound, preferably iron salt or iron complex salt which stays water-soluble in the concentration range used, particularly iron complex salt which can be easily contained in silver halide grains. Specific examples of such an iron salt or complex salt include hexacyanoironate (II), hexacyanoironate complex salt (III), ferrous thiocyanate, and ferric thiocyanate. The amount of such an iron salt or complex salt to be used is in the range of $5\times10^{-9}$ to $1\times10^{-3}$ mol, preferably $1\times10^{-8}$ to $1\times10^{-4}$ mol per mol of silver in silver halide.

In order to incorporate the above mentioned metallic ion-donative compound in the localized layer and/or other portion (substrate) in the present silver halide grains, the compound can be dissolved in a dispersant such as aqueous solution of gelatin, aqueous solution of halide, aqueous solution of silver salt and other aqueous solutions directly or in the form of finely divided silver halide grains containing such metallic ions.

The incorporation of metallic ions in the emulsion grains can be effected before, during or shortly after the formation of grains depending on which position the metallic ions are to be contained in the grains.

If a silver halide emulsion having a high silver chloride content is used, a localized phase having a high silver bromide content in the emulsion is preferably deposited together with at least 50% of the total iridium to be added during the preparation of silver halide grains.

In order to deposit the localized phase together with iridium ions, an iridium compound is supplied at the same time with, shortly before or shortly after the supply of silver and/or halogen to be used for the formation of a localized phase, or iridium is previously contained in fine silver bromide grains to be used for the formation of a localized phase so that these fine grains are dissolved and contained in the localized layer.

The silver halide emulsion to be used is normally subjected to chemical sensitization.

The chemical sensitization can be accomplished by sulfur sensitization with, e.g., an unstable sulfur compound, noble metal sensitization with, e.g., gold, and reduction sensitization, singly or in combination thereof. As compounds to be used for the chemical sensitization there can be preferably used those described in JP-A-62-215272, lower right column on page 18—upper right column on page 22 therein.

The silver halide emulsion to be used in the present invention can comprise various compounds or precursors thereof for the purpose of inhibiting fogging during the preparation, storage or photographic processing of light-sensitive material or stabilizing the photographic properties thereof. Specific examples of compounds which can be preferably used include those described in JP-A-62-215272, pp. 39 to 72 therein.

Examples of such compounds include many compounds known as fog inhibitors or stabilizers such as azoles (e.g., benzothiazolium, nitroimidazole, nitro benzimidazole, chlorobenzimidazole, bromobenzimidazole, mercaptothiazole, mercaptobenzothiazole, mercaptobenzim idazole, mercaptothiadiazole, aminotriazole, benzotriazole, nitrobenzotriazole, mercaptotetrazole (particularly 1-phenyl-5-mercaptotetrazole or phenyl group substituted by N-methylureide group in the m-position of the above compound), mercaptopyrimidines, mercaptotriazines, thioketo compounds (e.g., oxadolinethione), azaindenes (e.g., triazaindene, tetraazaindene (particularly 4-hydroxy-substituted (1,3,3a,7)tetraazaindene), pentaazaindene), benzenethiosulfonic acid, benzenesulfinic acid, amide benzenesulfonate.

In particular, a mercaptoazole represented by the general formula (X), (XI) or (XII) is preferably incorporated in the coating solution for the silver halide emulsion. The amount of the mercaptoazole to be incorporated is preferably in the range of $1\times10^{-5}$ to $5\times10^{-2}$ mol, more preferably $1\times10^{-4}$ to $1\times10^{-2}$ mol per mol of silver halide.

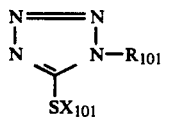

(X)

wherein $R_{101}$ represents an alkyl group, alkenyl group or aryl group; and $X_{101}$ represents a hydrogen atom, alkaline metal atom such as sodium and potassium, ammonium group such as tetramethylammonium and trimethylbenzylammonium or precursor which can become a hydrogen atom or an alkaline metal under an alkaline condition, such as acetyl, cyanoethyl and methanesulfonylethyl.

Examples of the alkyl and alkenyl groups represented by $R_{101}$ include substituted, unsubstituted and alicyclic alkyl and alkenyl groups. Examples of substituents to be contained in the substituted alkyl group include halogen atom, nitro group, cyano group, hydroxyl group, alkoxy group, aryl group, acylamino group, alkoxycarbonylamino group, ureide group, amide group, heterocyclic group, acyl group, sulfamoyl group, sulfonamide group, thioureide group, carbamoyl group, alkylthio group, arylthio group, heterocyclic thio group, carboxylic acid group, sulfonic acid group, and salts thereof.

The above mentioned ureide, thioureide, sulfamoyl, carbamoyl and amino groups include unsubstituted, N-alkyl-substituted and N aryl-substituted compounds. Examples of the aryl group include phenyl group and substituted phenyl group. Examples of substituents to be contained in the substituted phenyl group include alkyl group and substituents described with reference to the alkyl group.

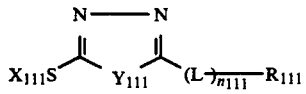

(XI)

wherein $Y_{111}$ represents an oxygen atom or sulfur atom.

L represents a divalent connecting group. $R_{111}$ represents hydrogen atom, an alkyl group, an alkenyl group or an aryl group. The alkyl group and alkenyl group represented by $R_{111}$ and the group represented by $X_{111}$ are as defined in the general formula (X).

Specific examples of the divalent connecting group represented by L include

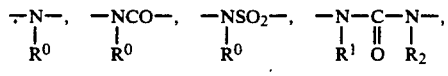

-continued

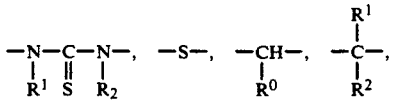

and a combination thereof.

The suffix $n_{111}$ represents an integer 0 or 1. $R_0$, $R_1$ and $R_2$ each represents a hydrogen atom, alkyl group or aralkyl group.

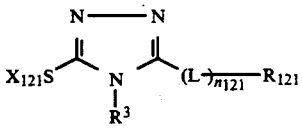

(XII)

wherein $n_{121}$, $R_{121}$ and $X_{121}$ are the same as $n_{111}$, $R_{111}$ and $X_{111}$, respectively, as defined in the general formula (XI); L is as defined in the general formula (XI); $R^3$ has the same meaning as $R_{121}$. These substituents may be the same or different.

Specific examples of the compounds represented by the general formulae (X), (XI) and (XII) will be further described below, but the present invention should not be construed as being limited thereto.

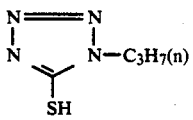

(X-1)

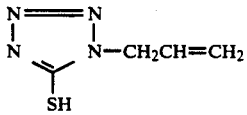

(X-2)

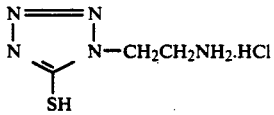

(X-3)

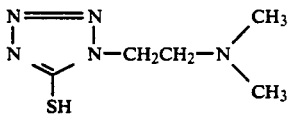

(X-4)

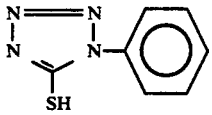

(X-5)

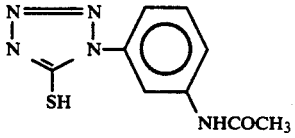

(X-6)

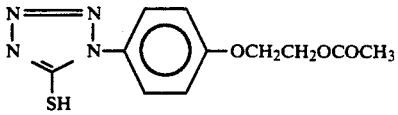

(X-7)

-continued (X-8)

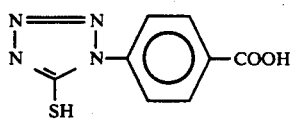

(X-9)

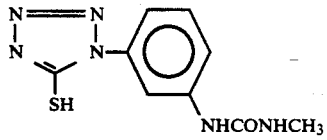

(X-10)

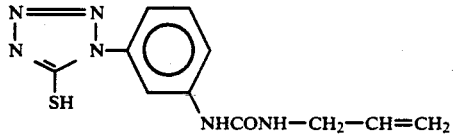

(XI-11)

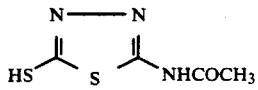

(XI-12)

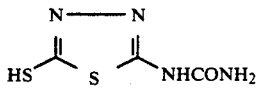

(XI-13)

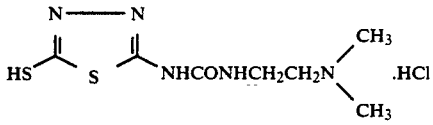

(XI-14)

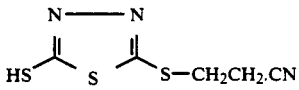

(XI-15)

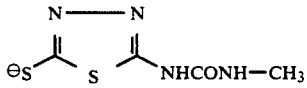

(XI-16)

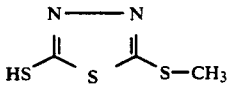

(XI-17)

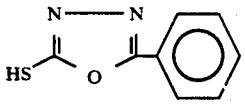

(XII-18)

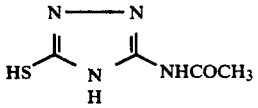

(XII-19)

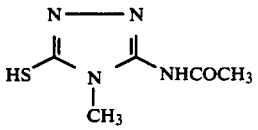

(XII-20)

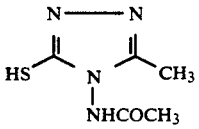

-continued (XII-21)

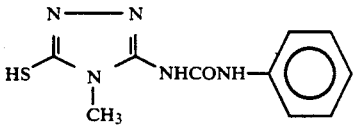

The emulsion to be used in the present invention may be of any type such as so-called surface latent image type wherein latent images are formed mainly on the surface of grains and so-called internal latent image type wherein latent images are formed mainly inside grains.

If the present invention is applied to color light-sensitive materials, the color light-sensitive materials normally comprise yellow, magenta and cyan couplers which undergo coupling with an oxidation product of an aromatic amine color developing agent to form colors of yellow, magenta and cyan.

Cyan, magenta and yellow couplers which can be preferably used in the present invention are represented by the general formulae (C-I), (C-II), (M-I), (M-II) and (Y):

(C-I)

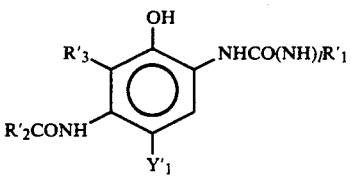

(C-II)

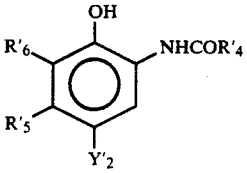

(M-I)

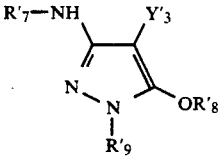

(M-II)

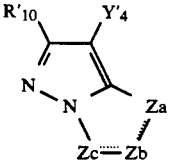

(Y)

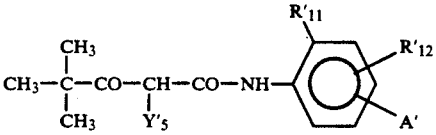

In the general formulae (C-I) and (C-II), $R'_1$, $R'_2$ and $R'_4$ each represents a substituted or unsubstituted aliphatic, aromatic or heterocyclic group. $R'_3$, $R'_5$ and $R'_6$ each represents a hydrogen atom, halogen atom, aliphatic group, aromatic group or acylamino group. $R'_3$ may also represent a nonmetallic atom group which forms a nitrogen-containing 5- or 6-membered ring together with $R'_2$. $Y'_1$ and $Y'_2$ each represents a hydrogen atom or a group capable of being released upon coupling with an oxidation product of a developing agent. The suffix l represents an integer 0 or 1.

In the general formula (C-II), $R'_5$ is preferably an aliphatic group such as methyl group, ethyl group, propyl group, butyl group, pentadecyl group, tert-butyl group, cyclohexyl group, cyclohexylmethyl group, phenylthiomethyl group, dodecyloxyphenylthiomethyl group, butanamidemethyl group and methoxymethyl group.

The cyan coupler represented by the general formula (C-I) or (C-II) will be further described hereinafter.

Where general formula (C-I) represents a cyan coupler, $R'_1$ is preferably an aryl group or heterocyclic ring, more preferably aryl group substituted by halogen atom, alkyl group, alkoxy group, aryloxy group, acylamino group, acyl group, carbamoyl group, sulfonamide group, sulfamoyl group, sulfonyl group, sulfamide group, oxycarbonyl group or cyano group.

In the general formula (C-I), if $R'_3$ and $R'_2$ do not together form a ring, then $R'_2$ is preferably a substituted or unsubstituted alkyl or aryl group, particularly substituted aryloxy-substituted alkyl group, and $R'_3$ is preferably a hydrogen atom.

In the general formula (C-II), $R'_4$ is preferably a substituted or unsubstituted alkyl or aryl group, particularly substituted aryloxy-substituted alkyl group.

In the general formula (C-II), $R'_5$ is preferably a $C_{2-15}$ alkyl group and a substituted methyl group containing 1 or more carbon atoms. Preferred examples of such substituents include arylthio group, alkylthio-group, acyamino group, aryloxy group, and alkyloxy group.

In the general formula (C-II), $R'_5$ is more preferably a $C_{2-15}$ alkyl group, particularly a $C_{2-4}$ alkyl group.

In the general formula (C-II), $R'_6$ is preferably a hydrogen atom or halogen atom, particularly chlorine atom or fluorine atom. In the general formulae (C-I) and (C-II), $Y'_1$ and $Y'_2$ each is preferably a hydrogen atom, halogen atom, alkoxy group, aryoxy group, acyloxy group or sulfonamide group.

In the general formula (M-I), $R'_7$ and $R'_9$ each represents an aryl group. $R'_8$ represents a hydrogen atom or aliphatic or aromatic acyl or sulfonyl group. $Y'_3$ represents a hydrogen atom or separatable group. The substituents which can be contained in the aryl group (preferably phenyl group) represented by $R'_7$ and $R'_9$ are the same as those which can be contained in the substituent $R'_1$ as defined for general formula (C-1). If two or more such substituents are included, they may be the same or different. $R'_8$ is preferably a hydrogen atom or aliphatic acyl or sulfonyl group, particularly hydrogen atom. The separatable group represented by $Y'_3$ is preferably of the type which can be separated by any one of sulfur, oxygen and nitrogen atom, particularly sulfur atom-releasable type as described in U.S. Pat. No. 4,351,897 and International Patent Application W088/04795.

In the general formula (M-II). $R'_{10}$ represents a hydrogen atom or substituent. $Y'_4$ represents a hydrogen atom or separatable group, particularly a halogen atom or arylthio group. Za, Zb and Zc each represents a methine, substituted methine, =N— or —NH—. One of the Za-Zb bond or the Zb-Zc bond is a double bond, and the other a single bond. If Zb-Zc bond is a carbon-carbon double bond, it may be a part of an aromatic ring. At the position, $R'_{10}$ or $Y'_4$, a dimer or higher polymer may be formed. If Za, Zb or Zc is a substituted methine, the substituted methine may form a dimer or higher polymer.

Preferred among the pyrazoloazole couplers represented by the general formula (M-II) are imidazo[1,2-b]pyrazoles as described in U.S. Pat. No. 4,500,630 because they provide developed dyes having a small yellow subsidiary absorption and excellent fastness to light. Pyrazolo[1,5-b][1,2,4]triazole as described in U.S. Pat. No. 4,540,654 is particularly preferred.

Other preferred examples of pyrazoloazole couplers include pyrazolotriazole couplers comprising branched alkyl groups directly connected to the 2, 3 and 6-position of pyrazolotriazole ring as described in JP-A-61-65245, pyrazoloazole couplers comprising sulfonamide groups contained in the molecule as described in JP-A-61-65246, pyrazoloazole couplers containing alkoxyphenylsulfonamide ballast groups therein as described in JP-A-61-147254, and pyrazolotriazole couplers containing alkoxy or aryloxy groups in the 6-position as described in European Patents (Disclosure) 226,849 and 294,785.

In the general formula (Y), $R'_{11}$ represents a halogen atom, alkoxy group, trifluoromethyl group or aryl group, and $R'_{12}$ represents a hydrogen atom, halogen atom or alkoxy group. A' represents —$NHCOR'_{13}$ —$NHSO_2$-$R'_{13}$, —$SO_2NHR'_{13}$, —$COOR'_{13}$ or $$-SO_2\underset{\underset{R'_{14}}{|}}{N}-R'_{13},$$

with the proviso that $R'_{13}$ and $R'_{14}$ each represents an alkyl group, aryl group or acyl group. $Y'_5$ represents a separatable group. The substituents on the groups of $R'_{12}$, $R'_{13}$ and $R'_{14}$ are the same as those to be contained in $R_1$ in the general formula (C-1). The separatable group represented by $Y'_5$ is of the type which can be separated by either oxygen or nitrogen atom, particularly a nitrogen atom-separatable type.

Specific examples of couplers represented by the general formulae (C-I), (C-II), (M-I) (M-II) and (Y) will be set forth below, but the present invention should not be construed as being limited thereto.

(C-1)

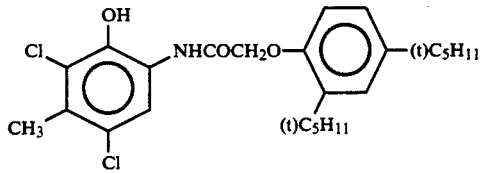

-continued
(C-2)
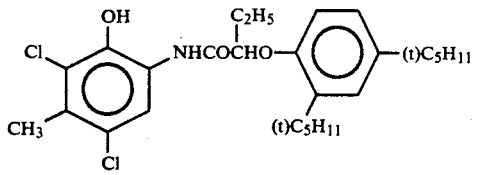
(C-3)
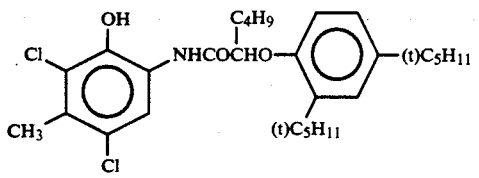
(C-4)
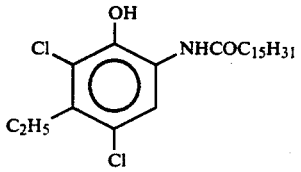
(C-5)
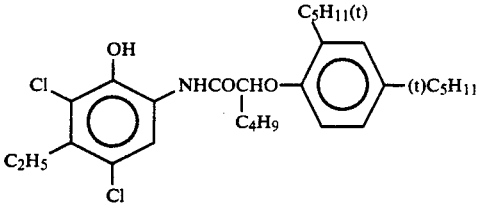
(C-6)
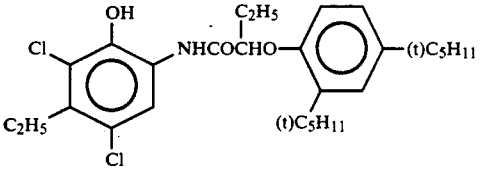
(C-7)
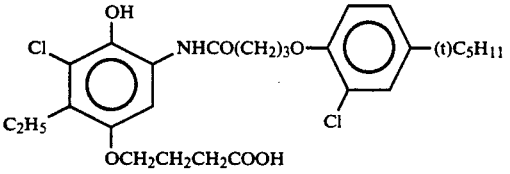
(C-8)
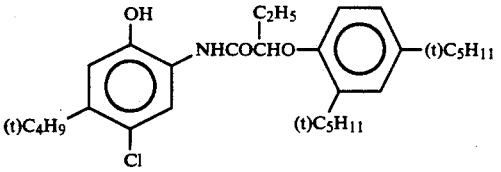
(C-9)
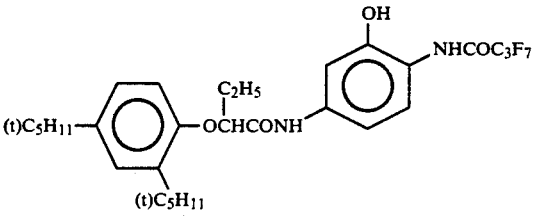

-continued
(C-10)
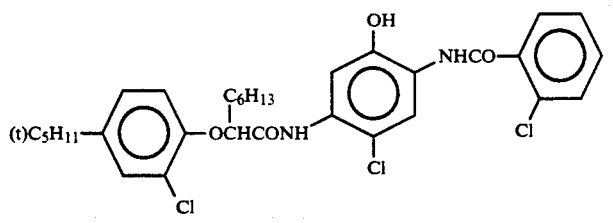
(C-11)
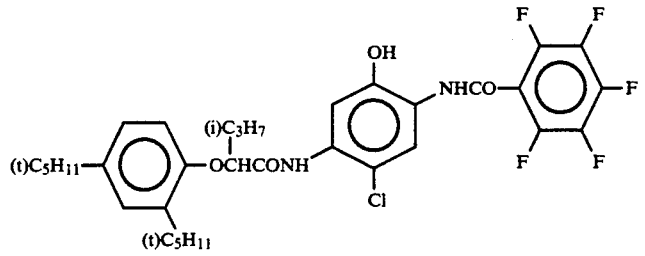
(C-12)
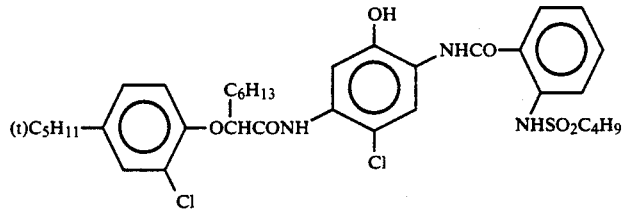
(C-13)
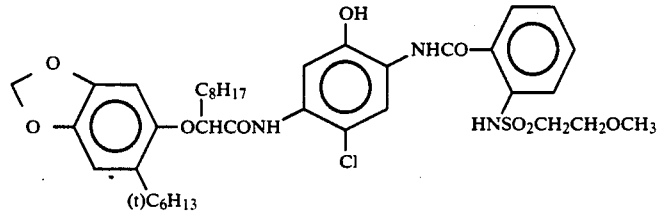
(C-14)
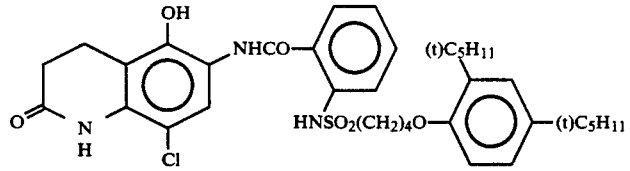
(C-15)
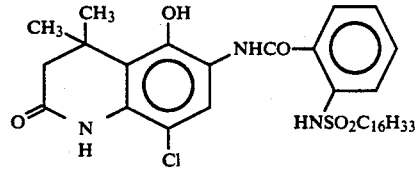
(C-16)
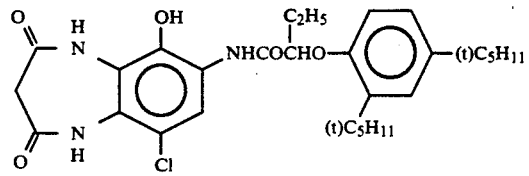

-continued
(C-17)
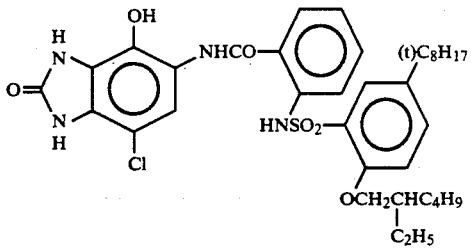
(C-18)
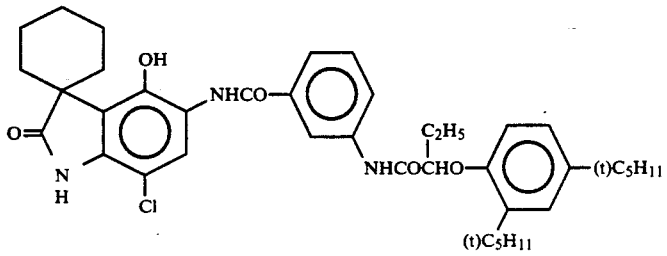
(C-19)
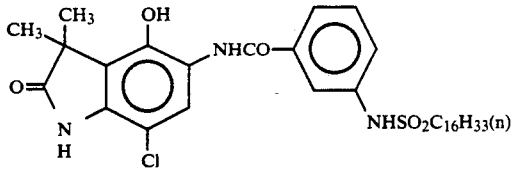
(C-20)
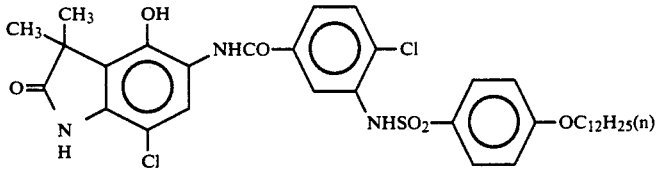
(C-21)
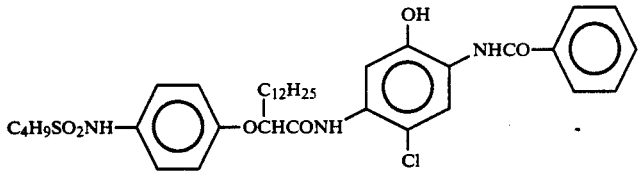
(C-22)
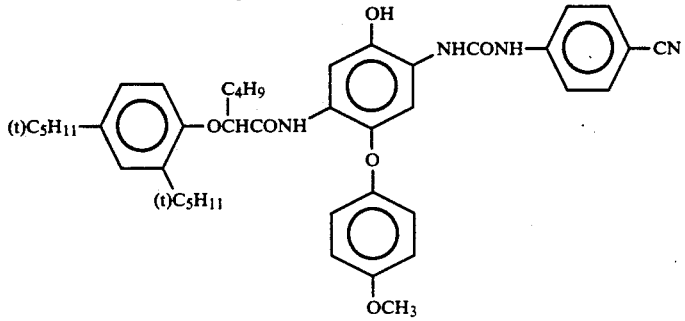

-continued
(M-1)
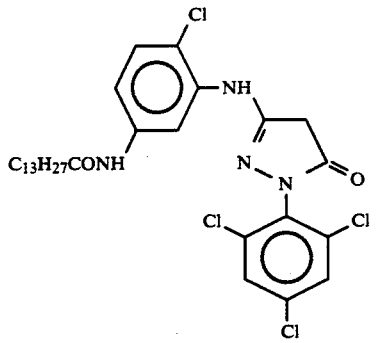
(M-2)
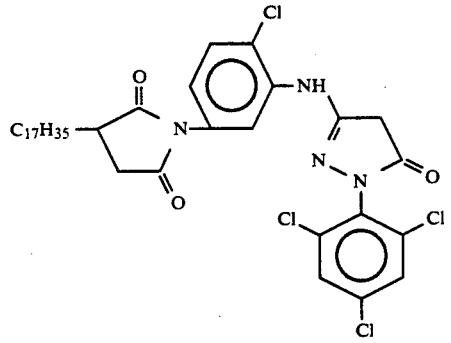
(M-3)
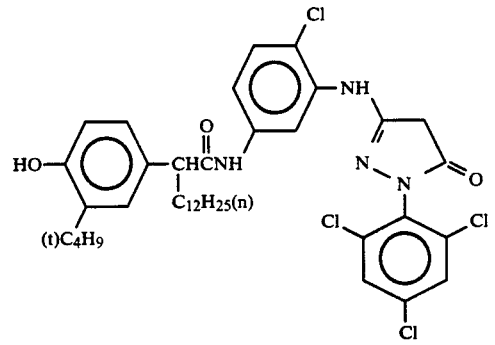
(M-4)
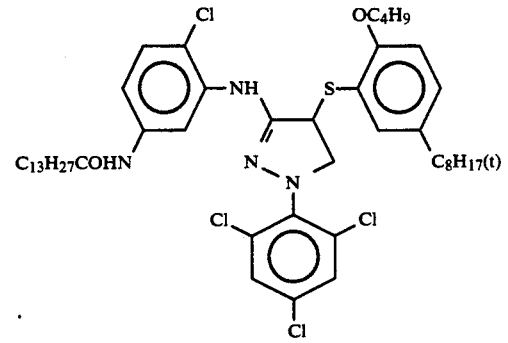

-continued
(M-5)
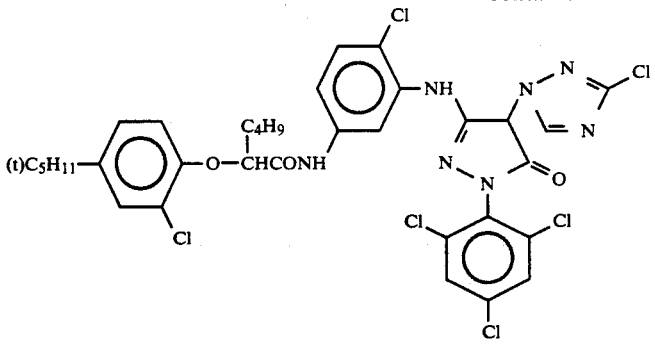
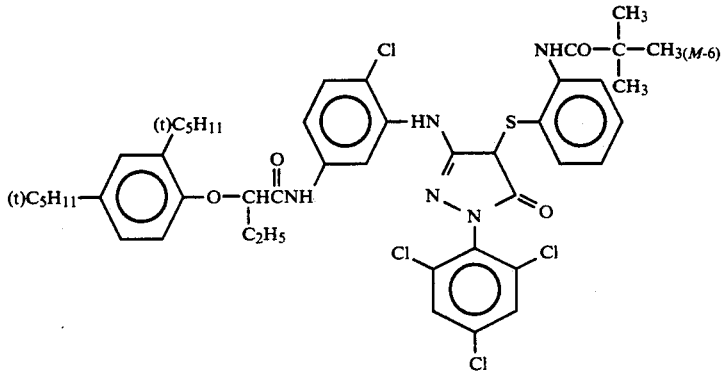
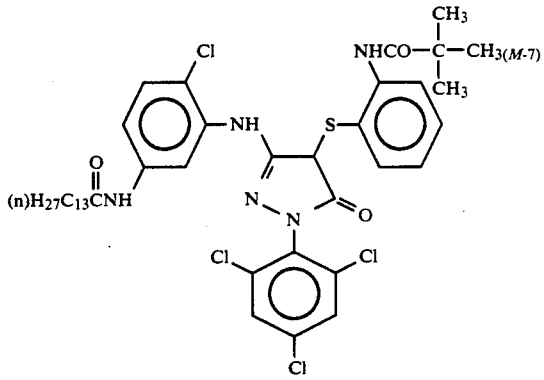
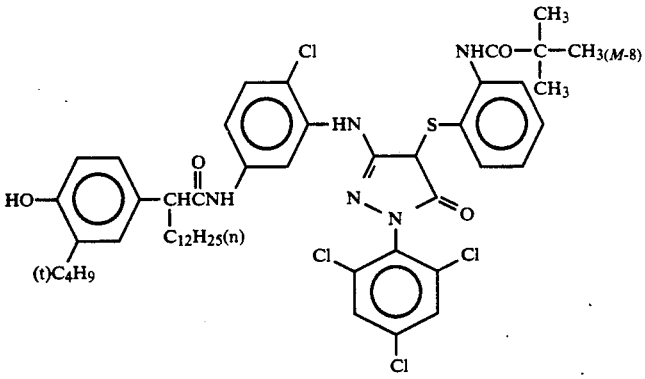

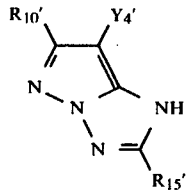
| Compound | $R_{10}'$ | $R_{15}'$ | $Y_4'$ |
|---|---|---|---|
| M-9 | $CH_3$— | 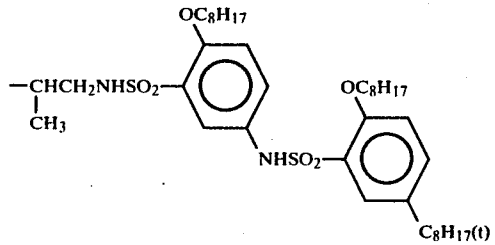 | Cl |
| M-10 | " | 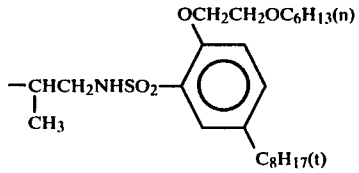 | " |
| M-11 | $(CH_3)_3C$— | 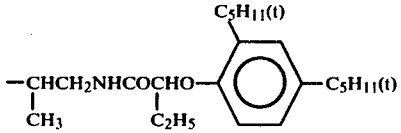 | 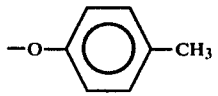 |
| M-12 | 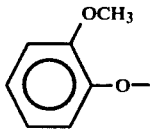 | 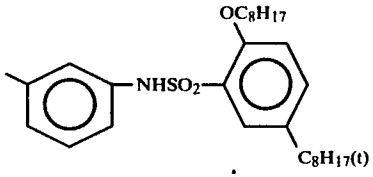 | 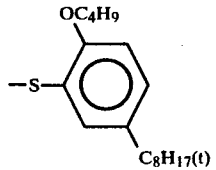 |

-continued
| | | | |
|---|---|---|---|
| M-13 | $CH_3$— | 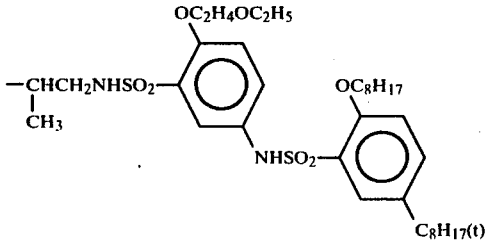 | Cl |
| M-14 | " | 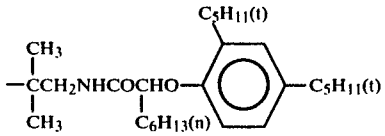 | " |
| M-15 | $CH_3$— | 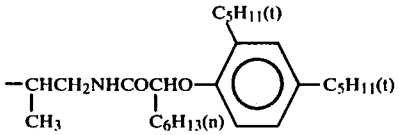 | Cl |
| M-16 | " | 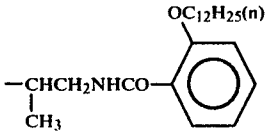 | " |
| M-17 | " | 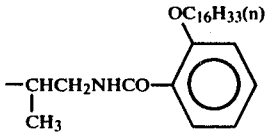 | " |

-continued
| | | | |
|---|---|---|---|
| M-18 | 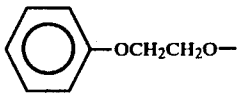 | 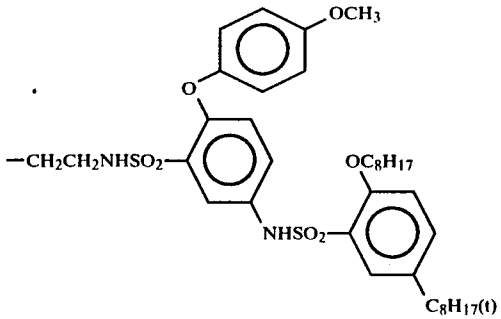 | 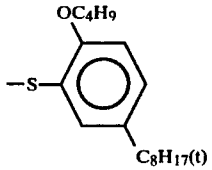 |
| M-19 | $CH_3CH_2O-$ | " | " |
| M-20 | 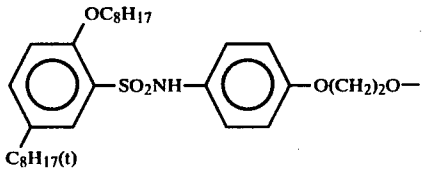 | 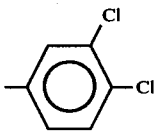 | " |
| M-21 | 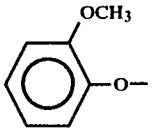 | 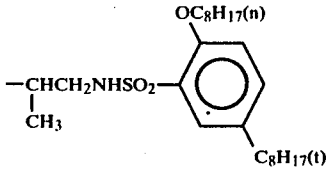 | Cl |
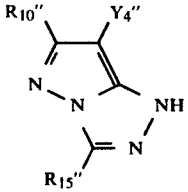
| Compound | $R_{10}''$ | $R_{15}''$ | $Y_4''$ |
|---|---|---|---|
| M-22 | $CH_3-$ | 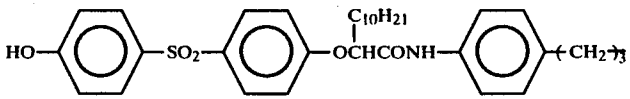 | Cl |

-continued
| | | | |
|---|---|---|---|
| M-23 | " | 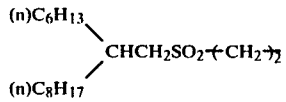 | " |
| M-24 | 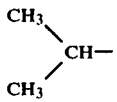 | 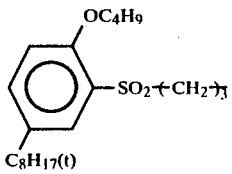 | " |
| M-25 | 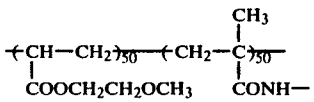 | 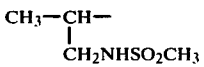 | Cl |
| M-26 | 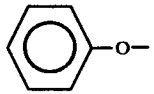 | 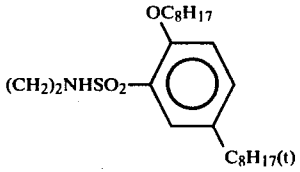 | " |
| M-27 | $CH_3$— | 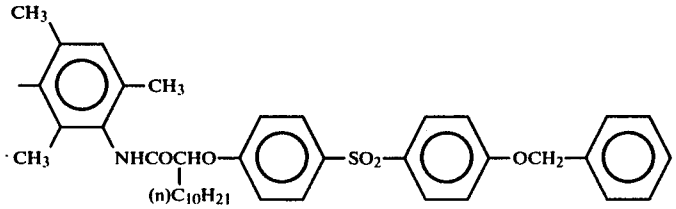 | " |
| M-28 | $(CH_3)_3C$— | 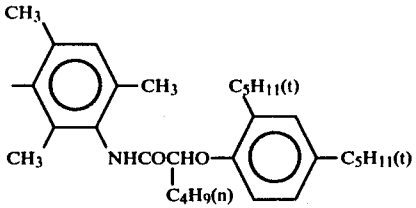 | Cl |

-continued
| | | | |
|---|---|---|---|
| M-29 | 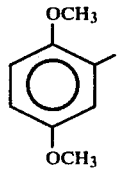 | 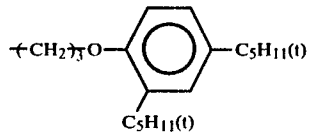 | " |
| M-30 | $CH_3-$ | $(n)C_{18}H_{37}$<br>$-CH-NCOCH_2CH_2COOH$<br>$C_2H_5$ | " |

(Y-1)
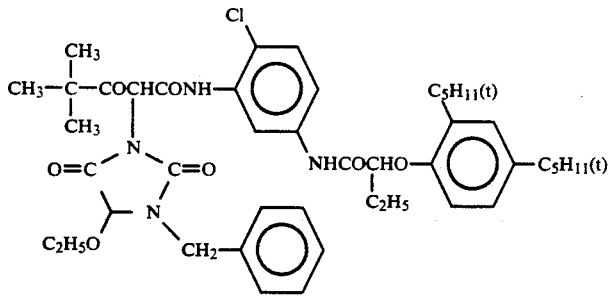
(Y-2)
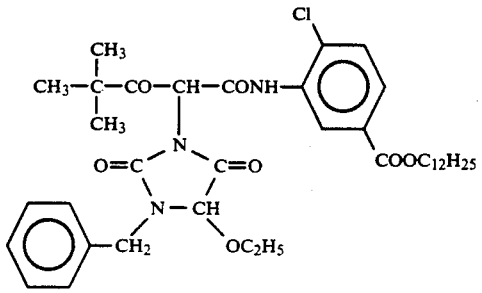
(Y-3)
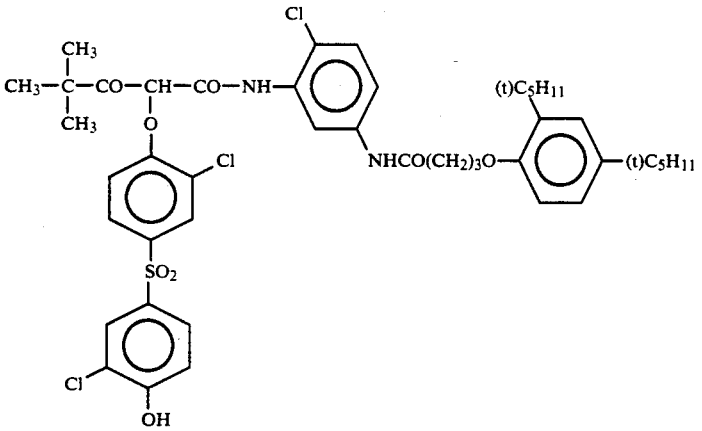
(Y-4)
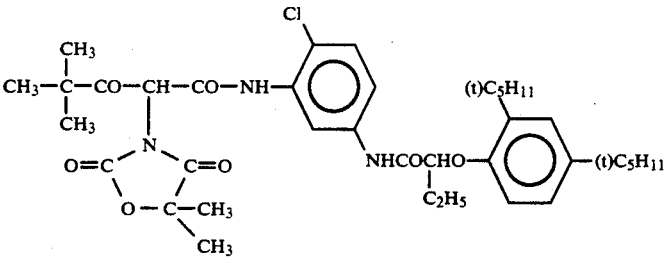
(Y-5)
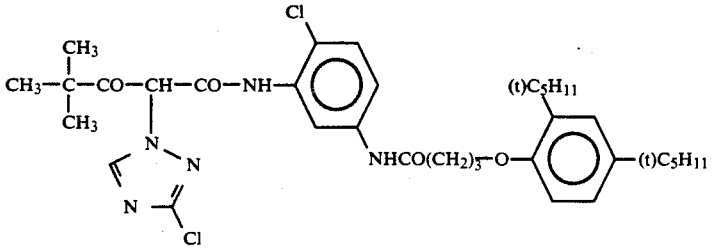

-continued (Y-6)

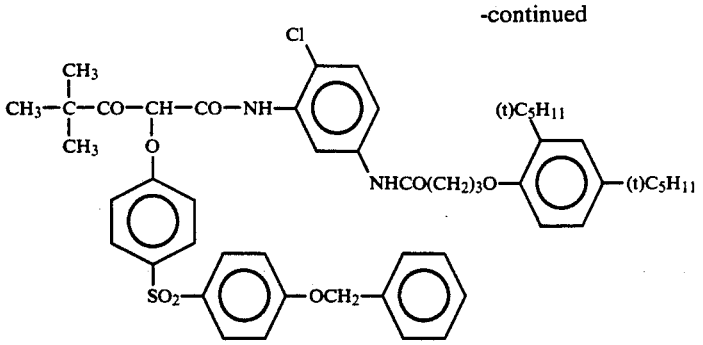

(Y-7)

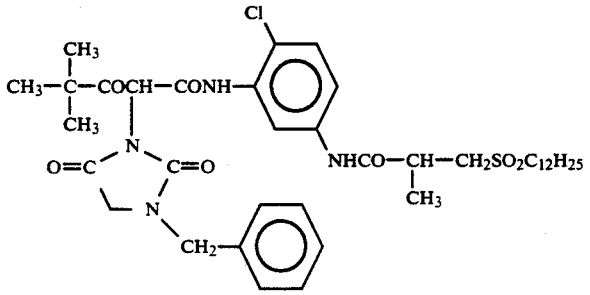

(Y-8)

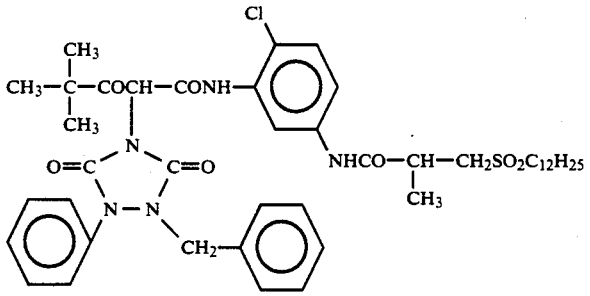

(Y-9)

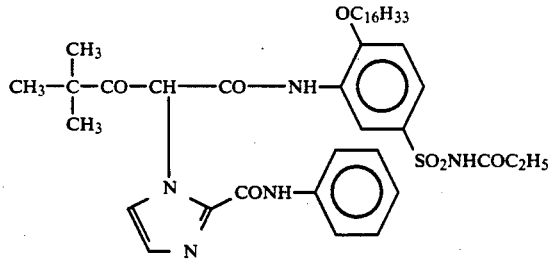

The couplers represented by the general formulae (C-1) to (Y) described supra are each normally incorporated in the silver halide emulsion layers constituting the light-sensitive layer in an amount of 0.1 to 1.0 mol, preferably 0.1 to 0.5 mol per mol of silver halide.

In the present invention, the incorporation of the above mentioned couplers in the light-sensitive layer can be accomplished by conventional method. These couplers can be normally incorporated in the light-sensitive layer by an oil-in-water dispersion process known as oil protect process. In particular, these couplers may be dissolved in a solvent, and then emulsion-dispersed in an aqueous solution of gelatin containing a surface active agent. Alternatively, water or an aqueous solution of gelatin may be incorporated in a coupler solution containing a surface active agent to cause phase inversion to prepare an oil-in-water dispersion. Furthermore, an alkali-soluble coupler may be dispersed by a so-called Fischer's dispersion process. Low boiling organic solvents may be removed from the coupler dispersion by distillation, noodle rinse or ultrafiltration, and then mixed with a photographic emulsion.

As such coupler dispersants there can be preferably used high boiling organic solvents and/or water-insoluble high molecular compounds having a dielectric constant (25° C.) of 2 to 20 and a refractive index (25° C.) of 1.5 to 1.7.

As high boiling organic solvents, preferably used solvents include high boiling organic solvents represented by the general formulae (AA) to (EE):

(AA)

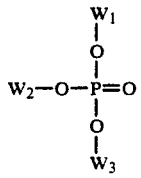

-continued $W_1-COO-W_2$ (BB)

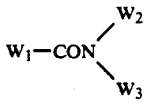
(CC)

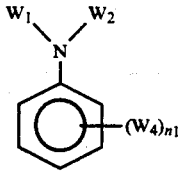
(DD)

$W_1-O-W_2$ (EE)

wherein $W_1$, $W_2$ and $W_3$ each represents a substituted or unsubstituted alkyl group, cycloalkyl group, alkenyl group, aryl group or heterocyclic group; $W_4$ represents $W_1$, $OW_1$ or $S-W_1$; and $n_1$ represents an integer 1 to 5. When $n_1$ is 2 or more, the plurality of $W_4$ may be the same or different. In the general formula (EE), $W_1$ and $W_2$ may together form a condensed ring.

Besides the high boiling organic solvents represented by the general formulae (AA) to (EE), compounds immiscible with water having a melting point of 100° C. or lower and a boiling point of 140° C. or higher can be used so long as they are good solvents for couplers. These high boiling organic solvents preferably exhibit a melting point of 80° C. or lower and a boiling point of 160° C. or higher, more preferably 170° C. or higher.

These high boiling organic solvents are further described in JP-A-62-215272, lower right column on page 137—upper right column on page 144.

These couplers can be absorbed by a loadable latex (as described in U.S. Pat. No. 4,203,716) in the presence or absence of the above mentioned high boiling organic solvent or dissolved in a water-insoluble and organic solvent-soluble polymer, and then emulsion-dispersed in an aqueous solution of hydrophilic colloid.

Single polymers or copolymers as described in International Patent Disclosure W088/00723, pp. 12 to 30, are preferably used. In particular, acrylamide polymers are preferred in the light of stabilization of dye images.

The light-sensitive material prepared according to the present invention may comprise as a color fog inhibitor a hydroquinone derivative, aminophenol derivative, gallic acid derivative, ascorbic acid derivative or the like.

The present light-sensitive material can comprise various discoloration inhibitors. Examples of organic discoloration inhibitors for cyan, magenta and/or yellow images include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines, and ether or ester derivatives obtained by silylating or alkylating the phenolic hydroxyl group of these compounds. Furthermore, metal complexes such as (bissalicylaldoximate)nickel complex and (bis-N,N-dialkyldithiocarbamate)nickel complex can be also used.

Specific examples of organic discoloration inhibitors are described in the following patent specifications recited infra.

Examples of hydroquinone inhibitors are described in U.S. Pat. Nos. 2,360,290, 2,418,613, 2,700,453, 2,701,197, 2,728,659, 2,732,300, 2,735,765, 3,982,944 and 4,430,425, 2,710,801, and 2,816,028, and British Patent 1,363,921, 6-Hydroxychromans, 5-hydroxycoumarans, and spirochromans are described in U.S. Pat. Nos. 3,432,300, 3,573,050, 3,574,627, 3,698,909, and 3,764,337, and JP-A-152225. Spiroindans are described in U.S. Pat. No. 4,360,589. p-Alkoxyphenols are described in U.S. Pat. No. 2,735,765, British Patent 2,066,975, JP-A-59-10539, and JP-B-57-19765. Hindered phenols are described in U.S. Pat. Nos. 3,700,455 and 4,228,235, JP-A-52-72224, and JP-B-52-6623. Gallic acid derivatives, methylenedioxybenzenes, and aminophenols are described in U.S. Pat. Nos. 3,457,079 and 4,332,886, and JP-B-56-21144. Hindered amines are described in U.S. Pat. Nos. 3,336,135 and 4,268,593, British Patents 1,326,889, 1,354,313, and 1,410,846, JP-B-51-1420, and JP-A-58-114036, JP-A-59-53846, and JP-A-59-78344. Metal complexes are described in U.S. Pat. Nos. 4,050,938 and 4,241,155, and British Patent 2,027,731 (A). These compounds can be emulsified with the corresponding color couplers in amounts of 5 to 100% by weight based on the color couplers, and then incorporated in the light-sensitive layer to accomplish the desired objects. In order to inhibit the deterioration of cyan dye images due to heat, particularly light, an ultraviolet absorbent can be effectively incorporated in the cyan coloring layer and opposing layers adjacent thereto.

As such ultraviolet absorbents there can be used benzotriazole compounds substituted by aryl group as described in U.S. Pat. No. 3,533,794, 4-thiazolidone compounds as described in U.S. Pat. Nos. 3,314,794 and 3,352,681, benzophenone compounds as described in JP-A-46-2784, cinnamic ester compounds as described in U.S. Pat. Nos. 3,705,805 and 3,707,395, butadiene compounds as described in U.S. Pat. No. 4,045,229, or benzoxidol compounds as described in U.S. Pat. Nos. 3,406,070, 3,677,672, and 4,271,307. Ultraviolet-absorbing couplers (e.g., α-naphtholic cyan dye-forming couplers) or ultraviolet-absorbing polymers can also be used. These ultraviolet absorbents may be mordanted.

In particular, the above mentioned benzotriazole compounds substituted by aryl group are preferably used.

The above mentioned couplers are preferably used in combination with compounds as described hereinafter, particularly pyrazoloazole couplers.

In particular, a compound (F) described infra which undergoes chemical bonding with an aromatic amine developing agent left after the color development to produce a chemically inert and substantially colorless compound and/or a compound (G) described infra which undergoes chemical bonding with an oxidation product of an aromatic color developing agent left after the color development to produce a chemically inert and substantially colorless compound are preferably used simultaneously or separately to inhibit stain or other side effects due to the production of developed dyes by the reaction of the remaining color developing agent or its oxidation product with a coupler during the storage after the processing.

As the compound (F) there can be preferably used a compound which undergoes a second-order reaction with p-anisidine at a rate $k_2$ (in trioctyl phosphate at 80° C.) of $1\times10^{-5}$ l/mol·sec to 1.0 l/mol·sec. The second-order reaction rate constant can be determined by a method as described in JP-A-63-158545.

If $k_2$ is greater than this range, the compound becomes unstable itself and thus can undergo reaction with gelatin or water, resulting in the decomposition thereof. On the other hand, if $k_2$ is smaller than this range, the compound reacts with the remaining aromatic amine developing agent too slowly to inhibit side effects of the remaining aromatic amine developing agent.

Preferred examples of the compound (F) can be represented by the general formula (FI) or (FII) below:

$$R_1-(A)_{n2}-X \quad \text{(FI)}$$

$$R_2-\underset{\underset{B}{|}}{C}=Y \quad \text{(FII)}$$

wherein $R_1$ and $R_2$ each represents an aliphatic group, aromatic group or heterocyclic group; $n_2$ represents an integer 0 or 1; A represents a group which reacts with an aromatic amine developing agent to form a chemical bond; X represents a group which reacts with an aromatic amine developing agent to release itself therefrom; B represents a hydrogen atom, aliphatic group, aromatic group, heterocyclic group, acyl group or sulfonyl group; and Y represents a group which accelerates the addition of an aromatic amine developing agent to a compound represented by the general formula (FII). $R_1$ and X, and Y and $R_2$ or B may be connected to each other to form a cyclic structure.

Typical examples of the reaction of chemical bonding of the compound to the remaining aromatic amine developing agent include substitution reaction and addition reaction.

Specific preferred examples of the compounds represented by the general formulae (FI) and (FII) are described in JP-A-63-158545 and JP-A-62-283338, and European Patent Disclosure 298321 and 277589.

On the other hand, preferred examples of the compound (G) which undergoes chemical bonding with an oxidation product of a color developing agent left after the color development to produce a chemically inert and substantially colorless compound can be represented by the general formula (GI):

$$R-Z \quad \text{(GI)}$$

wherein R represents an aliphatic group, aromatic group or heterocyclic group; and Z represents a nucleophilic group or a group which undergoes decomposition in a light-sensitive material to release a nucleophilic group. The compound represented by the general formula (GI) is preferably a group wherein Z exhibits a Pearson's nucleophilic $^{n}CH_3I$ value (R. G. Pearson, et al., J. Am. Chem. Soc., 90, 319 (1968)) of 5 or more or a group derived therefrom.

Specific preferred examples of the compound represented by the general formula (GI) are described in European Patent Disclosure 255722, 298321 and 277589, JP-A-62-143048, and JP-A-62-229145, and Japanese Patent Application Nos. 63-136724, and 62-214681.

The combination of the above mentioned compounds (G) and ( F) are further described in European Patent Disclosure 277589.

A hydrophilic colloid layer of the light-sensitive material prepared according to the present invention may contains a water-soluble dye or a dye which undergoes photographic processing to become water-soluble, as a filter dye or for the purpose of inhibiting irradiation or halation or other various purposes. Examples of such a dye include oxonol dye, hemioxonol dye, styryl dye, melocyanine dye, cyanine dye, and azo dye. Particularly useful among these dyes are oxonol dye, hemioxonol dye and melocyanine dye.

As binder or protective colloid to be incorporated in the emulsion layer in he present light-sensitive material there can be advantageously used gelatin. However, other hydrophilic colloids can be used, singly or in combination with gelatin.

In the present invention, as gelatin there can be used either lime-treated gelatin or acid-treated gelatin. The process for the preparation of gelatin is further described in Arthur Vice, "The Macromolecular Chemistry of Gelatin", Academic Press, 1964.

As a support to be used in the present invention there can be a transparent film such as cellulose nitrate film and polyethylene terephthalate commonly used in photographic light-sensitive materials or reflective support. For the objects of the present invention, reflective support materials are preferably used.

The term "reflective support" as used herein means a material which improves reflectivity to make dye images formed on the silver halide emulsion layer clear. Examples of such a reflective support include materials coated with a hydrophobic resin comprising a light reflecting substance such as titanium oxide, zinc oxide, calcium carbonate and calcium sulfate dispersed therein and materials comprising a hydrophobic resin comprising a light relfecting substance dispersed therein. Examples of such materials include baryta paper, polyethylene-coated paper, polypropylene synthetic paper, transparent support such as glass plate comprising a reflective layer or reflective substance, polyester film such as polyethylene terephthalate, cellulose triacetate and cellulose nitrate, polyamide film, polycarbonate film, polystyrene film, and vinyl chloride resin.

Other examples of reflective supports which can be used include supports having a metallic surface with mirror-like reflection or diffused reflection of the second kind. The metallic surface preferably has a spectral reflectance of 0.5 or more in the visible wavelength range. Alternatively, the metallic surface may be roughened or provided with metallic powder to exhibit diffused reflectivity. As the metal there can be used aluminum, tin, silver, magnesium or alloy thereof. The surface of the support may be a metal plate, metal foil or thin metal layer obtained by rolling, vacuum deposition or plating. In particular, a metal is preferably vacuum-deposited on other substrates to obtain such a metallic surface. On such a metallic surface is preferably provided a water-resistant resin layer, particularly a thermoplastic resin layer. On the surface opposite the metallic surface is preferably provided an antistatic layer. These supports are further described in JP-A-61-210346, JP-A-63-24247, JP-A-63-24251 and JP-A-63-24255.

These supports can be properly selected depending on the purpose of application.

As the light reflecting substance there can be used a white pigment which has been thoroughly kneaded in the presence of a surface active agent. The surface of the pigment is preferably treated with a divalent, trivalent or tetravalent alcohol before use.

The specified percentage area of .fine white pigment grains occupied per unit area can be most normally determined by dividing observed area into adjacent 6 μm×6 μm unit areas, and then measuring the percentage area of grains projected on the unit area (%) ($R_i$). The fluctuation of the percentage occupied area (%) can be determined by the ratio ($s/\overline{R}$) or the average ($\overline{R}$) of $R^i$ to the standard deviation s of $R_i$. The number (n) of unit areas to be measured is preferably 6 or more. Accordingly, $s/\overline{R}$ can be represented by the following equation:

$$\sqrt{\frac{\sum_{i=1}^{n}(Ri-\overline{R})^2}{n-1}} \Big/ \frac{\sum_{i=1}^{n} Ri}{n}$$

In the present invention, the fluctuation of the percentage occupied area (%) of fine pigment grains is preferably in the range of 0.15 or less, particularly 0.12 or less. When this fluctuation value is 0.08 or less, the grains can be said to have a substantially "uniform" dispersibility.

The color developing solution to be used in the development of the present light-sensitive material is preferably an alkaline aqueous solution containing as a main component an aromatic primary amine color developing agent. As such a color developing agent, an aminophenolic compound can be effectively used. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-N-β-methoxyethylaniline, and sulfates, hydrochlorides and p-toluenesulfonates thereof. These compounds can be used in a combination of two or more thereof depending on the purpose of application.

The color developing solution normally contains a pH buffer such as carbonate and phosphate of alkaline metal or a development inhibitor or fog inhibitor such as bromides, iodides, benzimidazoles, benzothiazoles and mercapto compounds. If desired, the color developing solution may further contain various preservatives, e.g., hydroxylamine, diethylhydroxylamine, hydrazines, such as N,N-biscarboxymethylhydrazine, sulfites, phenylsemicarbazides, triethanolamine, catecholsulfonic acids; organic solvents, e.g., ethylene glycol and diethylene glycol; development accelerators, e.g., benzyl alcohol, polyethylene glycol, quaternary ammonium salts, and amines; color-forming couplers; competing couplers; fogging agents, e.g., sodium boron hydride; auxiliary developing agents, e.g., 1-phenyl-3-pyrazolidone; viscosity-imparting agents; various chelating agents, and phosphonocarboxylic acids, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic ethylenediamine-N-N-N'-N'-tetramethylenephosphonic acid, and ethylenediamine-di(o-hydroxyphenylacetic acid), and salts thereof.

When reversal processing is used, black-and-white development and reversal processing are usually accompanied by color development. Black-and-white developing solutions to be used can contain one or more of known black-and-white developing agents, such as dihydroxybenzenes, e.g., hydroquinone; 3-pyrazolidones, e.g., 1-phenyl-3-pyrazolidone; and aminophenols, e.g., N-methyl-p-aminophenol.

The color developer or black-and-white developing solution usually has a pH of from 9 to 12. The replenishment rate of the developing solution is usually 3 l or less per $m^2$ of the light-sensitive material, though depending on the type of the color photographic material to be processed. The replenishment rate may be reduced to 500 ml/$m^2$ or less by decreasing the bromide ion concentration in the replenisher. When the replenishment rate is reduced, it is preferable to reduce the area of the liquid surface in contact with air in the processing tank to thereby prevent evaporation and air-oxidation of the liquid. The area of the liquid surface in contact with air can be represented by the opening value defined as follows:

Opening value = Area of liquid surface in contact with air ($cm^3$)/volume of liquid ($cm^3$)

The opening value is preferably in the range of 0.1 or less, more preferably 0.001 to 0.05.

The reduction of the opening value can be accomplished by providing a cover such as floating cover on the surface of a photographic processing solution in the processing tank, or by a process which comprises the use of a mobile cover as described in. Japanese Patent Application No. 62-241342, or a slit development process as described in JP-A-63-216050.

The reduction of the opening value can be applied not only to both the color development and black-and-white development but also to the subsequent steps such as bleach, blix, fixing, rinse and stabilization.

The replenishment rate can also be reduced by a means for suppressing accumulation of the bromide ion in the developing solution.

The color development time is normally selected for between 2 and 5 minutes. The color development time can be further reduced by carrying out color development at an elevated temperaure and a high pH value with a color developing solution containing a color developing agent in a high concentration.

The photographic emulsion layer which has been color-developed is normally subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of polyvalent metals, e.g., iron (III). Typical examples of these bleaching agents are organic complex salts with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc. Of these, aminopolycarboxylic acid-iron (III) complex salts such as (ethylenediaminetetraacetato(iron (III) complex salts are preferred in view of speeding up of processing and conservation of the environment. In particular, aminopolycarboxylic acid-iron (III) complex salts are useful in both of a bleaching solution and a blix solution. The bleaching or blix solution comprising such an aminopolycarboxylic acid-iron (III) complex salt normally has a pH value of 4.0 to 8.0. For speeding up of processing, it is possible to adopt a lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patent 1,290,812, JP-A-53-95630, and Research Disclosure No. 17129 (July 1978), thiazolidine derivatives as described in JP-A-50-140129, thiourea derivatives as described in U.S. Pat. No. 3,706,561, iodides as described in JP-A-58-16235, polyoxyethylene compounds as described in West German Patent 2,748,430, polyamine compounds as described in JP-B-45-8836, and bromine ions. Preferred among these compounds are compounds containing a mercapto group or disulfide group because of their great acceleratory effects. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for photographing.

Fixing agents to be used for fixation include thiosulfates, thiocyanates, thioethers, thioureas, and a large amount of iodides. The thiosulfates are normally used, with ammonium thiosulfate being applicable most broadly. Sulfites, bisulfites or carbonyl bisulfite adduct are suitably used as preservatives of the blix bath.

It is usual that the thus desilvered silver halide color photographic materials of the invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of washing water, the number of washing tanks (number of stages), the replenishment system (e.g., counter-flow system or direct-flow system), and other various factors. Of these factors, the relationship between the number of washing tanks and the quantity of water in a multistage counter-flow system can be obtained according to the method described in "Journal of the Society of Motion Picture and Television Engineers", vol. 64, pp. 248 to 253 (May 1955).

According to the multi-stage counter-flow system described in the above reference, although the requisite amount of water can be greatly reduced, bacteria would grow due to an increase of the retention time of water in the tank, and floating masses of bacteria stick to the light-sensitive material. In the present invention, in order to cope with this problem, the method of reducing calcium and magnesium ion concentrations described in Japanese Patent Application No. 61-131632 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku", Eisei Gijutsu Gakkai (ed.), "Biseibutsu no mekkin, sakkin, bobigijutsu", and Nippon Bokin Bobi Gakkai (ed.), "Bokin bobizai jiten".

The washing water has a pH value of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 40° C. in temperature and from 30 seconds to 5 minutes in time. The light-sensitive material of the invention may be directly processed with a stabilizer in place of the washing step. For the stabilization, any of the known techniques as described in JP-A-57-8543, JP-A-58-14834, and JP-A-60-220345 can be used.

The aforesaid washing step may be followed by stabilization in some cases. For example, a stabilizing bath containing formalin and a surface active agent as is used as a final bath or color light-sensitive materials for photographing is the case. The stabilizing bath may also contain various chelating agents or antifrengal agents.

The overflow accompanying replenishment of the washing bath and/or stabilizing bath can be reused in other steps such as desilvering.

The present silver halide color light-sensitive material may contain a color developing agent for the purpose of simplifying and expediting processing. Such a color developing agent is preferably used in the form of various precursors. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The present silver halide color light-sensitive material may optionally comprise various 1-phenyl-3-pyrazolidones for the purpose of accelerating color development. Typical examples of such compounds are described in JP-A-56-64339, JP-A-57-144547, and JP-A-58-115438.

In the present invention, the various processing solutions are used at a temperature of 10° C. to 50° C. The standard temperature range is normally from 33° C. to 38° C. However, a higher temperature range can be used to accelerate processing, thus, reducing the processing time. Alternatively, a lower temperature range can be used to improve the picture quality or the stability of the processing solutions. In order to save silver, a processing using cobalt intensification or hydrogen peroxide intensification as described in West German Patent 2,226,770 and U.S. Pat. No. 3,674,499 can be effectively used.

In the present inventive process, if the silver halide grains to be used have a high silver chloride content, a developing solution substantially free of benzyl alcohol is preferably used. The term "developing solution substantially free of benzyl alcohol" as used herein means a developing solution preferably containing 2 ml/l or less, more preferably 0.5 ml/l or less, most preferably none of benzyl alcohol.

The developing solution to be used for a high silver chloride content emulsion preferably is substantially free of sulfurous acid ions. Sulfurous acid ions serve as preservatives for developing agent but also have the effects of dissolving silver halide and reacting with an oxidation product of a developing agent to reduce the efficiency of dye formation. Such an effect is considered to be one of the causes for the increase in the fluctuation of photographic properties involved in the continuous processing. The term "developing solution substantially free of sulfurous acid ions" as used herein means a developing solution preferably containing $3.0\times10^{-3}$ mol/l or less, most preferably no sulfurous acid ions. In the present invention, an extremely small amount of sulfurous acid ions is excluded as conventionally used to inhibit the oxidation of a processing agent kit containing concentrated developing agents which is to be diluted for use.

Furthermore, the developing solution to be used for high silver chloride content emulsion preferably is substantially free of hydroxylamine. This is because the hydroxylamine ostensibly serves as a preservative for developing solution, but itself has a silver development activity which causes a fluctuation in the concentration of hydroxylamine that greatly affects the photographic properties. The term "developing solution substantially free of hydroxylamine" as used herein means a developing solution preferably containing $5.0\times10^{-3}$ mol/l or less, most preferably no hydroxylamine.

More preferably, the developing solution to be used in the present invention contains a substitute organic preservative used in place of the above described hydroxylamine or sulfurous acid ions.

The term "organic preservative" as used herein means an organic compound which reduces the rate of deterioration of an aromatic primary amine color developing agent when incorporated in a color photographic light-sensitive material, i.e., organic compound which serves to inhibit the oxidation of a color developing agent by air. Particularly effective examples of such organic preservatives include hydroxylamine derivatives (hereinafter excluding hydroxylamine), hydroxamic acids, hydrazines, hydrazides, phenols, α-hydroxyketones, α-aminokentones, saccharides, monoamines, diamines, polyamines, quaternary ammonium salts, nitroxy radicals, alcohols, oxims, diamide compounds, and condensed amines. These organic preservatives are disclosed in JP-A-63-4235, JP-A-63-30843, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, and JP-A-52-143020, U.S. Pat. Nos. 3,615,503, and 2,494,903, and JP-B-48-30496.

As other useful preservatives, there can be optionally in the developing solution various metals as described in ,JP-A-57-44148 and JP-A-57-53749, salicylic acids as described in JP-A-59-180588, alkanolamines as described in JP-A-54-3532, polyethyleneimines as described in JP-A-56-94349, and aromatic polyhydroxy compounds as described in U.S. Pat. No. 3,746,544. In particular, alkanolamines such as triethanolamine, dialkylhydroxylamine such as diethylhydroxylamine, hydrazine derivatives or aromatic polyhydroxy compounds are preferably used.

Particularly preferred among the above mentioned organic preservatives are hydroxylamine derivatives and hydrazine derivatives (e.g., hydrazines, hydrazides). These organic preservatives are further described in Japanese Patent Application Nos. 62-255270, 63-9713, 63-9714, and 63-11300.

The above mentioned hydroxylamine derivatives or hydrazine derivatives are preferably used in combination with amines to improve the stability of the color developing solution and hence the stability during the continuous processing.

Examples of the above mentioned amines include cyclic amines as described in JP-A-63-239447, amines as described in JP-A-63-128340, and amines as described in Japanese Patent Application No. 63-9713 and 63-11300.

In the case where a high silver chloride content emulsion is employed, the color developing solution preferably contains chlorine ions in an amount of $3.5\times10^{-2}$ to $1.5\times10^{-1}$ mol/l, particularly $4\times10^{-2}$ to $1\times10^{-1}$ mol/l. If the concentration of chlorine ions exceeds $1.5\times10^{-1}$ mol/l, it is disadvantageous in that it retards development, making it difficult to accomplish the present object of providing a high maximum density in a rapid processing. On the other hand, if the concentration of chloride ions is less than $3.5\times10^{-2}$ mol/l, it is disadvantageous in the inhibition of fog.

In the case where a high silver chloride content emulsion is employed, the color developing solution preferably contains bromine ions in an amount of $3.0\times10^{-5}$ mol/l to $1.0\times10^{-3}$ mol/l, more preferably $5.0\times10^{-5}$ mol/l to $5\times10^{-4}$ mol/l. If the bromine ion concentration exceeds $1\times10^{-3}$ mol/l, it retards development, reducing the maximum density and the sensitivity. If the bromine ion concentration is less than $3.0\times10^{-5}$ mol/l, it is inadequate in the inhibition of fog.

The chlorine and bromine ions can be directly incorporated in the developing solution or eluted from the light-sensitive material into the developing solution during development.

If these ions are directly incorporated in the color developing solution, then suitable examples of chlorine ion-donative substance include sodium chloride, potassium chloride, ammonium chloride, lithium chloride, nickel chloride, magnesium chloride, manganese chloride, calcium chloride, and cadmium chloride. Preferred among these chlorine ion-donative substances are sodium chloride and potassium chloride.

Alteternatively, chlorine ions may be supplied from a fluorescent brightening agent incorporated in the developing solution.

Examples of such suitable bromine ion-donative substances include sodium bromide, potassium bromide, ammonium bromide, lithium bromide, calcium bromide, magnesium bromide, manganese bromide, nickel bromide, cadmium bromide, cerium bromide, and thallium bromide. Preferred among these bromine ion-donative substances are potassium bromide, and sodium bromide.

If the chloride and bromine ions are eluted from the light-sensitive material during development, these ions may be supplied together from the emulsion or other sources.

The color developing solution to be used in the present invention preferably has a pH value of 9 to 12, preferably 9 to 11.0. The color developing solution may further contain other conventionally recognized compounds known as components for a developing solution.

In order to maintain the above described pH range, it is preferable to use various buffer agents. Examples of buffer agents which can be used in the present invention include carbonates, phosphates, borates, tetraborates, hydroxybenzoates, glycyl salts, N,N-dimethylglycyl salts, leucine salts, norleucine salts, guanine salts, 3,4-dihydroxyphenylaranine salts, aranine salts, aminobutyrates, 2-amino-2-methy-1,3-propanediol salts, valine salts, proline salts, trishydroxyaminomethane salts, and lysine salts. In particular, carbonates, phosphates, tetraborates, and hydroxybenzoates are advantageous in that they are excellent in solubility and buffering action in a high pH range as 9.0 or more, have no adverse effects (e.g., fog) on the photographic properties even when incorporated in the color developing solution and are inexpensive. Thus, these latter-mentioned buffer agents are preferably used.

Specific examples of these buffer agents include sodium carbonate, potassium carbonate, sodium bicarbonate, potassium bicarbonate, trisodium phosphate, tripotassium phosphate, disodium phosphate, dipotassium phosphate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate, and potassium 5-sulfo-2-hydroxybenzoate (potassium 5-sulfosalicaylate). However, the present invention should not be construed as being limited to these compounds.

The amount of such a buffer or buffer agent to be incorporated in the color developing solution is preferably in the range of 0.1 mol/l or more, particularly 0.1 mol/l to 0.4 mol/l.

Furthermore, the color developing solution may comprise various chelating agents effective as calcium or magnesium precipitation inhibitors or for the purpose of improving the stability of the color developing solution. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycoletherdiaminetetraacetic acid, ethylenediamineorthohydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

These chelating agents may be used in combinations thereof as necessary.

Such a chelating agent may be incorporated in the color developing agent in such an amount that it blocks metallic ions in the color developing solution. For example, such a chelating agent is incorporated in an amount of 0.1 g to 10 g/l.

The color developing solution may contain any of development accelerators as neccesary.

Examples of development accelerators which can be incorporated in the color developing solution as necessary include thioether compounds as disclosed in JP-B-37-16088, JP-B-37-5987, JP-B-38-7826, JP-B-44-12380, and JP-B-45-9019, and U.S. Pat. No. 3,813,247, p-phenylenediamine compounds as disclosed in JP-A-52-49829 and JP-A-50-15554, quaternary ammonium salts as disclosed in JP-A-50-137726, JP-A-56-156826, and JP-A-52-43429, and JP-B-44-30074, amine compounds as disclosed in U.S. Pat. Nos. 2,494,903, 3,128,182, 4,230,796, 3,254,919, 2,482,546, 2,596,926, and 3,582,346, and JP-B-41-11431, polyalkylene oxides as disclosed in JP-B-37-16088, JP-B-42-25201, JP-B-41-11431, and JP-B-42-23883, and U.S. Pat. Nos. 3,128,183, and 3,532,501, 1-phenyl-3-pyrazolidones, and imidazoles.

In the present invention, any fog inhibitors can be incorporated as necessary. Examples of fog inhibitors which can be used include halides of alkaline metals such as sodium chloride, potassium bromide, and potassium iodide, and organic fog inhibitors. Typical examples of such an organic fog inhibitors include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolyl-methylbenzimidazole, indazole, hydroxyazaindolidine, and adenine.

The color developing solution which can be applied to the present invention preferably contains a fluorescent brightening agent. As such a fluorescent brightening agent there can be preferably used a 4,4'-diamino-2,2'-disulfostilbene compound. The amount of the fluorescent brightening agent to be incorporated is in the range of 0 to 5 g/l, preferably 0.1 g to 4 g/l.

If desired, various surface active agents such as alkylsulfonic acid, arylsulfonic acid, aliphatic carboxylic acid, and aromatic carboxylic acid may be incorporated in the color developing solution.

The color developing solution which can be applied to the present invention is preferably used at a temperature of 20° to 50° C., preferably 30° to 40° C. The processing time is preferably in the range of 20 seconds to 5 minutes, preferably 30 seconds to 2 minutes. The replenishment rate is preferably small, suitably 20 to 600 ml, preferably 50 to 300 ml, more preferably 60 ml to 200 ml, most preferably 60 ml to 150 ml per $m^2$ of light-sensitive material.

The present invention will be further described in the following examples, but the present invention should not be construed as being limited thereto.

EXAMPLE 1

A multilayer color photographic paper was prepared by coating layers having the following structures on a paper support laminated with polyethylene on both sides thereof. The coating solutions were prepared as follows:

Preparation of coating solution for 1st layer 19.1 g of a yellow coupler (ExY), 4.4 g of a dye image stabilizer (Cpd-1) and 1.8 g of a dye image stabilizer (Cpd-7) were dissolved in 27.2 cc of ethyl acetate, 4.1 g of a solvent (Solv-3) and 4.1 g of a solvent (Solv-6). The solution thus obtained was then emulsion-dispersed in 185 cc of a 10% aqueous solution of gelatin containing 8 cc of 10% sodium dodecylbenzenesulfonate. Meanwhile, a blue-sensitive sensitizing dye (Dye-1) and an infrared-sensitive sensitizing dye (Dye-5) represented by the following general formulae were added to a silver bromochloride emulsion (1:3 (Ag molar ratio) mixture of cubic silver bromide grains having a silver bromide content of 80.0 mol %, a mean grain size of 0.85 μm and a grain size fluctuation coefficient of 0.08 and cubic silver bromide grains having a silver bromide content of 80.0%, a mean grain size of 0.62 μm and a grain size fluctuation coefficient of 0.07) which had been sulfur-sensitized in amounts of $5.0\times10^{-4}$ mol and $5.0\times10^{-5}$ mol per mol of silver, respectively. The above mentioned emulsion dispersion and the emulsion thus prepared were then mixed and dissolved to prepare a coating solution for the 1st layer having the following composition.

Coating solutions for the 2nd layer to the 7th layer relative to the support were prepared in the same manner as in the above 1st layer relative to the support. As gelatin hardener for each layer there was used 1-oxy-3,5-dichloro-s-triazine sodium salt.

As spectral sensitizing dyes for each layer there were used the following compounds:

Yellow coloring emulsion layer (Dye-1)

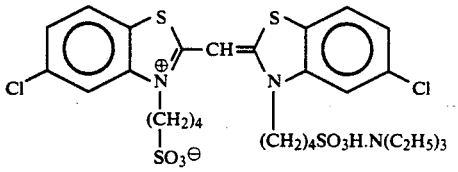

($5.0 \times 10^{-4}$ mol per mol of silver halide)

(Dye-5)

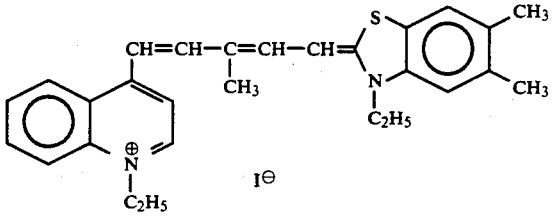

($5.0 \times 10^{-5}$ mol per mol of silver halide)

Magenta coloring emulsion layer (Dye-2)

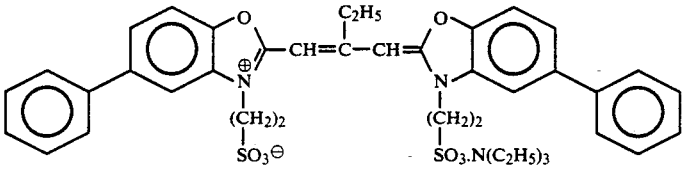

($4.0 \times 10^{-4}$ mol per mol of silver halide)

(Dye-3)

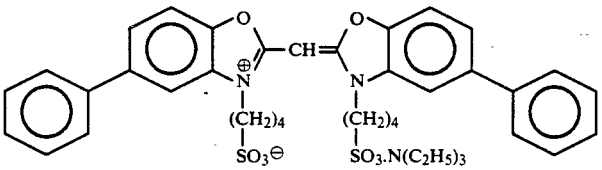

($7.0 \times 10^{-5}$ mol per mol of silver halide)

(Dye-6)

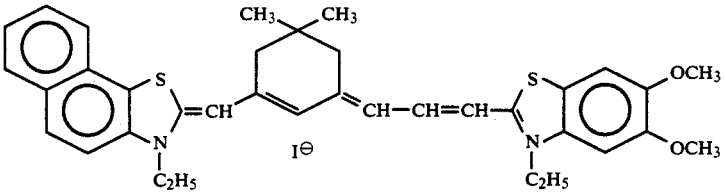

($0.5 \times 10^{-5}$ mol per mol of silver halide)

Cyan coloring emulsion layer (Dye-4)

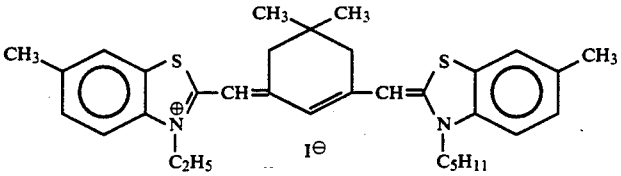

($0.9 \times 10^{-4}$ mol per mol of silver halide)

For the cyan coloring emulsion layer (5th layer) and the magenta coloring emulsion (3rd layer), the following compound was incorporated in an amount of $2.6 \times 10^{-3}$ mol per mol or silver halide.

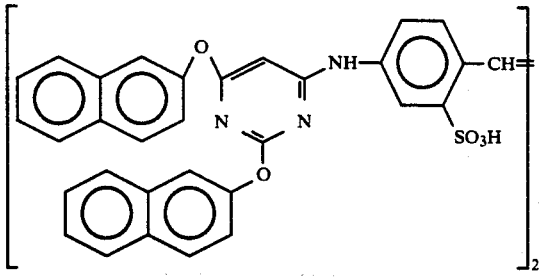

For the yellow coloring emulsion layer (1st layer), the magenta coloring emulsion layer (3rd layer) and the cyan coloring emulsion layer (5th layer), 1-(5-methylureiodephenyl)-5-mercaptotetrazole was incorporated in amounts of $4.0\times10^{-6}$ mol, $3.0\times10^{-5}$ mol and $1.0\times10^{-5}$ mol per mol of silver halide, respectively, and 2-methyl-5-t-octylhydroquinone was incorporated in amounts of $8\times10^{-3}$ mol, $2\times10^{-2}$ mol and $2\times10^{-2}$ mol per mol of silver halide, respectively.

For the yellow coloring layer and the magenta coloring layer, 4-hydroxy-6-methyl-1,3,3a-7-tetrazaindene was incorporated in amounts of $1.2\times10^{-2}$ mol and $1.1\times10^{-2}$ mol per mol of silver halide, respectively.

For the magenta-sensitive emulsion layer, the following mercaptoimidazoles were incorporated in amounts of $2\times10^{-4}$ mol per mol of silver halide, respectively, and the following mercaptothiadiazoles were incorporated in amounts of $4\times10^{-4}$ mol per mol of silver halide.

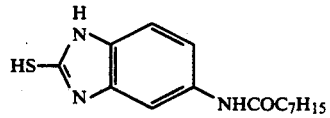

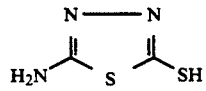

In order to inhibit irradiation, the following dyes were incorporated in the emulsion layers.

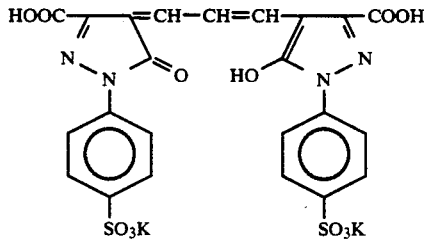

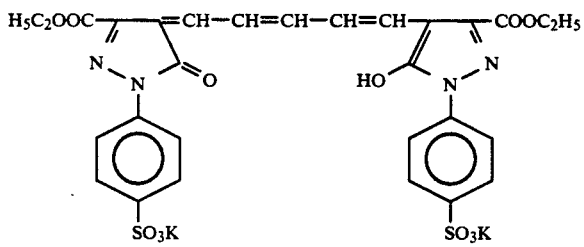

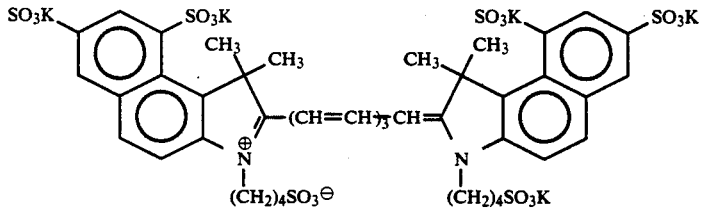

Layer structure

The composition of each layer will be set forth below. The coated amount of each component is represented in g/m². The coated amount of silver halide emulsion is represented as calculated in terms of g/m² silver.

Support:

Polyethylene-laminated paper [containing a white pigment ($TiO_2$) and a bluing dye (ultramarine) in the polyethylene layer on the side to be coated with the 1st layer]

1st Layer (Yellow coloring layer):

| | |
|---|---|
| Silver bromochloride emulsion as described above (AgBr: 80 mol %) | 0.26 |
| Gelatin | 1.83 |
| Yellow coupler (ExY) | 0.83 |
| Dye image stabilizer (Cpd-1) | 0.19 |
| Dye image stabilizer (Cpd-7) | 0.08 |
| Solvent (Solv-3) | 0.18 |
| Solvent (Solv-6) | 0.18 |

-continued

| | |
|---|---|
| 2nd Layer (Color stain inhibiting layer): | |
| Gelatin | 0.99 |
| Color mixing inhibitor (Cpd-5) | 0.08 |
| Solvent (Solv-1) | 0.16 |
| Solvent (Solv-4) | 0.08 |
| 3rd Layer (Magenta coloring layer): | |
| Silver bromochloride emulsion (1:1 mixture (Ag molar ratio) of cubic silver bromochloride grains having AgBr content of 90 mol %, mean grain size of 0.47 μm and grain size fluctuation coefficient of 0.12 and cubic silver bromochloride grains having AgBr content of 90 mol %, mean grain size of 0.36 μm and grain size fluctuation coefficient of 0.09) | 0.16 |
| Gelatin | 1.79 |
| Magenta coupler (ExM) | 0.32 |
| Dye image stabilizer (Cpd-2) | 0.02 |
| Dye image stabilizer (Cpd-3) | 0.20 |
| Dye image stabilizer (Cpd-4) | 0.01 |
| Cye image stabilizer (Cpd-8) | 0.03 |
| Dye image stabilizer (Cpd-9) | 0.04 |
| Solvent (Solv-2) | 0.65 |
| 4th Layer (Ultraviolet-absorbing layer): | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| 5th Layer (Cyan coloring layer): | |
| Silver bromochloride emulsion (1:2 mixture (Ag molar ratio) of cubic silver bromochloride grains having AgBr content of 70 mol %, mean grain size of 0.49 μm and grain size fluctuation coefficient of 0.08 and cubic silver bromochloride grains having AgBr content of 70 mol %, mean grain size of 0.34 μm and grain size fluctuation coefficient of 0.10) | 0.23 |
| Gelatin | 1.34 |
| Cyan coupler (ExC) | 0.30 |
| Dye image stabilizer (Cpd-6) | 0.17 |
| Dye image stabilizer (Cpd-7) | 0.40 |
| Solvent (Solv-6) | 0.20 |
| 6th Layer (Ultraviolet absorbing layer): | |
| Gelatin | 0.53 |
| Ultraviolet absorbent (UV-1) | 0.16 |
| Color stain inhibitor (Cpd-5) | 0.02 |
| Solvent (Solv-5) | 0.08 |
| 7th Layer (Protective layer): | |
| Gelatin | 1.33 |
| Acryl-modified copolymer of polyvinyl alcohol (modification degree: 17%) | 0.17 |
| Liquid paraffin | 0.03 |

Dye image stabilizer (Cpd-1)

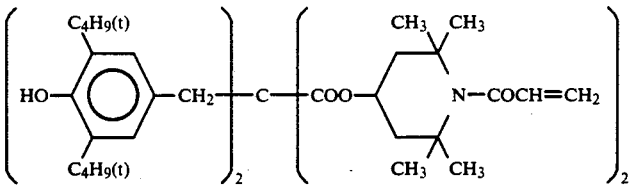

Dye image stabilizer (Cpd-2)

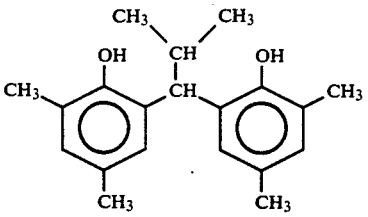

Dye image stabilizer (Cpd-3)

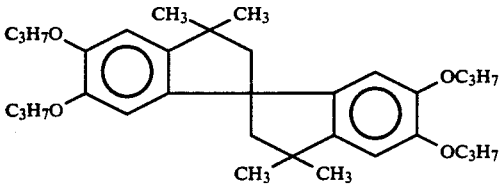

Dye image stabilizer (Cpd-4)

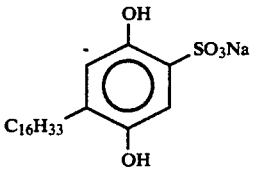

Color mixing inhibitor (Cpd-5)

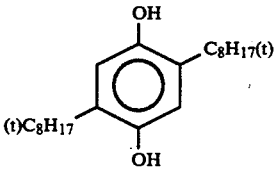

Dye image stabilizer (Cpd-6)
2:4:4 mixture (weight ratio of:

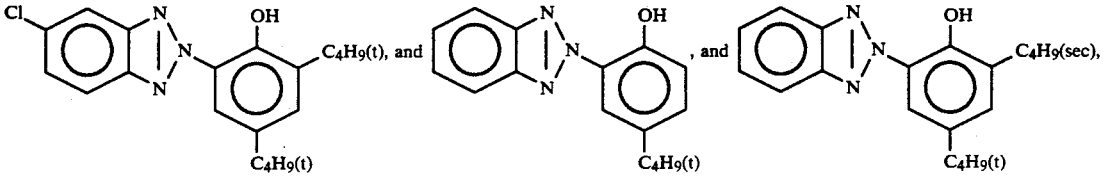

respectively.

-continued

Dye image stabilizer (Cpd-7)

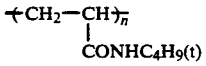

Mean molecular weight: 80,000

Dye image stabilizer (Cpd-8)

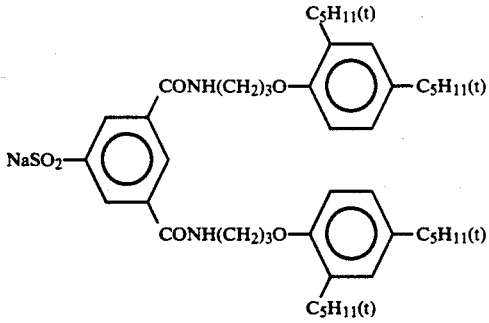

Dye image stabilizer (Cpd-9)

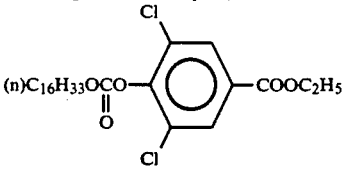

Ultraviolet absorbent (UV-1)
4:2:4 mixture (weight ratio) of:

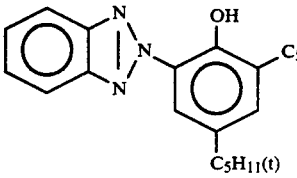

and

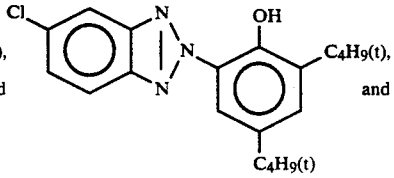

and

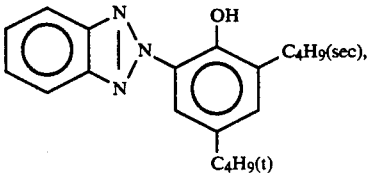

respectively.

Solvent (Solv-1)

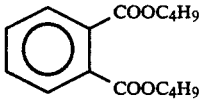

Solvent (Solv-2)
2:1 mixture (weight ratio of:

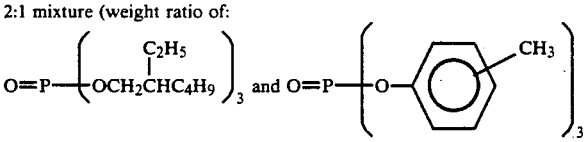

, respectively.

Solvent (Solv-3)

$O{=}P{\leftarrow}O{-}C_9H_{19}(iso))_3$

Solvent (Solv-4)

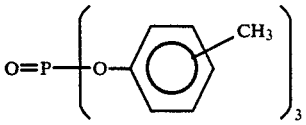

Solvent (Solv-5)

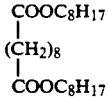

Solvent (Solv-6)

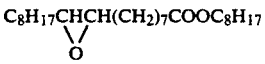

Yellow coupler (ExY)
1:1 mixture (molar ratio) of:

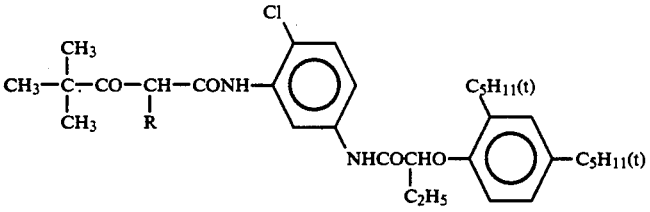

wherein R represents

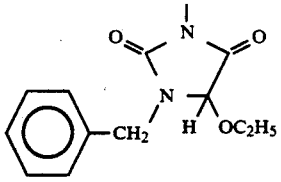

and the same compound except wherein R represents

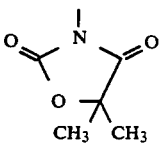

Magenta coupler (ExM)
1:1 mixture (molar ratio) of:

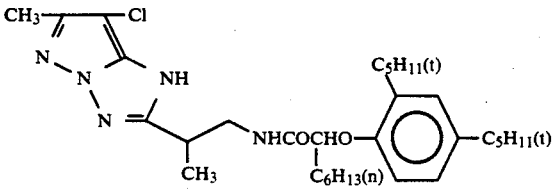

and

-continued

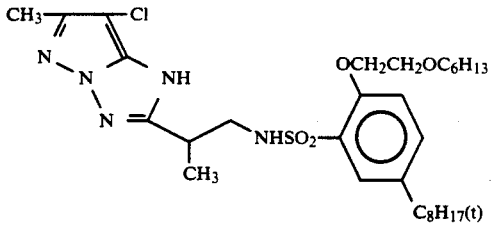

Cyan coupler (ExC):
1:1 mixture (molar ratio) of:

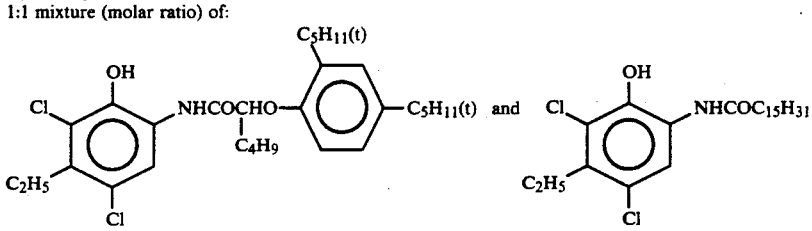

In the light-sensitive material thus prepared, the yellow coloring layer had a maximum spectral sensitivity at 480 nm and 780 nm, the magenta coloring layer had a maximum spectral sensitivity at 550 nm and 845 nm, and the cyan coloring layer had a maximum spectral sensitivity at 710 nm.

An automatic color negative printer and a laser exposure apparatus as described in Japanese Patent Application No. 63-226552 (semiconductor laser wavelength: 670 nm, 780 nm, 830 nm) were combined to assemble an exposure apparatus. The light-sensitive material specimen was then imagewise exposed to light through a color negative. Color letters and illustration were input to the same picture by means of the semiconductor laser exposure apparatus.

The specimen thus exposed was then processed with processing solutions having the following compositions in the following steps by means of an automatic developing machine.

| Processing step | Temperature | Time |
|---|---|---|
| Color development | 37° C. | 3 min. 30 sec. |
| Blix | 33° C. | 1 min. 30 sec, |
| Rinse | 24 to 34° C. | 3 min. |
| Drying | 70 to 80° C. | 1 min. |

| Color developing solution | |
|---|---|
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-ethyl-N-(α-methanesulfonamidoethyl)-3-methyl-4-aminoaniline sulfate | 4.5 g |
| Hydroxylamine sulfate | 3.0 g |
| Fluorescent brightening agent (WHITEX 4B, available from Sumitomo Chemical Co., Ltd.) | 1.0 g |
| Water to make | 1,000 ml |
| pH (25° C.) | 10.25 |
| **Blix solution** | |
| Water | 400 ml |
| Ammonium thiosulfate (700 g/l) | 150 ml |
| Sodium sulfite | 18 g |

-continued

| | |
|---|---|
| Ferric ammonium ethylenediaminetetraacetate | 55 g |
| Disodium ethylenediaminetetraacetate | 5 g |
| Water to make | 1,000 ml |
| pH (25° C.) | 6.70 |

The print thus obtained exhibited an excellent picture quality. Furthermore, color letters and illustration, which had heretofore never been able to be written on the same picture as color print, could be written on the print. This could be accomplished quite easily as compared to the conventional process for the preparation of post cards.

EXAMPLE 2

A multilayer color photographic paper was prepared by coating layers having the following structures on a paper support laminated with polyethylene on both sides thereof. The coating solutions were prepared as follows:

Preparation of coating solution for 1st layer 19.1 g of the yellow coupler (ExY'), 4.4 g of the dye image stabilizer (Cpd-1') and 0.7 g of the dye image stabilizer (Cpd-7') were dissolved in 27.2 cc of ethyl acetate and 8.2 g of the solvent (Solv-1'). The solution thus obtained was then emulsion-dispersed in 185 cc of a 10% aqueous solution of gelatin containing 8 cc of 10% sodium dodecylbenzenesulfonate. Meanwhile, blue-sensitive sensitizing dyes (Dye-1', Dye-2') represented by the following general formulae were added to a silver bromochloride emulsion (3:7 (Ag molar ratio) mixture of cubic silver bromide grains comprising 0.2 mol % of silver bromide localized thereon, a mean grain size of 0.88 μm and a grain size fluctuation coefficient of 0.08 and cubic silver bromide grains comprising 0.2 mol % of silver bromide localized thereon, a mean grain size of 0.70 μm and a grain size fluctuation coefficient of 0.10) in amounts of $2.0\times10^{-4}$ mol per mol of silver for large size grains and $2.5\times10^{-4}$ mol per mol of silver for small size grains, respectively. The emulsion was then sulfur-sensitized. The above mentioned emulsion dispersion and the emulsion thus prepared were then mixed and dissolved to prepare a coating solution for the 1st layer having the following composition.

Coating solutions for the 2nd layer to the 11th layer were prepared in the same manner as in the 1st layer. As gelatin hardener for each layer there was used 1-oxy-3,5-dichloro-s-triazine sodium salt.

As spectral sensitizing dyes for each layer there were used the following compounds:

1st Layer (Blue-sensitive yellow coloring layer):
(Dye-1')

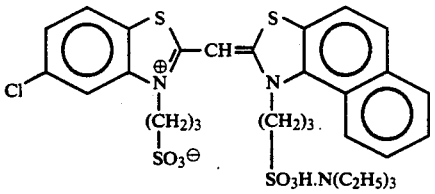

($2.0 \times 10^{-4}$ mol per mol of silver halide for large size grains and $2.5 \times 10^{-4}$ mol per mol of silver halide for small size grains)

(Dye-2')

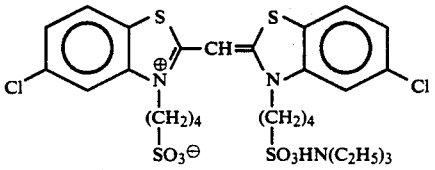

($2.0 \times 10^{-4}$ mol per mol of silver halide for large size grains and $2.5 \times 10^{-4}$ mol per mol of silver halide for small size grains)

3rd Layer (Infrared sensitive yellow coloring layer):
(Dye-3')

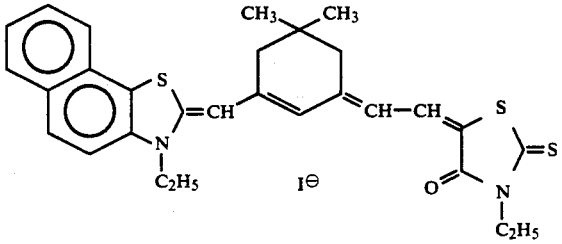

($1.0 \times 10^{-5}$ mol per mol of silver for both large size grains and small size grains)

5th Layer (Green-sensitive magenta coloring layer):
(Dye-4')

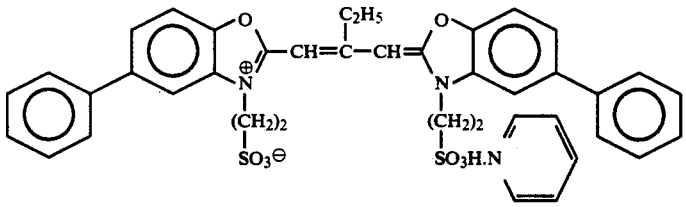

($4.0 \times 10^{-4}$ mol per mol of silver halide for large size grains and $5.6 \times 10^{-4}$ mol per mol of silver halide for small size grains)

and (Dye-5')

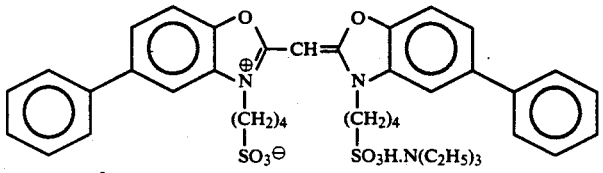

($7.0 \times 10^{-5}$ mol per mol of silver halide for large size grains and $1.0 \times 10^{-5}$ mol per mol of silver halide for small size grains)

7th Layer (Red sensitive magenta coloring layer):
(Dye-6')

-continued

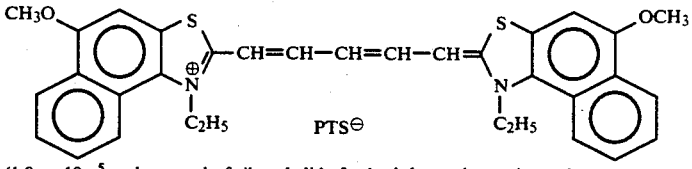

(1.0 × $10^{-5}$ mol per mol of silver halide for both large size grains and small size grains)

(Dye-7')

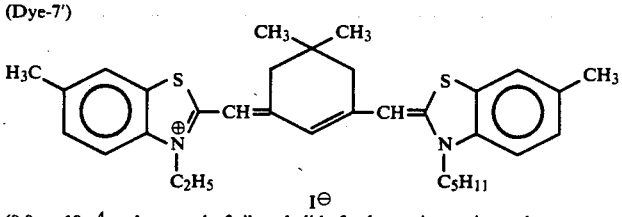

(0.9 × $10^{-4}$ mol per mol of silver halide for large size grains and 1.1 × $10^{-4}$ mol per mol of silver halide for small size grains)

For the 3rd layer (infrared-sensitive yellow coloring layer), the 7th layer (infrared-sensitive magenta coloring layer) and the 9th layer (infrared-sensitive cyan coloring layer), the following compound was incorporated in amounts of $1.9\times10^{-3}$ mol, $2.0\times10^{-3}$ mol and $2.6\times10^{-3}$ mol per mol of silver halide, respectively.

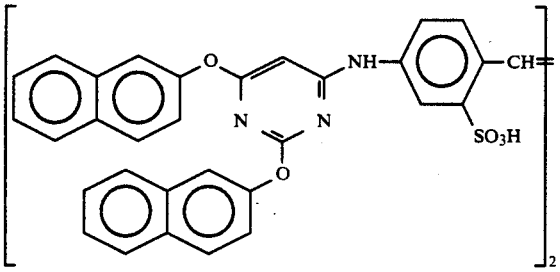

For the yellow coloring emulsion layer (1st layer, 3rd layer), the magenta coloring emulsion layer (5th layer, 7th layer) and the cyan coloring emulsion layer (9th layer), 1-(5-methylureidophenyl)-5-mercaptotetrazole was incorporated in amounts of $8.5\times10^{-5}$ mol, $7.7\times10^{-4}$ mol and $2.5\times10^{-4}$ mol per mol of silver halide, respectively.

In the yellow, magenta and cyan coloring light-sensitive emulsions were incorporated 4-hydroxy-6-methyl-1,3,3a,7-tetrazaindene in amounts of $1.5\times10^{-4}$ mol per mol of silver halide, respectively.

In order to inhibit irradiation, the following dyes were incorporated in the emulsion layers.

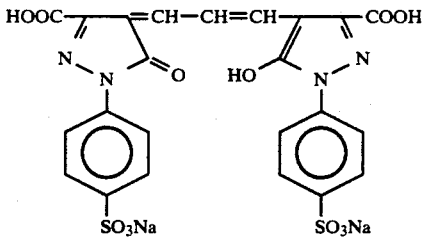

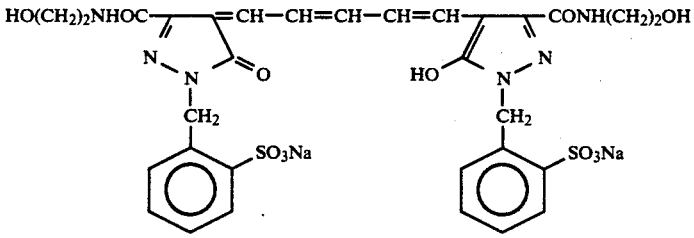

and

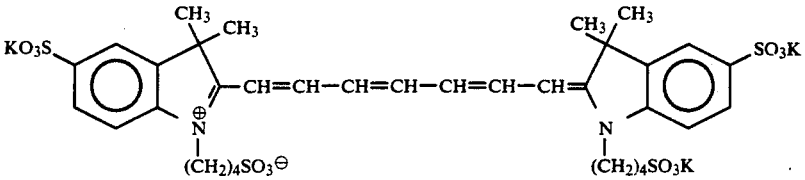

Layer structure

The composition of each layer will be set forth below. The coated amount of each component is represented in g/m$^2$. The coated amount of silver halide emulsion is represented as calculated in terms of g/m$^2$ silver.

| | |
|---|---|
| Support: | |
| Polyethylene-laminated paper [containing a white pigment ($TiO_2$) and a bluing dye (ultramarine) in the polyethylene layer on the side to be coated with the 1st layer] | |
| 1st Layer (Yellow coloring layer): | |
| Silver bromochloride emulsion as described above | 0.30 |
| Gelatin | 1.86 |
| Yellow coupler (ExY') | 0.82 |
| Dye image stabilizer (Cpd-1') | 0.19 |
| Solvent (Solv-1') | 0.35 |
| Dye image stabilizer (Cpd-7') | 0.06 |
| 2nd Layer (Color stain inhibiting layer): | |
| Gelatin | 0.99 |
| Color stain inhibitor (Cpd-5') | 0.08 |
| Solvent (Solv-1') | 0.16 |
| Solvent (Solv-4') | 0.08 |
| 3rd Layer (Infrared-sensitive yellow coloring layer): | |
| Silver bromochloride emulsion (1:4 (Ag molar ratio) of cubic silver bromochloride grains comprising 0.6 mol % AgBr localized thereon and having mean grain size of 0.58 μm and grain size fluctuation coefficient of 0.09 and cubic silver bromochloride grains comprising 0.6 mol % AgBr localized thereon and having mean grain size of 0.45 μm and grain size fluctuation coefficient of 0.11) | 0.30 |
| Gelatin | 1.86 |
| Yellow coupler (ExY') | 0.82 |
| Dye image stabilizer (Cpd-1') | 0.19 |
| Solvent (Solv-1') | 0.35 |
| Dye image stabilizer (Cpd-7') | 0.06 |
| 4th Layer (Color stain inhibiting layer): | |
| Gelatin | 0.99 |
| Color mixing inhibitor (Cpd-5') | 0.08 |
| Solvent (Solv-1') | 0.16 |
| Solvent (Solv-4') | 0.08 |
| 5th Layer (Green-sensitive magenta coloring layer): | |
| Silver bromochloride emulsion (1:3 mixture (Ag molar ratio) of cubic silver bromochloride grains comprising 0.8 mol % AgBr localized thereon and having mean grain size of 0.55 μm and grain size fluctuation coefficient of 0.10 and cubic silver bromochloride grains comprising 0.8 mol % AgBr localized thereon and having mean grain size of 0.39 μm and grain size fluctuation coefficient of 0.08) | 0.12 |
| Gelatin | 1.24 |
| Magenta coupler (ExM') | 0.20 |
| Dye image stabilizer (Cpd-2') | 0.03 |
| Dye image stabilizer (Cpd-3') | 0.15 |
| Dye image stabilizer (Cpd-4') | 0.02 |
| Dye image stabilizer (Cpd-9') | 0.02 |
| Solvent (Solv-2') | 0.40 |
| 6th Layer (Color stain inhibiting layer): | |
| Gelatin | 0.99 |
| Color mixing inhibitor (Cpd-5') | 0.08 |
| Solvent (Solv-1') | 0.16 |
| Solvent (Solv-4') | 0.08 |
| 7th Layer (Infrared-sensitive magenta coloring layer): | |
| Silver bromochloride emulsion (1:3 mixture (Ag molar ratio) of cubic silver bromochloride grains comprising 0.8 mol % AgBr localized thereon and having mean grain size of 0.55 μm and grain size fluctuation coefficient of 0.10 and cubic silver bromochloride grains comprising 0.8 mol % AgBr localized thereon and having mean grain size of 0.39 μm and grain size fluctuation coefficient of 0.08) | 0.12 |
| Gelatin | 1.24 |
| Magenta coupler (ExM') | 0.20 |
| Dye image stabilizer (Cpd-2') | 0.03 |
| Dye image stabilizer (Cpd-3') | 0.15 |
| Dye image stabilizer (Cpd-4') | 0.02 |
| Due image stabilizer (Cpd-9') | 0.02 |
| Solvent (Solv-2') | 0.40 |
| 8th Layer (Ultraviolet absorbing layer): | |
| Gelatin | 1.58 |
| Ultraviolet absorbent (UV-1') | 0.47 |
| Color mixing inhibitor (Cpd-5') | 0.05 |
| Solvent (Solv-5') | 0.24 |
| 9th Layer (Red-sensitive cyan coloring layer): | |
| Silver bromochloride emulsion (1:4 mixture (AgBr ratio) of cubic silver bromochloride grains comprising 0.6 mol % AgBr localized thereon and having mean grain size of 0.58 μm and grain size fluctuation coefficient of 0.09 and cubic silver bromochloride grains comprising 0.6 mol % AgBr localized thereon and having mean grain size of 0.45 μm and grain size fluctuation coefficient of 0.11) | 0.23 |
| Gelatin | 1.34 |
| Cyan coupler (ExC') | 0.32 |
| Dye image stabilizer (Cpd-6') | 0.17 |
| Dye image stabilizer (Cpd-7') | 0.40 |
| Dye image stabilizer (Cpd-8') | 0.04 |
| Solvent (Solv-6') | 0.15 |

-continued

| | |
|---|---|
| 10th Layer (Ultraviolet absorbing layer): | |
| Gelatin | 0.53 |
| Ultraviolet absorbent (UV-1') | 0.16 |
| Color mixing inhibitor (Cpd-5') | 0.02 |
| Solvent (Solv-5') | 0.08 |
| 11th Layer (Protective layer): | |
| Gelatin | 1.33 |
| Acryl-modified copolymer of polyvinyl alcohol (modification degree: 17%) | 0.17 |
| Liquid paraffin | 0.03 |

Yellow coupler (ExY')
1:1 mixture (molar ratio) of:

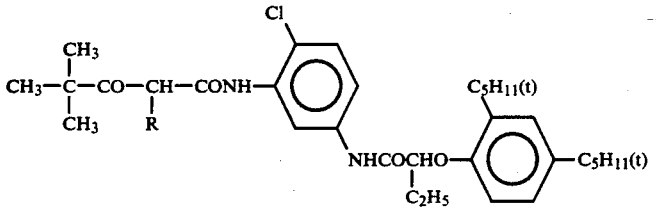

wherein R represents the structure below:

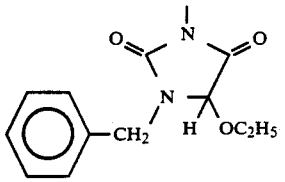

and the same compound except wherein R represents the structure below:

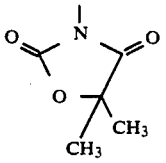

Magenta coupler (ExM')
1:1 mixture (molar ratio) of:

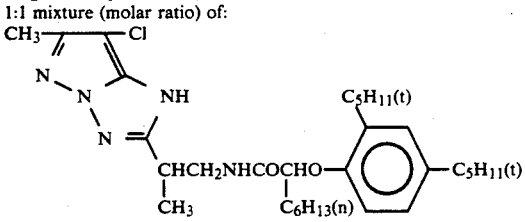

and

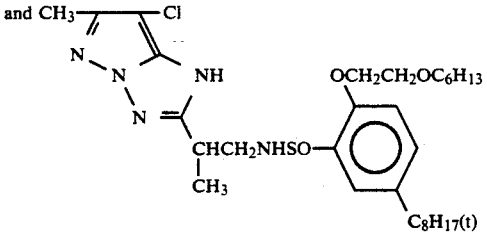

Cyan Coupler (ExC')
2:4:4 mixture (by weight) of:

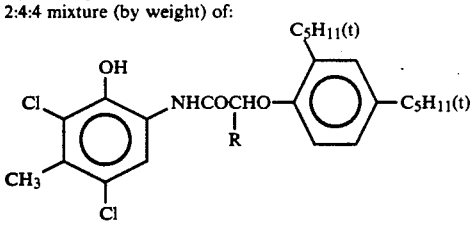

wherein R represents $C_2H_5$, and the same compound
wherein R represents $C_4H_9$, and the same compound wherein R represents

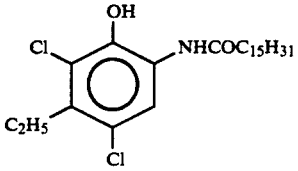

respectively.

-continued

Dye image stabilizer (Cpd-1')

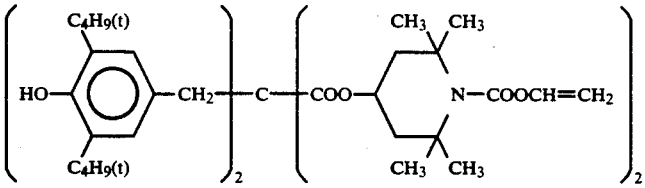

Dye image stabilizer (Cpd-2')

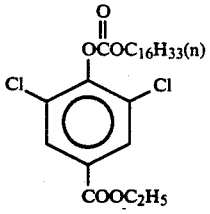

Dye image stabilizer (Cpd-3')

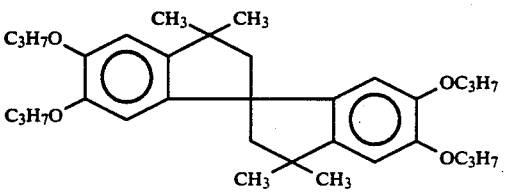

Dye image stabilizer (Cpd-4')

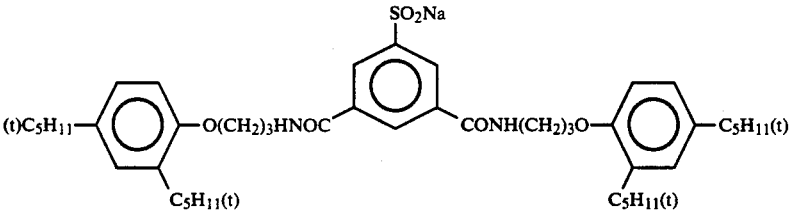

Color mixing inhibitor (Cpd-5')

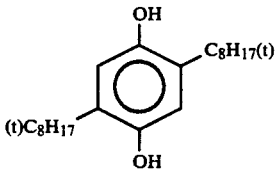

Dye image stabilizer (Cpd-6')
2:4:4 mixture (weight ratio) of:

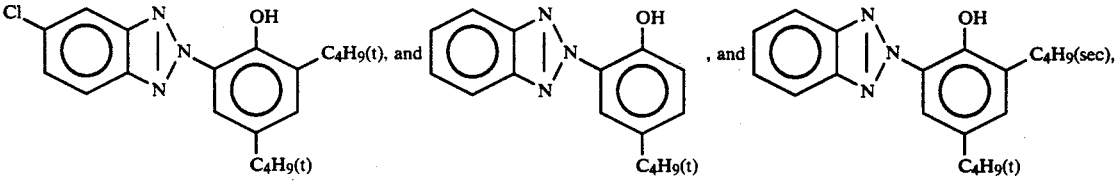

respectively.

Dye image stabilizer (Cpd-7')

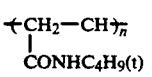

(Mean molecular weight: 60,000)

Dye image stabilizer (Cpd-8')

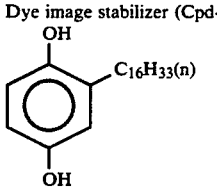

Dye image stabilizer (Cpd-9')

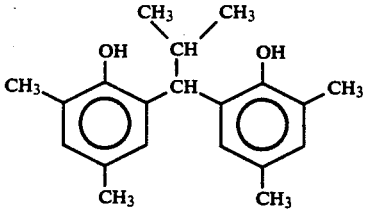

Ultraviolet absorbent (UV-1'):
4:2:4 mixture (weight ratio) of

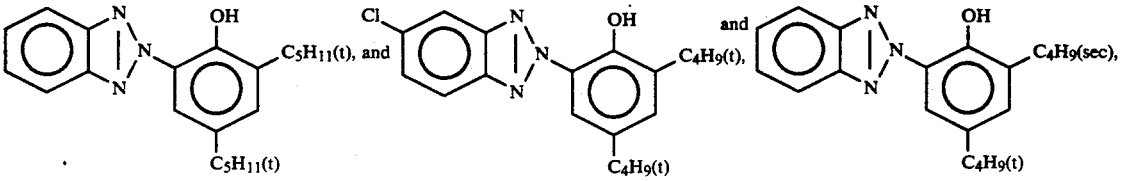

respectively.

-continued

Solvent (Solv-1')

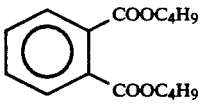

Solvent (Solv-2')
2:1 mixture (volume ratio) of:

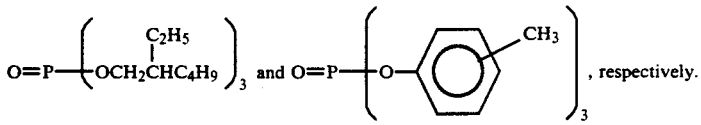

, respectively.

Solvent (Solv-4')

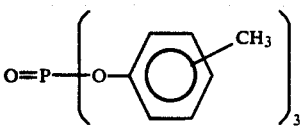

Solvent (Solv-5')

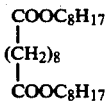

Solvent (Solv-6')

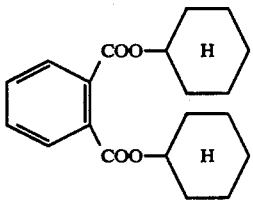

In the light-sensitive material thus prepared, the yellow coloring layer had a maximum spectral sensitivity at 480 nm and 810 nm, the magenta coloring layer had a maximum spectral sensitivity at 550 nm and 750 nm, and the cyan coloring layer had a maximum spectral sensitivity at 710 nm.

An automatic color negative printer and a semiconductor laser exposure apparatus as described in Japanese Patent Application No. 63-226552 (semiconductor laser wavelength: 670 nm, 750 nm, 810 nm) were combined to assemble an exposure apparatus. The light-sensitive material specimen was then imagewise exposed to light through a color negative. Color letters and illustration were input to the same picture by means of the semiconductor laser exposure apparatus.

The specimen thus exposed was then processed with processing solutions having the following compositions in the following steps by means of an automatic developing machine. The running test was continued until an amount of replenishing liquid was twice a volume of tank.

| Processing Step | Temp. | Time | Replenish-rate* | Tank volume for running solution |
|---|---|---|---|---|
| Color development | 35° C. | 45 sec. | 161 ml | 17 l |
| Blix | 30 to 35° C. | 45 sec. | 215 ml | 17 l |
| Rinse 1 | 30 to 35° C. | 20 sec. | — | 10 l |
| Rinse 2 | 30 to 35° C. | 20 sec. | — | 10 l |
| Rinse 3 | 30 to 35° C. | 20 sec. | 350 ml | 10 l |
| Drying | 70 to 80° C. | 60 sec. | | |

*per $m^2$ of light-sensitive material

The washing water was replenished by a so-called counter-flow system in which the overflow from the washing bath (3) is lead through the washing bath (2) to the washing bath (1).

The respective processing solution has the following composition:

| | Running Solution | Replenisher |
|---|---|---|
| Color developing solution | | |
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |

-continued

| | | |
|---|---|---|
| Sodium chloride | 1.4 g | — |
| Potassium carbonate | 25 g | 25 g |
| N-ethyl-N-(β-methanesulfonamideethyl)-3-methyl-4-aminoaniline sulfate | 5.0 g | 7.0 g |
| N,N-bis(carboxymethyl) hydrazine | 5.5 g | 7.0 g |
| Fluorescent brightening agent (WHITEX 4B, available from Sumitomo Chemical Co., Ltd.) | 1.0 g | 2.0 g |
| Water to make | 1,000 ml | 1,000 ml |
| pH (25° C.) | 10.05 | 10.45 |

Blix solution (Running solution has the same composition as replenisher)

| | |
|---|---|
| Water | 400 ml |
| Ammonium thiosulfate (700 g/1) | 100 ml |
| Sodium sulfite | 17 g |
| Ferric ammonium ethylenediaminetetraacetate | 55 g |
| Disodium ethylenediaminetetraacetate | 5 g |
| Ammonium bromide | 40 g |
| Water to make | 1,000 ml |
| pH (25° C.) | 6.0 |

Rinsing solution (Running solution has the same composition as replenisher)

Ion-exchanged water (containing calcium and magnesium in amounts 3 ppm, respectively)

The print thus obtained exhibited an excellent picture quality. Furthermore, color letters and illustration, which had heretofore never been able to be writen on the same picture as color print, could be writen on the print. This could be accomplished quite easily as compared to the conventional process for the preparation of post cards.

EXAMPLE 3

The same light-sensitive material specimen as prepared in Example 2 was imagewise exposed to light through a color negative in an exposure apparatus assembled by combinining an automatic color negative printer and a laser exposure apparatus as described in Japanese Patent Application No. 63-226552 (semiconductor laser wavelength: 670 nm, 750 nm, 810 nm). Color letters and illustration were input to the same picture by means of the semiconductor laser exposure apparatus.

The specimen thus exposed was then processed with processing solutions having the following compositions in the following steps by means of an automatic developing machine.

| Processing step | Temperature | Time |
|---|---|---|
| Color development | 50° C. | 9 sec. |
| Blix | 50° C. | 9 sec. |
| Rinse 1 | 40° C. | 4 sec. |
| Rinse 2 | 40° C. | 4 sec. |
| Rinse 3 | 40° C. | 4 sec. |
| Drying | 90° C. | 14 sec. |

The various processing solutions had the following compositions:

| | |
|---|---|
| **Color developing solution** | |
| Water | 800 ml |
| Ethylenediamine-N,N,N,N-tetramethylenephosphonic acid | 3.0 g |
| N,N-di(carboxymethyl)hydrazine | 4.5 g |
| N,N-diethylhydroxylamine oxalate | 2.0 g |
| Triethanolamine | 8.5 g |
| Sodium sulfite | 0.14 g |
| Potassium chloride | 1.6 g |
| Potassium bromide | 0.01 g |
| Potassium carbonate | 25.0 g |
| N-ethyl-N-(β-methanesulfonamideethyl)-3-methyl-4-aminoaniline sulfate | 5.0 g |
| Fluorescent brightening agent (WHITEX 4B, available from Sumitomo Chemical Co., Ltd.) | 1.4 g |
| Water to make | 1,000 ml |
| pH (25° C.) | 10.05 |
| **Blix solution** | |
| Water | 400 ml |
| Ammonium thiosulfate (55 wt %) | 100 ml |
| Sodium sulfite | 17 g |
| Ferric ammonium ethylenediaminetetraacetate | 55 g |
| Disodium ethylenediaminetetraacetate | 5 g |
| Ammonium bromide | 40 g |
| Glacial acetic acid | 9 g |
| Water to make | 1,000 ml |
| pH (25° C.) | 5.8 |

Rinsing solution

Ion-exchanged water (containing calcium and magnesium ions in amounts of 3 ppm or less and 2 ppm or less, respectively)

The print thus obtained exhibited an excellent picture quality. Furthermore, color letters and illustration, which had heretofore never been able to be written on the same picture as color print, could be written on the print. This could be accomplished quite easily as compared to the conventional process for the preparation of post cards. By this process, prints could be obtained with 1 minute from the imagewise exposure.

While the present invention has been described in detail and with reference to specific embodiments thereof, it will be apparent to one skilled in the art that various changes and modifications can be made therein without departing from the spirit and scope thereof.

What is claimed is:

1. A color image formation method, which comprises exposing a silver halide color photographic material to light in a print exposure process at the same time with a scanning exposure process, wherein said photographic material comprises a support having coated thereon at least three silver halide emulsion layers having maximum spectral sensitivities in at least three sensitive wavelength ranges of 400 nm to 500 nm, 500 nm to 570 nm and 650 nm to 730 nm and is sensitive to said three sensitive wavelength ranges to form yellow, magenta and cyan dye images, respectively, characterized in that said silver halide color photographic material has additionally at least one function to provide a maximum spectral sensitivity in a wavelength range other than said three sensitive wavelength ranges and to form any of yellow, magenta or cyan dye image, wherein said exposing comprises using at least a light source in wavelength range other than said three sensitive material wavelength ranges, and then developing said silver halide color photographic material.

2. A color image formation method as claimed in claimed in claim 1, wherein the provision of maximum spectral sensitivity in wavelength range of 400 nm to 500 nm is involved by using at least one of compounds represented by the general formula (I):

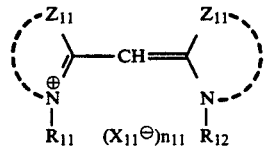

(I)

wherein $Z_{11}$ and $Z_{12}$ each represents an atomic group selected from the group consisting of substituted or unsubstituted benzoxaxole nucleus, substituted or unsubstiltuted naphthoxazole nucleus, substituted or unsubstiltuted benzothiazole nucleus and substituted or unsubstiltuted naphthothiazole nucleus; $R_{11}$ and $R_{12}$ each represents a substituted or unsubstituted alkyl group; $X_{11}^{\theta}$ represents an anion; and $n_{11}$ represents an integer 0 or 1, with the proviso that at least one of $Z_{11}$ and $Z_{12}$ represents a benzothiazole nucleus or naphthothiazole nucleus and that if one of $R_{11}$ and $R_{12}$ forms an inner salt with quarternarized nitrogen atoms, $n_{11}$ is 0.

3. A color image formation method as claimed in claim 1, wherein the provision of maximum spectral sensitivity in wavelength range of 500 nm to 570 nm is involved by using at least one of compounds represented by the general formula (II):

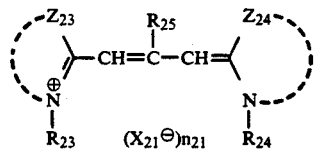

(II)

wherein $Z_{23}$ and $Z_{24}$ each represents an atomic group selected from the group consisting of substituted or unsubstituted benzoxazole nucleus and substituted or unsubstituted naphthoxazole nucleus substituted or unsubstituted benzothiazole nucleus or substituted or unsubstituted naphthothiazole nucleus; $R_{25}$ represents a hydrogen atom or alkyl group; $R_{23}$ and $R_{24}$ each represents a substituted or unsubstituted alkyl group; $X_{21}^{\theta}$ represents an anion; and $n_{21}$ represents an integer 0 or 1, with the proviso that if one of $R_{23}$ and $R_{24}$ forms an inner salt with quarternarized nitrogen atoms, $n_{21}$ is 0.

4. A color image formation method as claimed in claim 1, wherein the provision of maximum spectral sensitivity in wavelength range of 650 nm to 750 nm is involved by using at least one of compounds represented by formula (III):

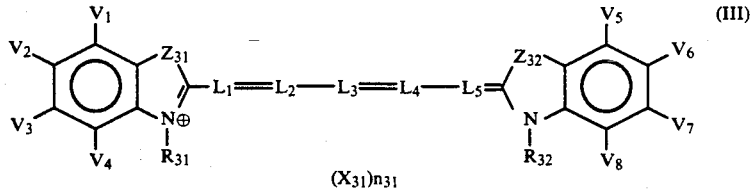

(III)

wherein $Z_{31}$ represents a nitrogen atom, oxygen atom, sulfur atom or selenium atom; $Z_{32}$ represents an oxygen atom, sulfur atom or selenium atom, $L_1$, $L_2$, $L_3$, $L_4$ and $L_5$ each represents a substituted or unsubstituted methine group or may form a ring with other methine groups; $R_{31}$ and $R_{32}$ may be the same or different and each represent an alkyl group; ($R_{31}$and $L_1$) or ($R_{32}$ and $L_5$) may be connected to each other to form a 5- or 6-membered carbon ring; $V_1$, $V_2$, $V_3$, $V_4$, $V_5$, $V_6$, $V_7$ and $V_8$ each represent hydrogen atom, a halogen atom, a substituted or unsubstituted alkyl group, an acyl group, an acyloxy group, an alkoxycarbonyl group, a substituted or unsubstituted carbamoyl group, a substituted or unsubstituted sulfamoyl group, a carboxy group, a cyano group, a hydroxyl group, an amino group, an acylamino group, an alkoxy group, an alkylthio group, a sulfonic group, an alkylsulfonyl group, an aryloxy group, or an aryl group; $X_{31}^{\theta}$ represents an anion or cation and $n_{31}$ represents 0 or more.

5. A color image formation method as claimed in claim 1, wherein the provision of maximum spectral sensitivity in a wavelength range of 720 nm or more is involved by using at least one of compounds represented by the general formula (VI), (VII) or (VIII):

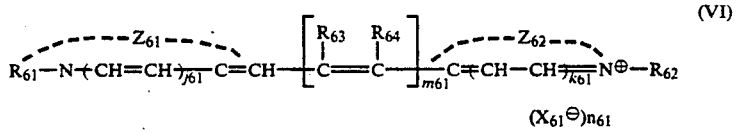

(VI)

wherein $Z_{61}$ and $Z_{62}$ each represents an atomic group to form a heterocyclic nucleus, $R_{61}$ and $R_{62}$ each represent an alkyl group, an alkenyl group, an alkynyl group, or an aralkyl group, $R_{63}$ represents hydrogen atom, $R_{64}$ represents hydrogen atom, a lower alkyl group, or an aralkyl group or is connected to $R_{62}$ to form a 5- or 6-membered ring and when $R_{64}$ represents hydrogen atom, $R_{63}$ may be connected to two or more of other $R_{63}$ to form a hydrocarbon ring or heterocyclic ring, $m_{61}$ represents an integer 1, 2 or 3, $j_{61}$ and $k_{61}$ each represents an integer 0 or 1, $X_{61}^{\theta}$ represents an acid anion and $n_{61}$ represents an integer 0 or 1,

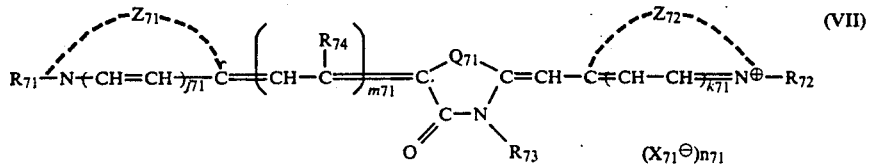

(VII)

wherein $Z_{71}$ and $Z_{72}$ have the same meanings as $Z_{61}$ and $Z_{62}$, respectively, and $R_{71}$ and $R_{72}$ have the same meanings as $R_{61}$ and $R_{62}$, $R_{73}$ represents an alkyl group, an alkenyl group, an alkynyl group; or an aryl group, $R_{74}$ represents hydrogen atom, a lower alkyl group, or an aryl group, or is connected to two or more of other $R_{74}$ to form a hydrocarbon ring or heterocyclic ring, $Q_{71}$ represents a sulfur atom, oxygen atom, selenium atom or $>N—R_{75}$ in which $R_{75}$ has the same meaning as $R_{73}$, $m_{71}$ represents an integer 2 or 3, $j_{71}$, $k_{71}$, $X_{71}^{\theta}$ and $n_{71}$ have the same meanings as $j_{61}$, $k_{61}$, $X_{61}^{\theta}$ and $n_{61}$, defined in the general formula (VI),

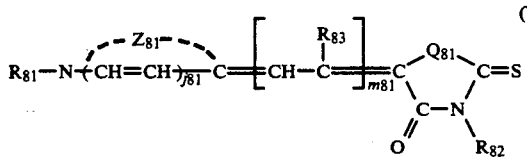

(VIII)

wherein $Z_{81}$ represents an atomic group to form a heterocyclic ring, $Q_{81}$ has the same meaning as $Q_{71}$, $R_{81}$ has the same meaning as $Q_{61}$ or $Q_{62}$, $R_{82}$ has the same meaning as $R_{73}$, $R_{83}$ has the same meaning as $R_{74}$ or is connected to two or more or other $R_{83}$ to form a hydrocarbon ring or heterocyclic ring, $m_{81}$ represents an integer 2 or 3 and $j_{81}$ has the same meaning as $j_{61}$.

6. A color image formation method as claimed in claim 1, wherein a light source for the scanning exposure is a combination of a light-emitting diode, a laser or a semiconductor laser, and a wavelength conversion element comprising non-linear optical materials.

7. A silver halide color photographic material which comprises a support having coated thereon at least three silver halide emulsion layers having maximum spectral sensitivities in at least three sensitive wavelength ranges of 400 nm to 500 nm, 500 nm to 570 nm and 650 nm to 730 nm and is sensitive to said three sensitive wavelength ranges to form yellow, magenta and cyan dye images, respectively, characterized in that said silver halide color photographic material has additionally at least one function to provide a maximum spectral sensitivity in wavelength range other than said three sensitive wavelength ranges and to form any of yellow, magenta or cyan dye image by a scanning to the light of said other wavelength at the same time with printing exposure to light, wherein the function is provided by a photographic layer obtained by a process comprising mixing a mixture of a silver halide emulsion having a maximum spectral sensitivity in a wavelength range of 400 nm to 500 nm and a silver halide emulsion having a maximum spectral sensitivity in a wavelength range other than the three sensitive wavelength ranges, and a yellow coupler, and then coating the thus obtained mixture onto the support.

8. A silver halide color photographic material which comprises a support having coated thereon at least three silver halide emulsion layers having maximum spectral sensitivities in at least three sensitive wavelength ranges of 400 nm to 500 nm, 500 nm to 570 nm and 650 nm to 730 nm and is sensitive to said three sensitive wavelength ranges to form yellow, magenta and cyan dye images, respectively, characterized in that said silver halide color photographic material has additionally at least one function to provide a maximum spectral sensitivity in wavelength range other than said three sensitive wavelength ranges and to form any of yellow, magenta or cyan dye image by a scanning to the light of said other wavelength at the same time with printing exposure to light, wherein the function is provided by a photographic silver halide emulsion layer containing a yellow coupler and silver halide grains spectrally sensitized by both spectral sensitizing dye providing a maximum spectral sensitivity to 400 nm to 500 nm and a spectral sensitizing dye providing a maximum spectral sensitivity to wavelength range other than the three sensitive wavelength ranges.

9. A silver halide color photographic material which comprises a support having coated thereon at least three silver halide emulsion layers having maximum spectral sensitivities in at least three sensitive wavelength ranges of 400 nm to 500 nm, 500 nm to 570 nm and 650 nm to 730 nm and is sensitive to said three sensitive wavelength ranges to form yellow, magenta and cyan dye images, respectively, characterized in that said silver halide color photographic material has additionally at least one function to provide a maximum spectral sensitivity in wavelength range other than said three sensitive wavelength ranges and to form any of yellow, magenta or cyan dye image by a scanning to the light of said other wavelength at the same time with printing exposure to light, wherein the function is provided by a photographic layer obtained by a process comprising mixing a mixture of a silver halide emulsion having a maximum spectral sensitivity in a wavelength range of 500 nm to 570 nm and a silver halide emulsion having a maximum spectral sensitivity in a wavelength range other than the three sensitive wavelength ranges, and a magenta coupler, and then coating the thus obtained mixture onto the support.

10. A silver halide color photographic material which comprises a support having coated thereon at least three silver halide emulsion layers having maximum spectral sensitivities in at least three sensitive wavelength ranges of 400 nm to 500 nm, 500 nm to 570 nm and 650 nm to 730 nm and is sensitive to said three sensitive wavelength ranges to form yellow, magenta and cyan dye images, respectively, characterized in that said silver halide color photographic material has additionally at least one function to provide a maximum spectral sensitivity in wavelength range other than said three sensitive wavelength ranges and to form any of yellow, magenta or cyan dye image by a scanning to the light of said other wavelength at the same time with printing exposure to light, wherein the function is provided by a photographic silver halide emulsion layer containing a magenta coupler and silver halide grains spectrally sensitized by both spectral sensitizing dye providing a maximum spectral sensitivity to 500 nm to 570 nm and spectral sensitizing dye providing a maximum spectral sensitivity to wavelength range other than the three sensitive wavelength ranges.

11. A silver halide color photographic material which comprises a support having coated thereon at least three silver halide emulsion layers having maximum spectral sensitivities in at least three sensitive wavelength ranges of 400 nm to 500 nm, 500 nm to 570 nm and 650 nm to 730 nm and is sensitive to said three sensitive wavelength ranges to form yellow, magenta and cyan dye images, respectively, characterized in that said silver halide color photographic material has additionally at least one function to provide a maximum spectral sensitivity in wavelength range other than said three sensitive wavelength ranges and to form any of yellow, magenta or cyan dye image by a scanning to the light of said other wavelength at the same time with printing exposure to light, wherein the function is provided by a photographic layer obtained by a process comprising mixing a mixture of a silver halide emulsion having a maximum spectral sensitivity in a wavelength range of 650 nm to 730 nm and a silver halide emulsion having a maximum spectral sensitivity in a wavelength range other than the three sensitive wavelength ranges, and a cyan coupler, and then coating the thus obtained mixture onto the support.

12. A silver halide color photographic material which comprises a support having coated thereon at least three silver halide emulsion layers having maximum spectral sensitivities in at least three sensitive wavelength ranges of 400 nm to 500 nm, 500 nm to 570 nm and 650 nm to 730 nm and is sensitive to said three sensitive wavelength ranges to form yellow, magenta and cyan dye images, respectively, characterized in that said silver halide color photographic material has additionally at least one function to provide a maximum spectral sensitivity in wavelength range other than said three sensitive wavelength ranges and to form any of yellow, magenta or cyan dye image by a scanning to the light of said other wavelength at the same time with printing exposure to light, wherein the function is provided by a photographic silver halide emulsion layer containing a cyan coupler and silver halide grains spectrally sensitized by both spectral sensitizing dye providing a maximum spectral sensitivity to 650 nm to 730 nm and spectral sensitizing dye providing a maximum spectral sensitivity to wavelength range other than the three sensitive wavelength ranges.

* * * * *